US005561040A

United States Patent [19]

Kawai et al.

[11] Patent Number: 5,561,040

[45] Date of Patent: Oct. 1, 1996

[54] METHOD FOR FORMING IMAGE

[75] Inventors: Kiyoshi Kawai; Shigeaki Ohtani, both of Minami-ashigara, Japan

[73] Assignee: Fuji Photo Film Co., Ltd., Kanagawa, Japan

[21] Appl. No.: 451,251

[22] Filed: May 26, 1995

Related U.S. Application Data

[63] Continuation of Ser. No. 93,143, Jul. 19, 1993, abandoned, which is a continuation-in-part of Ser. No. 815,865, Jan. 3, 1992, abandoned, which is a continuation of Ser. No. 388,456, Aug. 2, 1989, abandoned.

[30] Foreign Application Priority Data

Aug. 3, 1988 [JP] Japan ..... 63-193671

[51] Int. Cl.[6] ..... G03C 1/46

[52] U.S. Cl. ..... 430/386; 430/387; 430/489; 430/551; 430/554; 430/555; 430/558; 430/613

[58] Field of Search ..... 430/380, 382, 430/383, 467, 469, 372, 376, 489, 544, 555, 551, 611, 387, 386, 558, 613

[56] References Cited

U.S. PATENT DOCUMENTS

| | | | |
|---|---|---|---|
| 4,554,245 | 11/1985 | Hayashi et al. | 430/567 |
| 4,565,774 | 1/1986 | Kajiwara et al. | 430/382 |
| 4,830,955 | 5/1989 | Kajiwara et al. | 430/505 |
| 4,853,319 | 8/1989 | Krishnamurthy et al. | 430/387 |
| 4,853,321 | 8/1989 | Momoki et al. | 430/380 |
| 4,880,728 | 11/1989 | Ishikawa et al. | 430/380 |
| 4,965,175 | 10/1990 | Fujimoto et al. | 430/375 |
| 5,001,042 | 3/1991 | Hasebe | 430/382 |
| 5,094,937 | 3/1992 | Morimoto et al. | 430/485 |
| 5,108,877 | 4/1992 | Asami | 430/377 |
| 5,110,713 | 5/1992 | Yoshida et al. | 430/372 |
| 5,110,714 | 5/1992 | Furusawa et al. | 430/376 |
| 5,118,592 | 6/1992 | Hasebe | 430/376 |
| 5,153,108 | 10/1992 | Ishikawa et al. | 430/372 |
| 5,162,195 | 11/1992 | Inagaki | 430/377 |
| 5,173,395 | 12/1992 | Asami | 430/376 |
| 5,238,789 | 8/1993 | Ohshima | 430/372 |
| 5,250,407 | 10/1993 | Kase | 430/555 |
| 5,264,330 | 11/1993 | Yoshida et al. | 430/351 |

FOREIGN PATENT DOCUMENTS

| | | |
|---|---|---|
| 62-170955 | 7/1987 | Japan . |
| 63-36245 | 2/1988 | Japan . |
| 63-46440 | 2/1988 | Japan . |
| 63-106655 | 11/1988 | Japan . |

*Primary Examiner*—Hoa Van Le

*Attorney, Agent, or Firm*—Sughrue, Mion, Zinn, Macpeak & Seas

[57] ABSTRACT

There is provided a method for forming an image, which comprises processing a silver halide color photographic material that has a high-silver-chloride silver halide emulsion and which contains in the photographic material a nitrogen-containing heterocyclic compound, the solubility product of which for the silver salt is in a limited range, with a color developer containing chloride ions and bromide ions in a limited concentration, respectively. The method is excellent in forming an image that can be performed rapidly, and is high in sensitivity, in prevention of processing color-mixing, and in less fluctuation of the photographic quality involved in continuous processing.

14 Claims, No Drawings

METHOD FOR FORMING IMAGE

This is a continuation of application Ser. No. 08/093,143 filed Jul. 19, 1993 now abandoned, which is a continuation-in-part application of application Ser. No. 07/815,865 filed Jan. 3, 1992 now abandoned, which is a continuation of application Ser. No. 07/388,456 filed Aug. 2, 1989, now abandoned.

FIELD OF THE INVENTION

The present invention relates to a method for forming an image of a silver halide photographic material, and more particularly to a method for forming an image a silver halide photographic material high in sensitivity and good in color reproduction that uses a high-silver-chloride silver halide photographic material, and that is suitable for rapid processing.

BACKGROUND OF THE INVENTION

Generally, a silver halide photographic material consists of a base and a photographic layer applied on the base. Herein the photographic layer includes a photosensitive silver halide emulsion layer and a non-photosensitive hydrophilic colloid layer.

In the case of silver halide color photographic materials, three kinds of silver halide photographic emulsion layers photosensitive to blue light, green light, and red light, respectively, are applied on a base. These layers contain couplers that are sensitive to blue light, green light, and red light, which, after exposure to these lights, can react with the oxidized product of an aromatic primary amine developing agent at the time of development, thereby forming yellow color, magenta color, and cyan color.

For color print papers, recently, along with the improvement in productivity of photographic prints, the shortening of the delivery time of finished papers, and the reduction of labor in laboratories, there are increasing demands that development processing be made more rapid and photographic materials be made more sensitive, and various measures have been taken toward these ends.

As a way of shortening the periods of processing steps, though usually the temperature is elevated or the replenishing amount is increased, many other techniques have been proposed, including the intensification of stirring or the addition of various accelerating agents.

Among others, for the purpose of making color development rapid and/or lowering the replenishing amount, a method for processing a color photographic material containing a silver chloride emulsion, instead of the conventionally widely used silver bromide emulsions or silver bromoiodide emulsions, is known. For example, a method for processing rapidly a high-silver-chloride silver halide color photographic material with a color developer substantially free from sulfite ions and benzyl alcohol is described in WO 87-04534.

However, when development processing is carried out using the above method, the part where yellow formation and/or cyan formation should fundamentally occur has magenta formation additionally, that is, so-called processing color-contamination occurs, so that the method was unpreferable in view of color reproduction. Further, it was found that fluctuation of the maximum density was great in continuous processing.

Further, it was found that the more the processing temperature was increased to make the color development speed high, and the more the silver chloride content in the silver halide emulsion grains was increased, the more these phenomena increased.

Thus rapid processing that uses a high-silver-chloride color photographic material involved serious problems, i.e. processing color-contamination, and fluctuation of the color density, and therefore such processing could not be used practically.

As a technique of lessening processing color-contamination, it is effective to increase the amount of the hydroquinone derivative in the non-photosensitive layer, but in view of rapid processing the technique was not considered a preferable measure to solve the problem, because the sensitivity of the photographic material lowers and the time required for drying is increased.

With respect to fluctuation of the maximum density in processing, it was found that fluctuation can be fairly lessened when a coupler was improved, for example, when a coupler as shown in WO 88-04795 was used as a magenta coupler. However, when such a coupler was used, although the fluctuation of the maximum color density was lessened, processing color-contamination was made worse, contrary to the expected result, and therefore a technique of satisfactorily lessening the fluctuation of maximum density and also obviating the processing color-contamination could not be provided.

Further, JP-A ("JP-A" means unexamined published Japanese patent application) No. 70552/1986 discloses a method for lowering the replenishing amount of a developer wherein a high-silver-chloride color photographic material is used, and during the development a replenisher is added to the developing bath in such an amount that will not cause overflow; and JP-A No.106655/1988 discloses a method that intends to stabilize processing and develops a silver halide color photographic material comprising silver halide emulsion layers high in silver chloride content with a color developer containing a hydroxylamine compound and a chloride in a prescribed concentration or over. However, these methods could not obviate processing color-contamination and the fluctuation of the maximum density as stated above, and therefore they could not be practically used.

Although chloride ions or bromide ions are known as antifoggants, when the ions are used alone, the effect of lessening processing color-contamination is low, and further, if the ions are added in such an amount that only a slight effect of lessening processing color-contamination can be recognized, adverse influences take place in that the development is made slow and the maximum density is lowered, contrary to the expected result.

Further, nitrogen-containing heterocyclic compounds are known as antifoggants and anti-aging stabilizers. However, if such a compound is used alone, although fluctuation of the maximum density is lessened slightly, little effect in lessening processing color-contamination is recognized.

Therefore, it was required to develop a silver halide color photographic material suitable for rapid processing that was in processing color-contamination and also low in fluctuation of photographic quality (the maximum density), and a method for processing the same.

The present inventors have studied in various ways and found that when a silver halide color photographic material that has high-silver-chloride silver halide emulsions comprising 80 mol % or over of silver chloride, and which contains a nitrogen-containing heterocyclic compound, the solubility product of the silver salt of which is $10^{-10}$ or less but $10^{-18}$ or more, is processed with a color developer containing chloride ions in an amount of $3.5\times10^{-2}$ to $1.5\times10^{-1}$ mol/l, and bromide ions in an amount of $3.0\times10^{-5}$ to $1.0\times10^{-3}$ mol/l, processing color-contamination is lessened and the fluctuation of the maximum density is made small.

BRIEF SUMMARY OF THE INVENTION

Therefore, a first object of the present invention is to provide a method for forming an image that can be performed rapidly, is high in sensitivity, and which is improved with respect to processing color-contamination, using a high-silver-chloride color photographic material.

A second object of the present invention is to provide a method for forming an image in which fluctuation of the photographic quality (maximum density) involved in continuous processing is remarkably suppressed, using a high-silver-halide color photographic material.

The above and other objects, features, and advantages of the invention will become apparent in the following description.

DETAILED DESCRIPTION OF THE INVENTION

In accordance with the present invention there is provided a method for processing a silver halide color photographic material that has silver halide emulsion layers, at least one of which has a high-silver-chloride silver halide emulsion comprising 80 mol % or over of silver chloride, and which contains in said photographic material a nitrogen-containing heterocyclic compound, the solubility product of the silver salt of which is $10^{-10}$ or less but $10^{-18}$ or more, with a color developer containing chloride ions in an amount of $3.5\times10^{-2}$ to $1.5\times10^{-1}$ mol/l, and bromide ions in an amount of $3.0\times10^{-5}$ to $1.0\times10^{-3}$ mol/l.

The color photographic material of the present invention can be constituted by applying at least each of a blue-sensitive silver halide emulsion layer, a green-sensitive silver halide emulsion layer, and a red-sensitive silver halide emulsion layer on a base. For common color print papers, the above silver halide emulsion layers are applied in the above-stated order on the base, but the order may be changed. Color reproduction by the subtractive color process can be performed by incorporating; into these photosensitive emulsion layers, silver halide emulsions sensitive to respective wavelength ranges, and so-called couplers capable of forming dyes complementary to light to which the couplers are respectively sensitive, that is, capable of forming yellow complementary to blue, magenta complementary to green, and cyan complementary to red. However, the constitution may be such that the photosensitive layers and the color formed from the couplers do not have the above relationship.

As the silver halide emulsion used in the present invention, one substantially free from silver iodide and having a silver chloride content of 80 mol % or over, based on the total silver halide, can be preferably used. Herein the term "substantially free from silver iodide" means that the silver iodide content is 1 mol % or below, and preferably 0.2 mol % or below. Although the halogen compositions of the emulsions may be the same or different from grain to grain, if emulsions whose grains have the same halogen composition are used, it is easy to make the properties of the;grains homogeneous. With respect to the halogen composition distribution in a silver halide emulsion grain, for example, a grain having a so-called uniform-type structure, wherein the composition is uniform throughout the silver halide grain, a grain having a so-called layered-type structure, wherein the halogen composition of the core of the silver halide grain is different from that of the shell (which may comprises a single layer or layers) surrounding the core, or a grain having a structure with nonlayered parts different in halogen composition in the grain or on the surface of the grain (if the nonlayered parts are present on the surface of the grain, the structure has parts different in halogen composition joined onto the edges, the corners, or the planes of the grain) may be suitably selected and used. To secure high sensitivity, it is more advantageous to use either of the latter two than to use grains having a uniform-type structure, which is also preferable in view of the pressure resistance. If the silver halide grains have the above-mentioned structure, the boundary section between parts different in halogen composition may be a clear boundary, or an unclear boundary, due to the formation of mixed crystals caused by the difference in composition, or it may have positively varied continuous structures.

The silver chloride content of these high-silver-chloride emulsions is preferably 90 mol % or over, and more preferably 95 mol % or over.

In these high-silver-chloride emulsions, the structure is preferably such that the silver bromide localized layer in the layered form or nonlayered form is present in the silver halide grain arid/or on the surface of the silver halide grain as mentioned above. The silver bromide content of the composition of the above-mentioned localized layer is preferably at least 10 mol %, and more preferably over 20 mol %. The localized layer may be present in the grain, or on the edges, or corners of the grain surfaces, or on the planes of the grains, and a preferable example is a localized layer epitaxially grown on each corner of the grain.

On the other hand, for the purpose of suppressing the lowering of the sensitivity as much as possible when the photographic material undergoes pressure, even in the case of high-silver-chloride emulsions having a silver chloride content of 90 mol % or over, it is preferably also practiced to use grains having a uniform-type structure, wherein the distribution of the halogen composition in the grain is small.

In order to reduce the replenishing amount of the development processing solution, it is also effective to increase the silver chloride content of the silver halide emulsion. In such a case, an emulsion whose silver chloride is almost pure, that is, whose silver chloride content is 98 to 100 mol %, is also preferably used.

The average grain size of the silver halide grains contained in the silver halide emulsion used in the present invention (the diameter of a circle equivalent to the projected area of the grain is assumed to be the grain size, and the number average of grain sizes is assumed to be an average grain size) is preferably 0.1 to 2 μm.

Further, the grain size distribution thereof is preferably one that is a so-called monodisperse dispersion, having a deviation coefficient (obtained by dividing the standard deviation of the grain size by the average grain size) of 20% or below, and desirably 15% or below. In this case, for the purpose of obtaining one having a wide latitude, it is also preferable that monodisperse emulsions as mentioned above are blended to be used in the same layer, or are applied in layers.

As to the shape of the silver halide grains contained in the photographic emulsion, use can be made of grain in a regular crystal form, such as cubic, tetradecahedral, or octahedral, or grains in an irregular crystal form, such as spherical or planar, or grains that are a composite of these. Also, a mixture of silver halide grains having various-crystal forms can be used. In the present invention, of these, grains containing grains in a regular crystal form in an mount of 50% or over, preferably 70% or over, and more preferably 90% or over, are preferred.

Further, besides those mentioned above, an emulsion wherein the tabular grains having an average aspect ratio (the diameter of a circle calculated/the thickness) of 5 or over, and preferably 8 or over, exceed 50% of the total of the grains in terms of the projected area, can be preferably used.

The high-silver-chloride emulsion used in the present invention can be prepared by methods described, for example, by P. Glafkides, in *Chimie et Phisique Photographique* (published by Paul Montel, 1967), by G. F. Duffin in *Photographic emulsion Chemistry* (published by Focal Press, 1966), and by V. L. Zelikman et al. in *Making and Coating Photographic Emulsion* (published by Focal Press, 1964). That is, any of the acid process, the neutral process, the ammonia process, etc. can be used, and to react a soluble silver salt and a soluble halide, for example, any of the single-jet process, the double-jet process, or a combination of these can be used. A process of forming grains in an atmosphere having excess silver ions (the so-called reverse precipitation process) can also be used. A process wherein the pAg in the liquid phase where a silver halide is to be formed is kept constant, that is, the so-called controlled double-jet process, can be used as one type of double-jet process. According to the controlled double-jet process, a silver halide emulsion wherein the crystal form is regular and the grain sizes are nearly uniform can be obtained.

Into the silver halide emulsion used in the present invention, various polyvalent metal ion impurities can be introduced during the information or physical ripening of the emulsion grains. Examples of such compounds to be used include salts of cadmium, zinc, lead, copper, and thallium, and salts or complex salts of an element of Group VIII, such as iron, ruthenium, rhodium, palladium, osmium, iridium, and platinum. Particularly the elements of Group VIII can be preferably used. Although the mount of these compounds to be added varies over a wide range according to the purpose, preferably the amount is $10^{-9}$ to $10^{-2}$ mol for the silver halide.

The silver halide emulsion used in the present invention is generally chemically sensitized and spectrally sensitized.

With respect to the chemical sensitization, sulfur sensitization, wherein typically an unstable sulfur compound is added, noble metal sensitization—typically gold sensitization—or reduction sensitization, can be used alone or in combination. With respect to compound s used in the chemical sensitization, it is preferable to use those described in JP-A No. 215372/1987, in the lower right column on page 18 to the upper right column on page 22.

Spectral sensitization is performed for the emulsions of the layers of the present photographic material, so as to provide the emulsions with spectral sensitivities in the desired light wavelength ranges. In the present invention, it is preferable to add a dye for absorbing light in the wavelength range corresponding to the intended spectral sensitivity, that is, a spectral-sensitizing dye. As the spectral-sensitizing dye used, those described, for example, by F. M. Harmer in *Heterocyclic compounds—Cyanine dyes and related compounds* (published by John Wiley & Sons New York, London, 1964) can be mentioned. Examples of specific compounds are preferably those described in the above-mentioned JP-A No. 215272/1987, page 22 (the upper right column) to page 38.

The emulsion used in the present invention may be any of the so-called surface sensitive emulsions, wherein a latent image will be formed mainly on the grain surfaces, or a so-called internal latent image emulsion, wherein a latent image will be formed mainly inside the grains.

The nitrogen-containing heterocyclic compound that can be used in the present invention is preferably one the solubility product of the silver salt of which is $10^{-10}$ to $10^{-18}$, and more preferably $10^{-10.5}$ or less but up to $10^{-16.5}$ or more, in water at 25° C. Herein the solubility product is determined as follows:

The definition of solubility product:

In a saturated aqueous solution of a silver salt at 25° C., the solubility product $(Ksp)=[Ag^{\oplus}]\times[X^{\ominus}]$, wherein $Ag^{\oplus}$ denotes the concentration of the silver ions in mol/l, and $X^{\ominus}$ denotes the concentration of the heterocyclic compound ions in mol/l.

Although there is no limitation on the nitrogen-containing heterocyclic compound of the present invention if the solubility product thereof is in the above-mentioned range, particularly preferable nitrogen-containing heterocyclic compounds are, for example, triazoles, benztriazoles (e.g., 5-methylbenztriazole, 5-nitrobenztriazole, 5-chlorobenztriazole, and 5-bromobenztriazole), benzimidazoles (e.g., 6-nitrobenzimidazole, 6-methylbenzimidazole, 2-methylbenzimidazole, 2-thiazolylbenzimidazole, and 2-thiazolylmethylbenzimidazole), tetraazaindenes, mercaptotetraazaindenes (e.g., 4-mercapto-6-methyl-1,3,3a,7-mercaptotetraazaindene), mercaptotriazoles (e.g., 1-ethyl-2-mercapto-5-amino-1,3,4-triazole, 2-mercapto- 5-amino-1,3,4-triazole, 2-mercapto-5-acetamido-1,3,4-triazole, and 1-methyl-2-mercapto-5-acetamido-3,4-triazole), tetrazoles, mercaptotetrazoles (e.g., 1-phenyl-5-mercaptotetrazole, 1-(5-methylureidophenyl)-5-mercaptotetrazole, and 1-ethyl-5-mercapto-1,2,3,4-tetrazole), mercaptothiadiazoles (e.g., 2-mercapto-5-amino- 1,3,4-thiadiazole), mercaptobenzimidazoles, mercaptobenzothiazoles, mercaptothiazolines, pyrimidines, (e.g., 2-mercapto-4-methyl-6,6'-dimethylpyrimidine), indazoles (e.g., 5-nitroindazole), hydroxyazaindolizine, and adenine. The method of determining the solubility product and the value of the solubility product of each compound are described in detail by James in *The Theory of the Photographic Process,* 4th edition, (1977), pages 7 to 10.

The nitrogen-containing heterocyclic compound that can be used in the present invention can be used by adding it to the silver halide photosensitive layer or the non-photosensitive layer. In this case, the nitrogen-containing heterocyclic compound may be contained only in the silver halide photosensitive layer, or only in the non-photosensitive layer, or in both the silver halide photosensitive layer and the non-photosensitive layer. Several nitrogen-containing heterocyclic compounds can be also used, and the combination thereof can be altered in the photosensitive layer and the non-photosensitive layer. Preferably when the nitrogen-containing heterocyclic compound is contained in the photosensitive layer, the effect of the present invention is further improved. More preferably, a nitrogen-containing heterocyclic compound is included in a green-sensitive silver halide emulsion layer.

There is no particular limitation on the stage when the nitrogen-containing heterocyclic compound of the present invention is added. That is, if the nitrogen-containing heterocyclic compound of the present invention is added to the silver halide emulsion layer, it can be added when the silver halide emulsion grains are prepared (when the grains are formed or before, during, or after the chemical sensitization), or when the coating solution is prepared. Preferably, part of the nitrogen-containing heterocyclic compound is added during the formation of the emulsion grains, and the remaining part is added when the coating solution is prepared.

Although the amount of the nitrogen-containing heterocyclic compound to be added varies depending on the solubility product of the silver salt thereof, preferably the amount thereof to be added is about $1\times10^{-5}$ to $5\times10^{-1}$ mol, and more preferably $1\times10^{-4}$ to $1\times10^{-1}$ mol, per mol of the silver halide. If several nitrogen-containing heterocyclic compounds are used, it is preferable that the total amount thereof falls within the above range.

The coating amount of silver of the silver halide photographic material of the present invention is 0.90 g/m$^2$ or less, and preferably 0.75 g/m$^2$ or less. If the coating silver amount exceeds 0.90 g/m$^2$, the photographic fluctuation (fluctuation of the maximum density) involved in continuous processing becomes great, not leading to the attainment of the objects of the present invention.

In the present invention, it is required that the color developer contains chloride ions in an amount of $3.5\times10^{-2}$ to $1.5\times10^{-1}$ mol/l, and preferably $4\times10^{-2}$ to $1\times10^{-1}$ mol/l. If the concentration of chloride ions exceeds $1.5\times10^{-1}$ mol/l, disadvantageously the development is made slow and the sensitivity is made low, not leading to the attainment of the objects of the present invention. On the other hand, if the concentration of chloride ions is less than $3.5\times10^{-2}$ mol/l, the processing color-contamination increases, not leading to the attainment of the objects of the present invention.

In the present invention, it is required that at the same time the color developer also contains bromide ions in an amount of $3.0\times10^{-5}$ to $1.0\times10^{-3}$ mol/l, and preferably $5\times10^{-5}$ to $5\times10^{-4}$ mol/l . If the concentration of bromide ions is more than $1\times10^{-3}$ mol/l, such disadvantages occur that the development is made slow, the sensitivity is made low, and the maximum density is made low, not leading to the attainment of the objects of the present invention. On the other hand, if the concentration of bromide ions is less than $3.0\times10^{-5}$ mol/l, the process color-contamination increases, not leading to the attainment of the objects of the present invention.

In the present invention, it is required that the concentration of chloride ions and the concentration of bromide ions are both within the above-mentioned ranges, and if one of the concentrations falls outside the above-mentioned range, the objects of the present invention cannot be attained. It is considered that, by balancing favorably the difference of the development-retarding effect of the chloride ions, the bromide ions, and the nitrogen-containing heterocyclic compound from the solubility-restraining effect of the chloride ions, the bromide ions, and the nitrogen-containing heterocyclic compound on the silver halide emulsion grains, the processing color-contamination and fluctuation of the color density are suppressed while retaining rapid development speed and high sensitivity.

Herein, chloride ions and bromide ions may be added directly to the developer, or the may be allowed to dissolve out from the photographic material in the developer.

If chloride ions are added directly to the color developer, as the chloride ion-supplying material can be mentioned sodium chloride, potassium chloride, ammonium chloride, lithium chloride, nickel chloride, magnesium chloride, manganese chloride, calcium chloride, and cadmium chloride, with sodium chloride and potassium chloride preferred. Chloride ions may be supplied from a brightening agent that will be added to the developer. As the bromide ion-supplying material can be mentioned sodium bromide, potassium bromide, ammonium bromide, lithium bromide, calcium bromide, magnesium bromide, manganese bromide, nickel bromide, cadmium bromide, thallium bromide, and cerium bromide, with potassium bromide and sodium bromide preferred.

When chloride ions and bromide ions are allowed to dissolve out from the photographic material in the developer, both the chloride ions and bromide ions may be supplied from the emulsion or a source other than the emulsion.

Generally, a yellow coupler, a magenta coupler, and a cyan coupler that will couple with the oxidized product of an aromatic amine color-developing agent to develop yellow, magenta, and cyan, respectively, are used in the color photographic material.

Of yellow couplers that can be used in the present invention, acylacetamide derivatives, such as pivaloylacetanilide and benzoylacetanilide, are preferable.

As the yellow coupler, among others, couplers represented by the following formulae (Y-1) and (Y-2) are preferable:

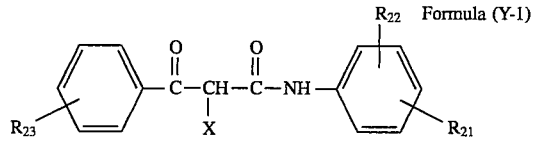

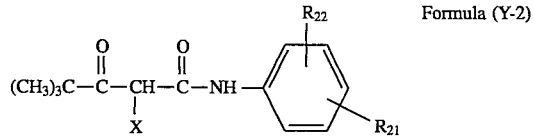

wherein X represents a hydrogen atom or a coupling split-off group, $R_{21}$ represents a ballast group having 8 to 32 carbon atoms in all, $R_{22}$ represents a hydrogen atom, one or more halogen atoms, a lower alkyl group, a lower alkoxy group, or a ballast group having 8 to 32 carbon atoms in all, $R_{23}$ represents a hydrogen atom or a substituent, and if there are two or more $R_{23}$'s, they may be the same or different.

Details of pivaloylacetanilide yellow couplers are described in U.S. Pat. No. 4,622,287 (column 3, line 15 to column 8, line 39) and U.S. Pat. No. 4,623,616 (column 14, line 50 to column 19, line 41).

Details of benzoylacetanilide yellow couplers are described in U.S. Pat. Nos. 3,408,194, 3,933,501, 4,046,575, 4,133,958, and 4,401,752.

Specific examples of pivaloylacetanilide yellow couplers are compound examples (Y-1) to (Y-39), described in the abovemmentioned U.S. Pat. No. 4,622,287 (columns 37 to 54), and among others, (Y-1), (Y-4), (Y-6), (Y-7), (Y-15), (Y-21), (Y-22), (Y-23), (Y-26), (Y-35), (Y-36), (Y-37), (Y-38), and (Y-39) are preferable.

Further, compound examples (Y-1) to (Y-33), described in the above-mentioned U.S. Pat. No. 4,623,616 (Columns 19 to 24), can be mentioned, and among others, For example, (Y-2), (Y-7), (Y-8), (Y-12), (Y-20), (Y-21), (Y-23), and (Y-29) are preferable.

Other preferable compounds include a typical example (34) described in U.S. Pat. No. 3,408,194 (column 6), compound examples (16) and (19) described in U.S. Pat. No. 3,933,501 (column 8), compound example (9) described in U.S. Pat. No. 4,046,575 (columns 7 to 8), compound example (1) described in U.S. Pat. No. 4,133,958 (columns 5 to 6), compound example 1 described in U.S. Pat. No. 4,401,752 (column 5), and compounds (a) to (h) given below.
Of the above couplers, ones whose atom that can be coupling split-off is a nitrogen atom are particularly preferable.
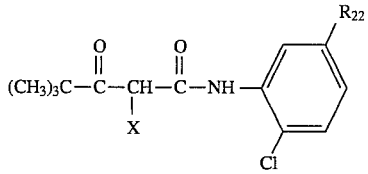
| Compound | $R_{22}$ | X |
|---|---|---|
| a | $-CO_2CH(CH_3)CO_2C_{12}H_{25}$ | 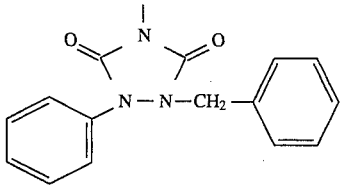 |
| b | $-CO_2CH(C_4H_9)CO_2C_{12}H_{25}$ | 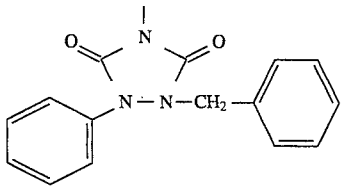 |
| c | 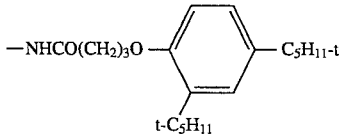 | 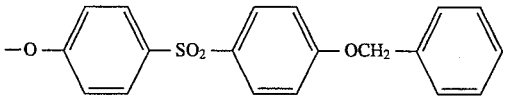 |
| d | 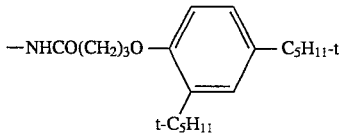 | 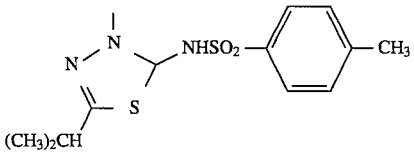 |
| e | 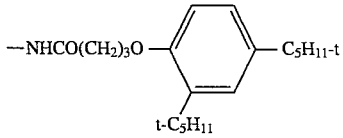 | 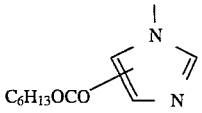 |
| f | $-NHSO_2C_{12}H_{25}$ | 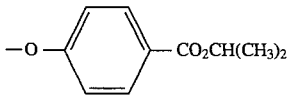 |
| g | $-NHSO_2C_{16}H_{33}$ | 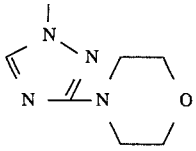 |
| h | $-NHCO(CH_3)CHCH_2SO_2C_{12}H_{25}$ | 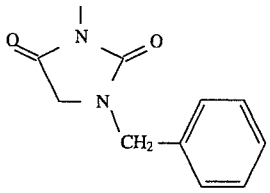 |

Magenta couplers used in the present invention include oil-protected-type indazolone couplers, cyanoacetyl couplers, preferably 5-pyrazolone couplers, and pyrazoloazole couplers, such as pyrazolotriazoles. Among 5-pyrazolone couplers, couplers wherein an arylamino group or an acylamino group is substituted at the 3-position are preferable in view of the color density and the hue of the color-developed dye, and typical examples thereof are described, for example, in U.S. Pat. Nos. 2,311,082, 2,343,703, 2,600,788, 2,908,573, 3,062,653, 3,152,896, and 3,936,015. As the coupling split-off group of 2-equivalent 5-pyrazolone couplers, nitrogen-linked coupling split-off groups, described in U.S. Pat. No. 4,310,619, and arylthio groups, described in U.S. Pat. No. 4,351,897, are preferable. 5-pyrazolone couplers having a ballast group described in European Patent No. 73,636 can give a high color density.

As pyrazoloazole couplers can be mentioned pyrazolobenzimidazoles, described in U.S. Pat. No. 2,369,879, preferably pyrazolo(5,1-c)(1,2,4)triazoles, described in U.S. Pat. No. 3,725,067, pyrazolotetrazoles, described in *Research Disclosure* 24220 (June 1984), and pyrazolopyrazoles, described in *Research Disclosure* 24230 (June 1984).

These compounds can be represented specifically by the following formula (M-1), (M-2) or (M-3).

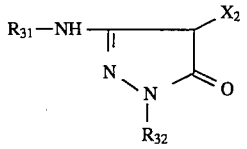

Formula (M-1)

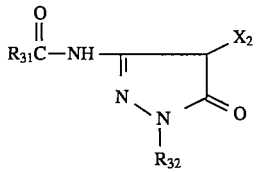

Formula (M-2)

-continued

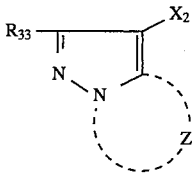

Formula (M-3)

wherein $R_{31}$ represents a ballast group having 8 to 32 carbon atoms in all, $R_{32}$ represents an optionally substituted phenyl group, $R_{33}$ represents a hydrogen atom or a substituent, Z represents a group of non-metal atoms required for forming a 5-membered azole ring containing 2 to 4 nitrogen atoms that may have a substituent (inclusive of a condensed ring), and $X_2$ represents a hydrogen atom or a coupling split-off group.

Details of the substituents represented by $R_{33}$ and the substituents that will be possessed by the azole ring are described in U.S. Pat. No. 4,540,654 (column 2, line 41 to column 8 line 27).

Of pyrazoloazole couplers, imidazo(1,2-b)pyrazoles, described in U.S. Pat. No. 4,500,630, and pyrazolo(1,5-b)(1,2,4)triazoles, described in U.S. Pat. No. 4,540,654, are particularly preferable in view of the lowness in the yellow subsidiary absorption of the color-developed dye, and the light-fastness.

In addition, pyrazolotriazole couplers, wherein branched alkyl groups are attached directly to 2-, and 3- or 6-positions of the pyrazolotriazole ring, as described in JP-A No. 65245/1986, pyrazoloazole couplers containing a sulfonamido group in the molecule, described in JP-A No. 65246/1986, pyrazoloazole couplers having an alkoxyphenylsulfonamido ballast group, as described in JP-A No. 147254/1986, and pyrazolotriazole couplers having an alkoxy group or an aryloxy group at the 6-position, described in European Patent (Publication) No. 226,849, are preferably used.

Specific examples of these couplers are listed below:

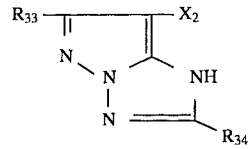
| Compound | $R_{33}$ | $R_{34}$ | $X_2$ |
|---|---|---|---|
| M'-1 | $CH_3-$ | 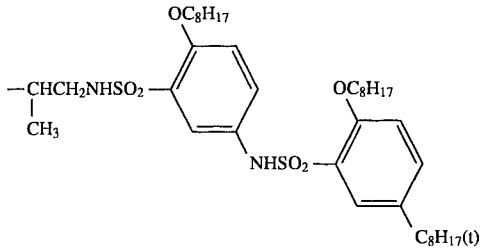 | Cl |
| M'-2 | $CH_3-$ | 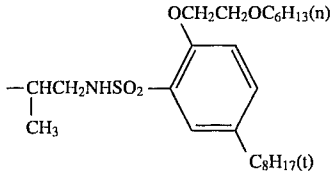 | Cl |
| M'-3 | $CH_3-$ | 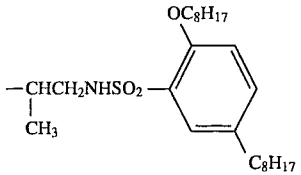 | 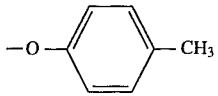 |
| M'-4 | 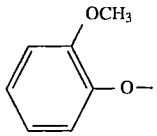 | 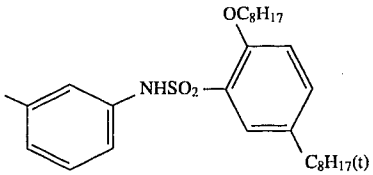 | 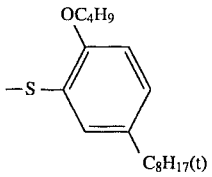 |

-continued
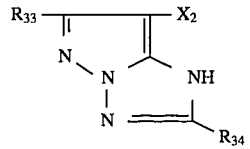
| Compound | $R_{33}$ | $R_{34}$ | $X_2$ |
|---|---|---|---|
| M'-5 | $CH_3-$ | 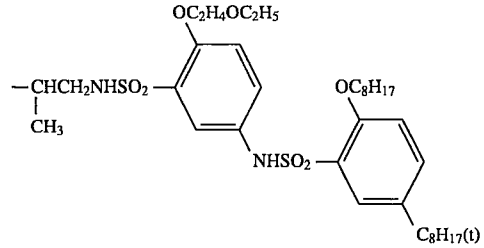 | Cl |
| M'-6 | $CH_3-$ | 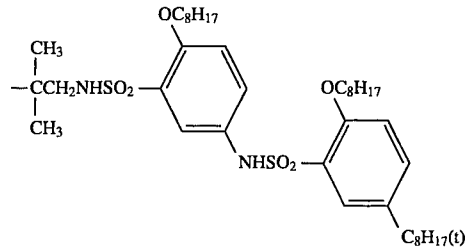 | Cl |
| M'-7 | 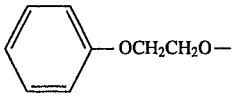 | 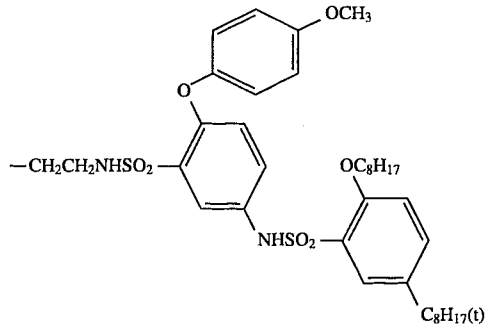 | 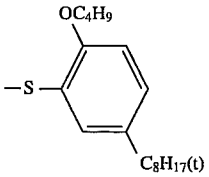 |

-continued
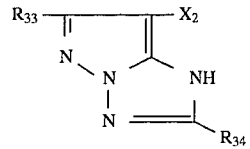
| Compound | $R_{33}$ | $R_{34}$ | $X_2$ |
|---|---|---|---|
| M'-8 | $CH_2CH_2O-$ | 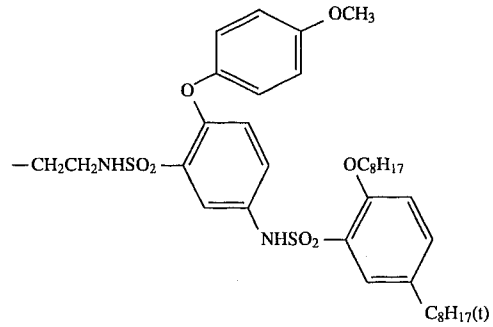 | 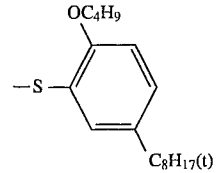 |
| M'-9 | 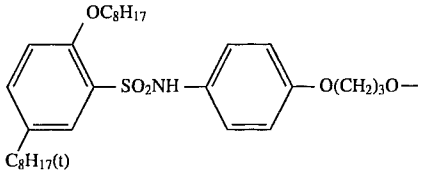 | 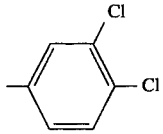 | 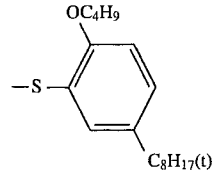 |
| M'-10 | 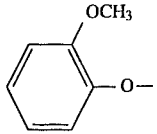 | 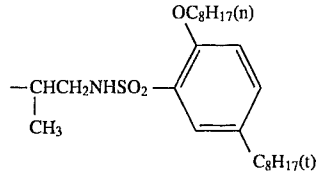 | Cl |
| M'-11 | $CH_3-$ | 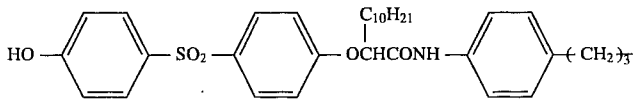 | Cl |
| M'-12 | $CH_3-$ | 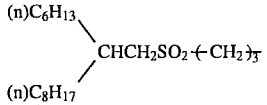 | Cl |

-continued
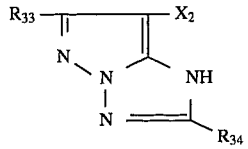
| Compound | $R_{33}$ | $R_{34}$ | $X_2$ |
|---|---|---|---|
| M'-13 | $(CH_3)_2CH-$ | $OC_8H_{17}$, $SO_2-(CH_2)_3$, $C_8H_{17}(t)$ | 同上 |
| M'-14 | $-(CH-CH_2)_{50}-(CH_2-C)_{50}-$ ($COOCH_2CH_2OCH_3$; $CH_3$, $CONH-$) | $CH_3-CH-$ ($CH_2NHSO_2CH_3$) | Cl |
| M'-15 | $-O-$ | $O_8H_{17}$, $(CH_2)_2NHSO_2$, $C_8H_{17}(t)$ | Cl |
| M'-16 | Cl, $-O-$ | $O_8H_{17}$, $(CH_2)_2NHSO_2$, $C_8H_{17}(t)$ | $OC_4H_9$, $-S-$, $C_8H_{17}(t)$ |

In the present invention, when a 5-pyrazolone magenta coupler is used, if a coupler having a coupling split-off group represented by the following formula (V) is used, a further preferable result can be obtained. That is, when the particular coupler is used in the range of the present invention, an image low in process color-contamination and less in fluctuation of the maximum density can be formed. Formula (V)

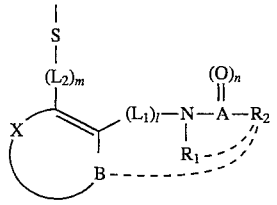

wherein $L_1$ and $L_2$ each represent a methylene group or an ethylene group, l and m each are 0 or 1, $R_1$ represents a hydrogen atom, an alkyl group, an aryl group, or a heterocyclic group, $R_2$ represents a group that will be bonded to A through a carbon atom, an oxygen atom, a nitrogen atom, or a sulfur atom, A represents a carbon atom or a sulfur atom, n is 1 when A is a carbon atom, or 1 or 2 when A is a sulfur atom, B represents a carbon atom, an oxygen atom, a nitrogen atom, or a sulfur atom, X represents a group of atoms required for forming a ring, $R_1$ and $R_2$ may bond together to form a ring, and B and $R_2$ may bond together to form a ring when B represents a carbon atom or a nitrogen atom.

The substituents in formula (V) are described in more detail below:

$L_1$ and $L_2$ each represent a substituted or unsubstituted methylene group or ethylene group. The substituent includes, for example, a halogen atom (e.g., fluorine, chlorine, and bromine), an alkyl group (e.g., linear or branched alkyl having 1 to 22 carbon atoms, aralkyl, alkenyl, alkynyl, cycloalkyl, and cycloalkenyl), an aryl group (e.g., phenyl and naphthyl), a heterocyclic group (e.g., 2-furyl and 3-pyridyl), an alkoxy group (e.g., methoxy, ethoxy, and cyclohexyloxy), an aryloxy group (e.g., phenoxy, p-methoxyphenoxy and p-methylphenoxy), an alkylamino group (e.g., ethylamino and dimthylamino), an alkoxycarbonyl group (e.g., methoxycarbonyl and ethoxycarbonyl), a carbamoyl group (e.g., N,N-dimethylcarbamoyl), an anilino group (e.g., phenylamino and N-ethylanilino), a sulfamoyl group (e.g., N,N-diethylsulfamoyl), an alkylsulfonyl group (e.g., methylsulfonyl), an arylsulfonyl group (e.g., tolylsulfonyl), an alkylthio group (e.g., methylthio and octylthio), an arylthio group (e.g., phenylthio and 1-naphthylthio), an acyl group (e.g., acetyl and benzoyl), an acylamino group (e.g., acetamido and benzamido), an imido group (e.g., succinimido and phthalimido), a ureido group (e.g., phenylureido and N,N-dibutylureido), a sulfamoylamino group (e.g., N,N-dipropylsulfamoylamino), an alkoxycarbonylamino group (e.g., methoxycarbonylamino), a sulfonamido group (e.g., methanesulfonamido), a hydroxyl group, and a cyano group, with an unsubstituted methylene or ethylene group being preferable. l and m each are 0 or 1, with 0 being preferable.

$R_1$ represents a hydrogen atom, an alkyl group, an aryl group, or a heterocyclic group, and more particularly it represents a hydrogen atom, an alkyl group such as a linear or branched alkyl and alkenyl group having 1 to 22 carbon atoms, and a cycloalkyl group, an aryl group such as a phenyl group, and a naphthyl group, or a heterocyclic group such as a 2-furyl group, a 2-thienyl group, a 2-pyrimidinyl group, and a 4-pyridyl group, which may further have a substituent defined for $L_1$ and $L_2$. Preferably $R_1$ represents a hydrogen atom or an alkyl group.

$R_2$ represents a group that will be bonded to A through a carbon atom, an oxygen atom, a nitrogen atom, or a sulfur atom. More particularly it represents a group that will be bonded to A through a carbon atom such as an alkyl group, an aryl group, a heterocyclic group that will be bonded through its carbon atom, an acyl group, an alkoxycarbonyl group, and a carbamoyl group; a group that will be bonded to A through an oxygen atom such as an alkoxy group and an aryloxy group; a group that will be bonded to A through a nitrogen atom such as an alkylamino group, an anilino group, an acyl group, a ureido group, a sulfamoylamino group, an alkoxycarbonylamino group, and a sulfonamido group; or a group that will be bonded to A through a sulfur atom such as an alkylthio group and an arylthio group, which, similar to $R_1$, may further have a substituent defined in $L_1$, and $L_2$. Preferably $R_2$ represents an alkyl group, an aryl group, an alkylamino group, or an anilino group.

A represents a carbon atom or a sulfur atom, with a carbon atom preferred.

n is 1 when A represents a carbon atom, or 1 or 2 when A represents a sulfur atom.

B represents a carbon atom, an oxygen atom, a nitrogen atom, or a sulfur atom, with a carbon atom or a nitrogen atom being preferable, and with a carbon atom being more preferable.

X represents a group of atoms required for forming a ring, and it preferably represents a group of atoms selected from the group consisting of carbon atoms, oxygen atoms, nitrogen atoms, and sulfur atoms, for forming a saturated or unsaturated 5-, 6-, or 7-membered ring, more preferably an unsaturated 5- or 6-membered ring, which ring may have a substituent defined for $L_1$ and $L_2$ above. Another ring may be fused to the ring including X.

$R_1$ and $R_2$ may bond together to form a ring, and preferably a 5- or 6-membered saturated or unsaturated ring, which ring may further have a substituent defined for $L_1$ and $L_2$.

When B represents a carbon atom or a nitrogen atom, B and $R_2$ may bond together to form a ring, and preferably a 5- or 6-membered saturated or unsaturated ring, which ring may have a substituent defined for L and $L_2$ above.

First preferable pyrazolone couplers can be represented by the following formula:

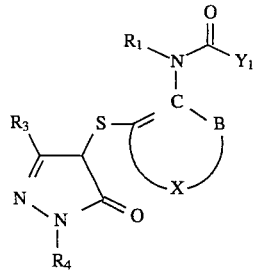

wherein $Y_1$ represents Ra or $Z_1$Rb, Ra represents a substituted or unsubstituted aryl group or heterocyclic group, or a substituent having a secondary or tertiary group represented by

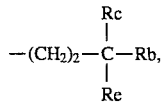

l is 0 or 1, $Z_1$ represents an oxygen atom, a sulfur atom, or NRf, Rb represents a substituted or unsubstituted alkyl group, aryl group, or heterocyclic group, Rc and Rd each represent a halogen atom or a group selected from the groups represented by Rb and $Z_2Rg$, Re represents a hydrogen atom or a group defined for Rc and Rd, Rf represents a hydrogen atom or a group defined for Rb, Z represents an oxygen atom, a sulfur atom, or NRh, Rg represents a group defined for Rf, Rh represents a group defined for Rf, Rc may bond to at least one of Rd and Re to from one or two carbon rings or heterocyclic rings, which may have a substituent, $R_1$, X and B each represent the same substituent, the same group of atoms, or the same atom as stated above, $R_3$ represents an anilino group, an acylamino group, a ureido group, a carbamoyl group, an alkoxy group, an allyoxycarbonyl group, an alkoxycarbonyl group, or an N-heterocyclic group, which preferably has an oil-solubility- providing group, and $R_4$ represents a substituted or unsubstituted aryl group, preferably a substituted phenyl group, and more preferably a 2,4,6-trichlorophenyl group.

Most preferable pyrazolone couplers having this formula can be represented by the following formula:

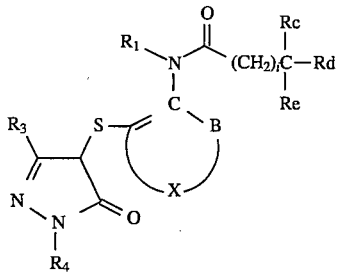

wherein $R_1$, $R_3$, $R_4$, Rc, Rd, Re, X, and B each represent the same substituent as stated above, and l is 0 or 1.

Second preferable pyrazolone couplers can be represented by the following formula:

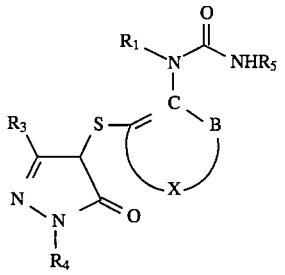

wherein $R_5$ represents a substituted or unsubstituted alkyl, aryl, or heterocyclic group, $R_1$, $R_3$, $R_4$, X, and B each represent the same substituent, the same group of atoms, or the same atom as stated above, with $R_3$ preferably being a group represented by —NH—$Y_2$, and with $R_4$ preferably being a 2,4,6-trichlorophenyl group, and $Y_2$ represents a substituted on unsubstituted aryl, arylcarbonyl, or arylamino carbonyl group.

Third preferable pyrazolone couplers can be represented by the following formula:

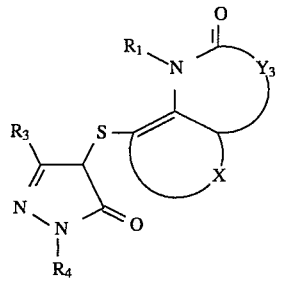

wherein $R_1$, $R_3$, $R_4$, and X each represents the same substituent or the same group of atoms as stated above, $Y_3$ represents a substituted or unsubstituted methylene or ethylene group, or >NRf and Rf represents the same substituent as stated above.

More preferable pyrazolone couplers having this formula can be represented by the following formula:

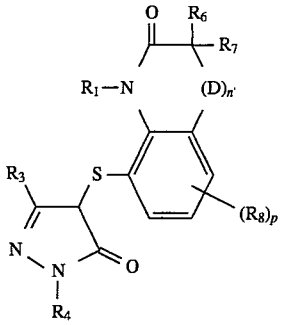

wherein $R_1$, $R_3$, and $R_4$ each represent the same substituent as stated above, $R_6$ and $R_7$ each represent an alkyl group or an aryl group, $R_8$ represents the substituent defined for $L_1$ and $L_2$, D represents a methylene group, an oxygen atom, a nitrogen atom, or a sulfur atom, n' is an integer of from 0 to 2 when D is a methylene group, or n' is 1 when D is other than a methylene group, and p is an integer of from 0 to 3.

Hereinafter the term "coupler part" refers to the part excluding the coupling split-off group, and the term "coupler" refers to the whole, including both the coupler part and the coupling split-off group.

The "coupler part" will react with an oxidized color-developing agent to form a dye, and particularly a magenta dye, and it is a pyrazolone coupler that is well known and used in the field of photography. As examples of the pyrazolone coupler part can be mentioned those disclosed in U.S. Pat. Nos. 4,413,054, 4,443,536, 4,522,915, 4,336,325, 4,199,361, 4,351,897, and 4,385,111, JP-A Nos. 170854/1985, 194452/1985, and 194451/1985, U.S. Pat. Nos. 4,407,936, 3,419,391, and 3,311,476, British Patent No. 1,357,372, U.S. Pat. Nos. 2,600,788, 2,908,573, 3,062,653, 3,519,429, 3,152,896, 2,311,082, 2,343,703, and 2,369,489, and those disclosed in the inventions cited in these patents. In these patents, when the pyrazolone coupler parts are substituted by a coupling split-off group, they may be replaced with the coupling split-off group represented by formula (V) of the present invention. The pyrazolone coupler of the present invention can be used with other pyrazolone couplers as described in the above patents.

Preferable examples of the "coupler part" can be represented by the following formula:

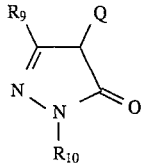

wherein Q represents a coupling split-off group of the present invention, $R_9$ represents an anilino, acylamino, ureido, carbamoyl, alkoxy, allyoxycarbonyl, alkoxycarbonyl, or N-heterocyclic group, and $R_{10}$ represents a substituted or unsubstituted aryl group, and preferably a phenyl group having at least one substituent selected from the group consisting of a halogen atom and an alkyl, alkoxy, alkoxycarbonyl, acylamino, sulfamido, sulfonamido, and cyano group. The carbon atom or the nitrogen atom of these substituents may optionally be substituted by a group that will not reduce the effect of the coupler. Preferably $R_9$ represents an anilino group, and more preferably an anilino group represented by the following formula:

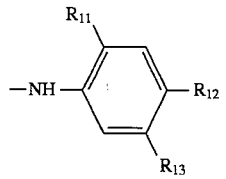

wherein $R_{11}$ represents an alkoxy group having 1 to 30 carbon atoms, an aryloxy group, or a halogen atom (preferably a chlorine atom).

$R_{12}$ and $R_{13}$ each represent a hydrogen atom, a halogen atom (e.g., chlorine, bromine, and fluorine), an alkyl group (e.g., an alkyl group having 1 to 30 carbon atoms), an alkoxy group (e.g., an alkoxy group having 1 to 30 carbon atoms), an acylamino group, a sulfonamido group, a sulfamoyl group, a sulfamido group, a carbamoyl group, a diacylamino group, an aryloxycarbonyl group, an alkoxycarbonyl group, an alkoxysulfonyl group, an aryloxysulfonyl group, an alkanesulfonyl group, an arylenesulfonyl group, an alkylthio group, an arylthio group, an alkoxycarbonylamino group, an alkylureido group, an acyl group, a nitro group, or a carboxyl group. For example, $R_{12}$ and $R_{13}$ may each represent a hydrogen atom or a ballast group.

Preferably, $R_{10}$ represents a substituted phenyl group. The substituent includes a halogen atom (e.g., a chlorine atom, a bromine atom, and a fluorine atom), an alkyl group having 1 to 22 carbon atoms (e.g., methyl, ethyl, propyl, t-butyl, and tetradecyl), an alkoxy group having 1 to 22 carbon atoms (e.g., methoxy, ethoxy, and dodecyloxy), an alkoxycarbonyl group having 1 to 23 carbon atoms (e.g., methoxycarbonyl, ethoxycarbonyl, and tetradecyloxycarbonyl), an acylamino group (e.g., α-[3-pentadecylphenoxy]-butylamido), and/or a cyano group. More preferably, $R_{10}$ represents a 2,4,6-trichlorophenyl group.

More particularly, $R_{12}$ and $R_{13}$ each represent a hydrogen atom, a halogen atom (e.g., a chlorine atom, a bromine atom, and a fluorine atom), a linear or branched alkyl group having 1 to 30 carbon atoms (e.g., methyl, trifluoromethyl, ethyl, t-butyl, and tetradecyl), an alkoxy group having 1 to 30 carbon atoms (e.g., methoxy, ethoxy, 2-ethylhexyloxy, and tetradecyloxy), an acylamino group (e.g., acetamido, benzamido, butylamido, tetradeandeamido, α-(2,4-di-t-pentylphenoxy)acetamido, α-(2,4-di-t-pentylphenoxy)butylamido, α-(4-hydroxy-3-t-butylphenoxy)tetradecaneamido, 2-oxo-pyrrolidin-1-yl, 2-oxy-5-tetradecyl-pyrrolin-1-yl, methyltetradecyldecaneamido, and t-butylcarbonamido), a sulfonamido group (e.g., methanesulfonamido, benzenesulfonamido, p-toluenesulfonamido, p-dodecylbenzenesulfonamido, N-methyltetradecylsulfonamido, and hexadecanesulfonamido), a sulfamoyl group (e.g., N-methylsulfamoyl, N-hexadecylsulfamoyl, N,N-dimthylsulfamoyl, N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl), a sulfamido group (e.g., N-methylsulfamido and N-octadecylsulfamido), a carbamoyl group (e.g., N-methylcarbamoyl, N-octadecylcarbamoyl, N-[4-(2,4-di-t-pentylphenoxy)butyl)carbamoyl, N-methyl-N-tetradecylcarbamoyl, and N,N-dioctylcarbamoyl), a diacylamino group (e.g., N-succinamido, N-phthalamido, 2,5-dioxo-1-oxazolidinyl, 3-dodecyl-2,5-dioxo-1-imidazolyl, and N-acetyl-N-dodecylamino), an aryloxycarbonyl group (e.g., phenoxycarbonyl and p-dodecyloxyphenoxycarbonyl), an alkoxycarbonyl group having 2 to 30 carbon atoms (e.g., methoxycarbonyl, tetradecyloxycarbonyl, ethoxycarbonyl, benzyloxycarbonyl, and dodecyloxycarbonyl), an alkoxysulfonyl group having 1 to 30 carbon atoms (e.g., methoxysulfonyl, octyloxysulfonyl, tetradecyloxysulfonyl, and 2-ethylhexyloxysulfonyl), an aryloxysulfonyl group (e.g., phenoxysulfonyl, and 2,4-di-t-pentylphenoxysulfonyl), an alkanesulfonyl group having 1 to 30 carbon atoms (e.g., methanesulfonyl, octanesulfonyl, 2-ethylhexanesulfonyl, and hexadecanesulfonyl), an arylenesulfonyl group (e.g., benzenesulfonyl, 4-nonylbenzenesulfonyl, and p-toluenesulfonyl), an alkylthio group having 1 to 22 carbon atoms (e.g., ethylthio, octylthio, benzylthio, tetradecylthio, and 2-(2,4-di-t-pentylphenoxy)ethylthio), an arylthio group (e.g., phenylthio, and p-tolylthio), an alkoxycarbonylamino group (e.g., ethoxycarbonylamino, benzyloxycarbonylamino, and hexadecyloxycarbonylamino), an alkylureido group (e.g., N-methylureido, N,N-dimthylureido, N-methyl-N-dodecylureido, N-hexadecylureido, N,N-dioctadecylureido, and N,N-dioctyl-N'-ethylureido), an acyl group (e.g., acetyl, benzoyl, octadecanoyl, p-dodecaneamidobenzoyl, and cyclohexanecarbonyl), a nitro group, a cyano group, or a carboxyl group.

The alkoxy group and the aryloxy group represented by $R_{11}$ are more particularly a methoxy group, an ethoxy group, a propoxy group, a 2-methoxyethoxy group, a sec-butoxy group, a hexyloxy group, a 2-ethylhexyloxy group, a 2-(2,4-di-t-pentylphenoxy)ethoxy group, and a 2-dodecyloxyethoxy group, and a phenoxy group, an α- or β-naphthyloxy group, and a 4-tolyloxy group.

The monomer containing a pyrazolone coupler having a coupling split-off group represented by formula (V) may form a copoloymer with a non-color-forming ethylenically-unsaturated monomer that will not couple with the oxidized product of an aromatic primary-amine-developing agent.

The non-color-forming ethylenically-unsaturated monomer that will not couple with the oxidized product of an aromatic primary amine developing agent includes, for example, acrylic acid, α-chloroacrylic acid, an α-alkylacrylic acid (e.g., methacrylic acid), and an ester or amide derived from these acrylic acids (e.g., acrylamide, n-butylacrylamide, t-butylacrylamide, diacetone acrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, and β-hydroxy methacrylate), methylenedibisacrylamide, a vinyl ester (e.g., vinyl acetate, vinyl propionate, and vinyl laurate), acrylonitrile, methacrylonitrile, an aromatic vinyl (e.g., styrene, and its derivative, vinyltoluene, divinylbenzene, vinylacetophenone, and sulfostyrene), itaconic acid, citraconic acid, crotonic acid, vinylidene chloride, a vinyl alkyl ether (e.g., vinyl ethyl ether), maleic acid, maleic arthydride, a maleate, N-vinyl-2-pyrrolidone, N-vinylpyridine, and 2- and 4-vinylpyridine, which may be used in combination. For example, a combination of n-butyl acrylate and methyl acrylate, styrene and methacrylic acid, methacrylic acid and acrylamide, or methyl acrylate and diacetone acrylamide, can be mentioned.

As is well known in the field of polymer color couplers, the non-color-forming ethylenically-unsaturated monomer to be copolymerized with a solid water-insoluble monomer coupler can be selected in such a manner that the physical properties and/or the chemical properties, for example, the solubility, the compatibility with the binder in the photographic colloid composition such, as gelatin, the flexibility, and the heat stability of the copolymer that will be formed may be influenced favorably.

The polymer coupler used in the present invention may or may not be soluble in water, and it is preferably a polymer coupler latex, among others.

Specific examples of the coupling-off group (Q) represented by formula (V) are shown below, but the present invention is not limited to them.

Q-1)

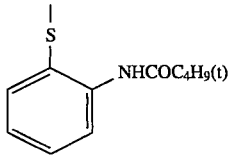

Q-2)

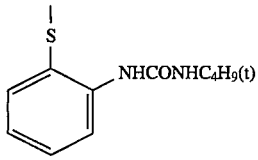

Q-3)

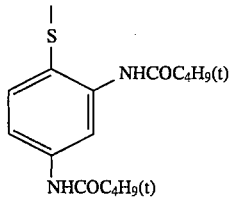

Q-4)

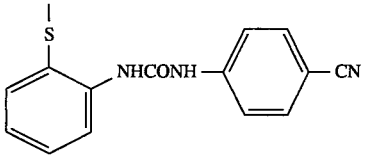

Q-5)

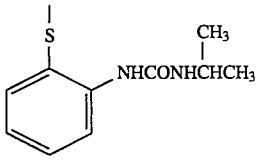

-continued

Q-6)

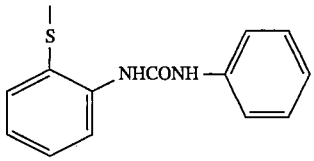

Q-7)

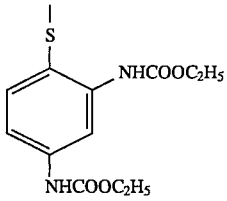

Q-8)

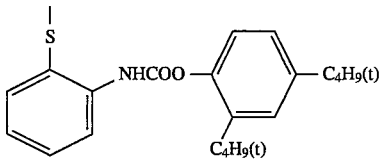

Q-9)

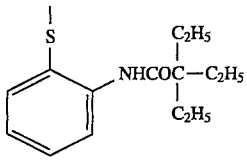

Q-10)

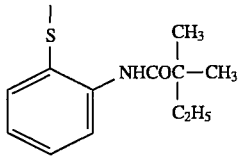

Q-11)

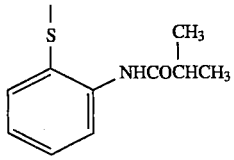

Q-12)

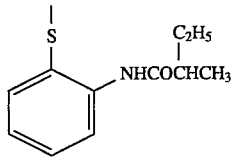

Q-13)

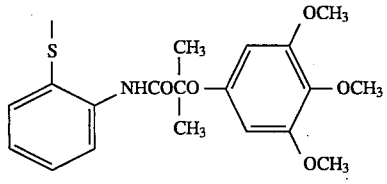

-continued
Q-14)
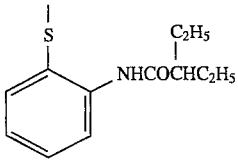
Q-15)
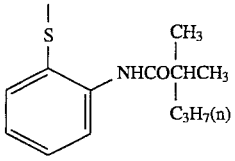
Q-16)
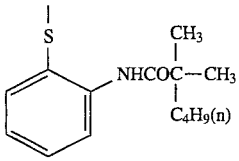
Q-17)
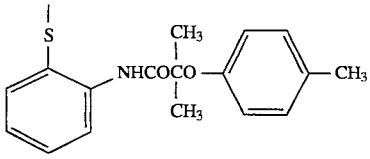
Q-18)
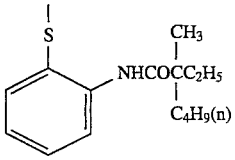
Q-19)
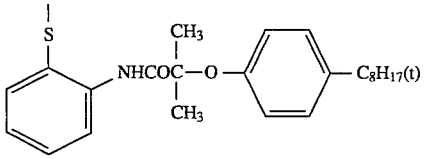
Q-20)
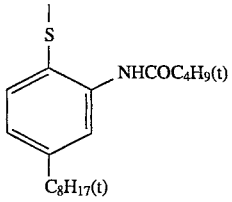
Q-21)
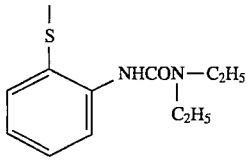
Q-22)
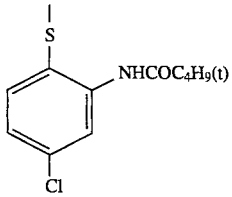
-continued
Q-23)
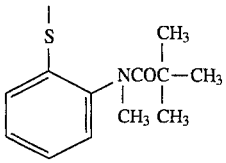
Q-24)
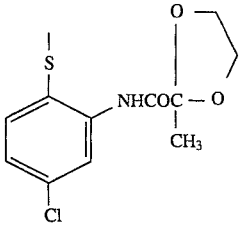
Q-25)
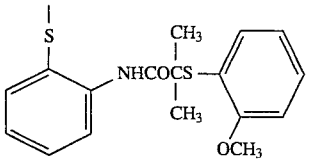
Q-26)
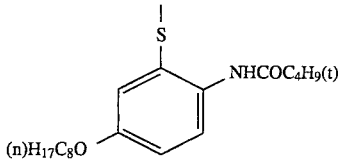
Q-27)
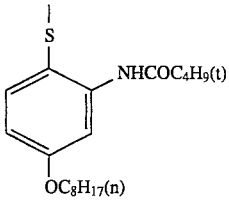
Q-28)
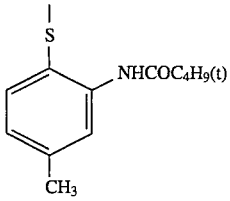
Q-29)
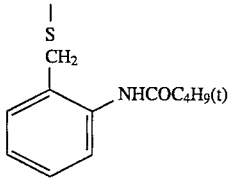
Q-30)
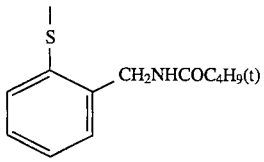

-continued
Q-31)
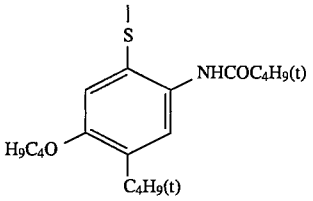
Q-32)
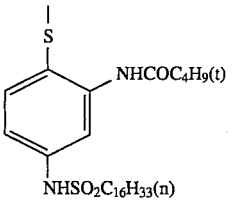
Q-33)
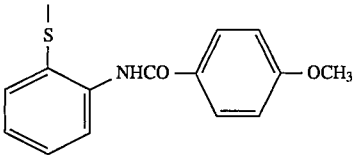
Q-34)
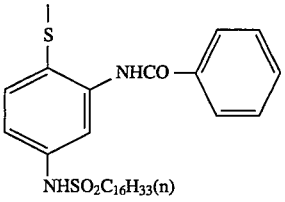
Q-35)
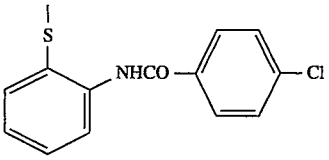
Q-36)
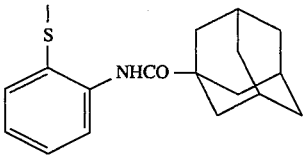
Q-37)
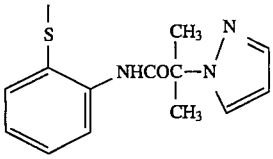
Q-38)
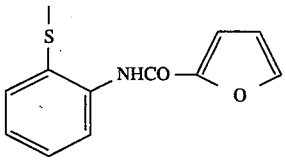
-continued
Q-39)
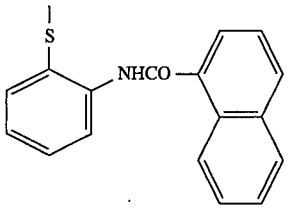
Q-40)
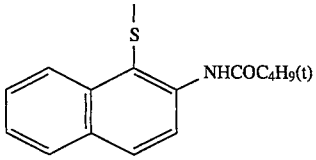
Q-41)
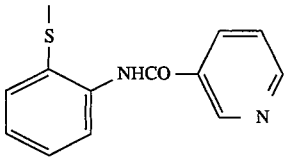
Q-42)
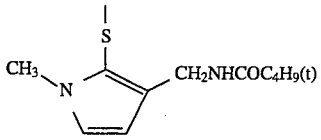
Q-43)
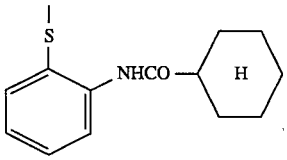
Q-44)
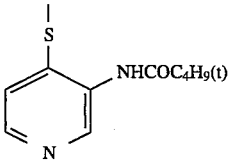
Q-45)
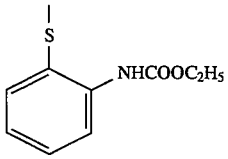
Q-46)
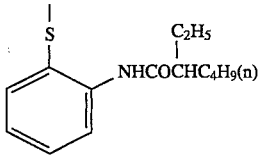
Q-47)
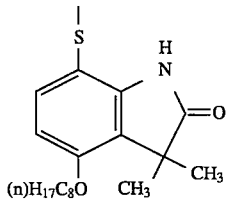

Q-48)
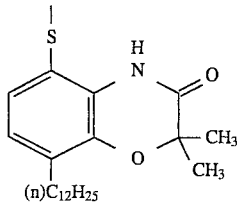
Q-49)
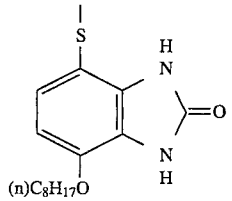
Q-50)
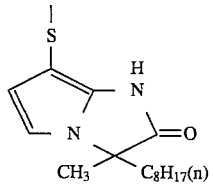
Q-51)
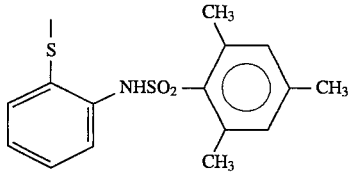
Q-52)
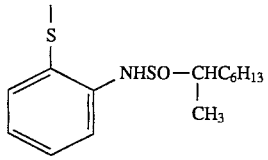
Q-53)
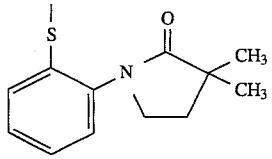
Q-54)
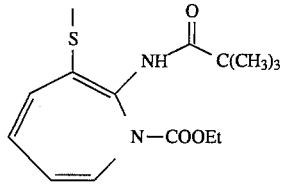
Q-55)
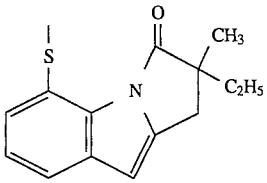
Q-56)
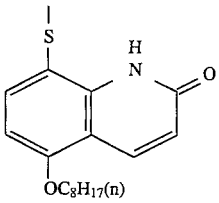
Q-57)
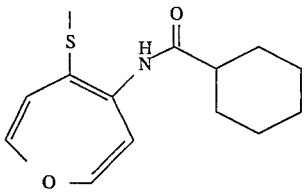
Q-58)
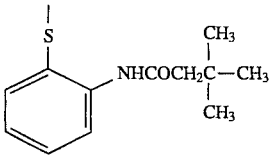
Q-59)
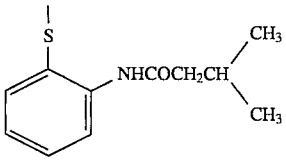
Q-60)
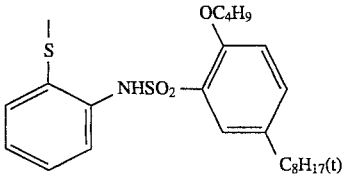
Specific examples of couplers according to the present invention are given below, but the present invention is not limited to them.

(M-1)
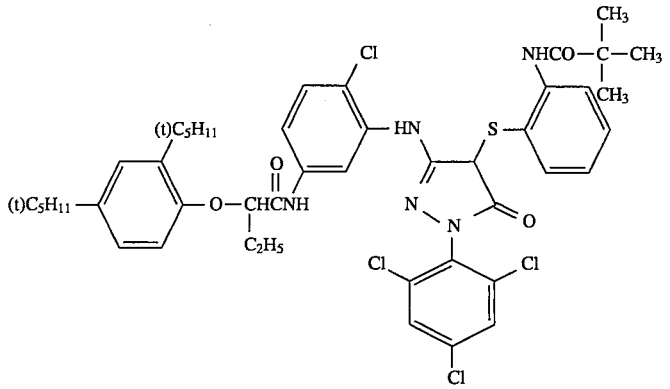
(M-2)
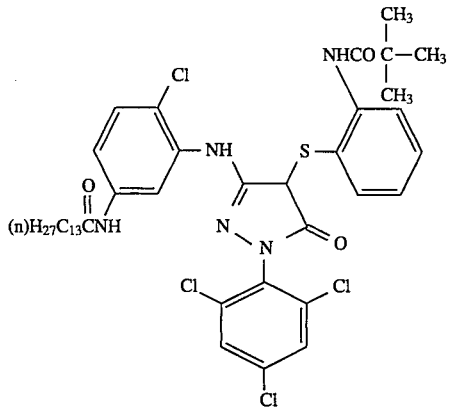
(M-3)
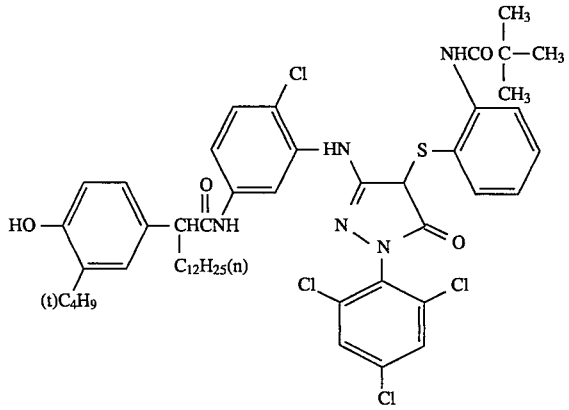
(M-4)
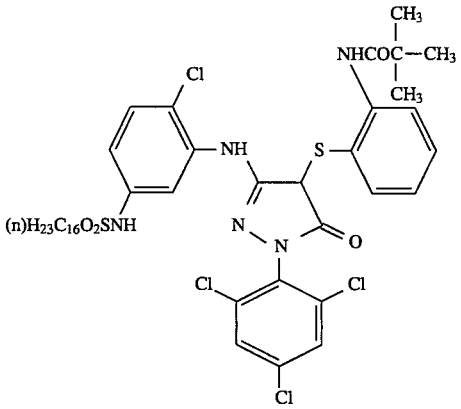
(M-5)
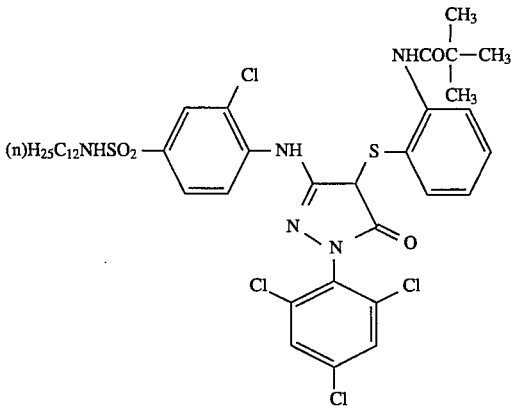

-continued
(M-6)
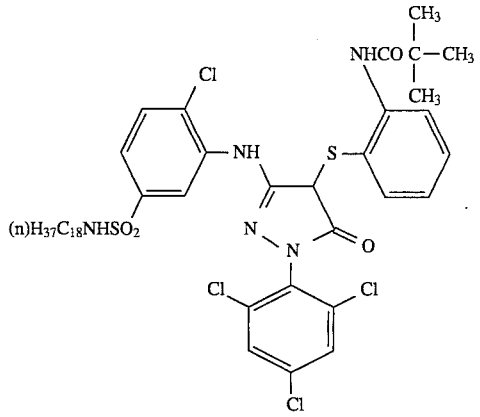
(M-7)
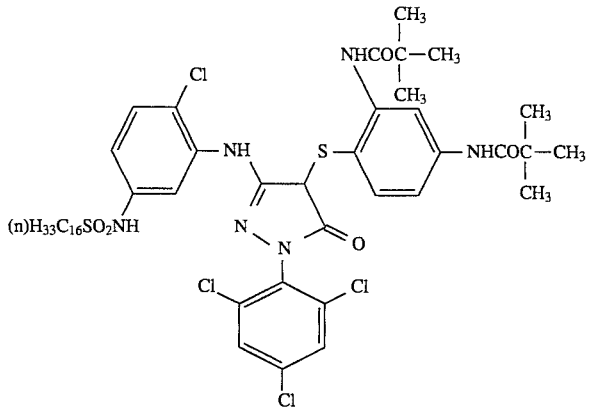
(M-8)
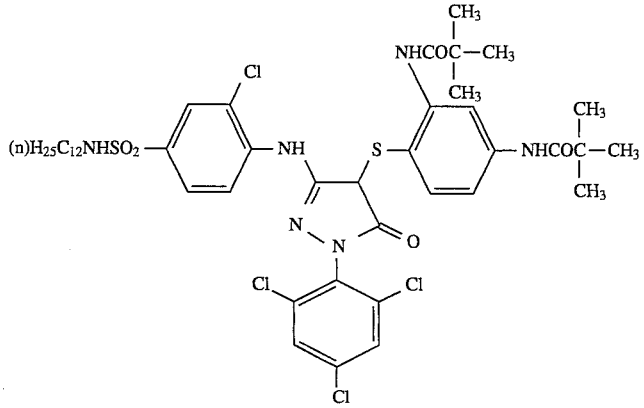
(M-9)
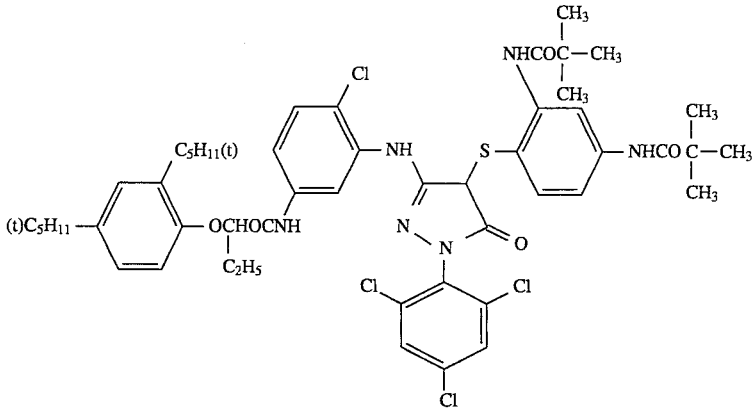

-continued
(M-10)
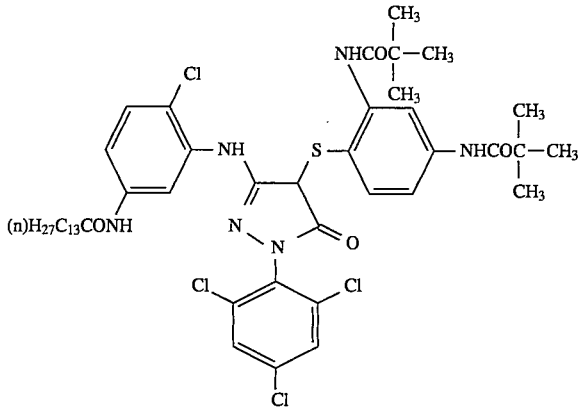
(M-11)
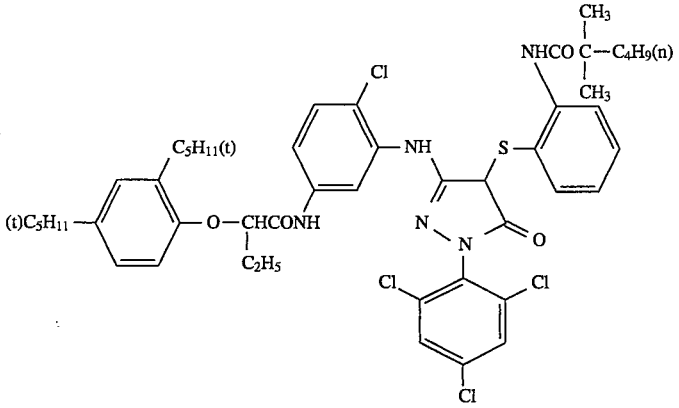
(M-12)
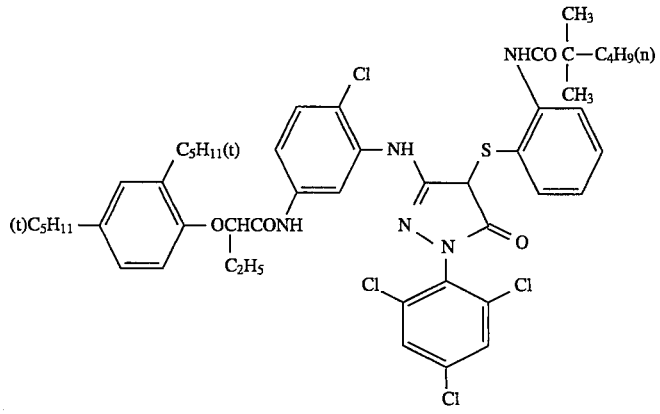
(M-13)
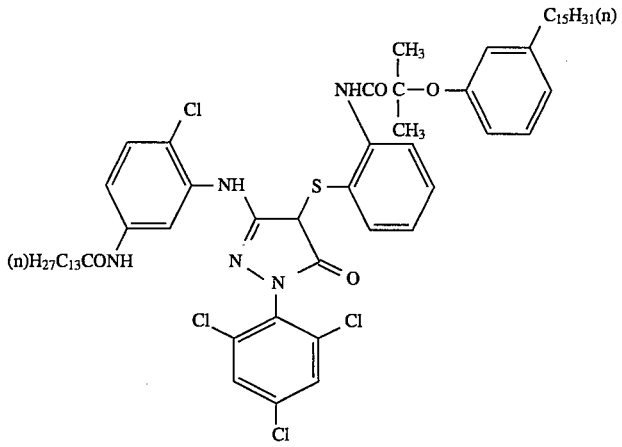

-continued
(M-14)
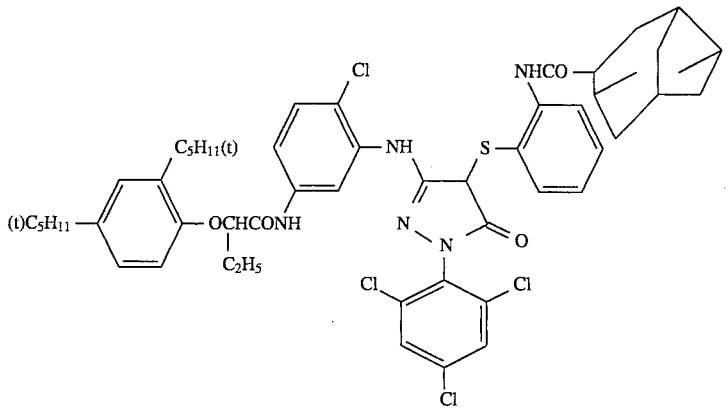
(M-15)
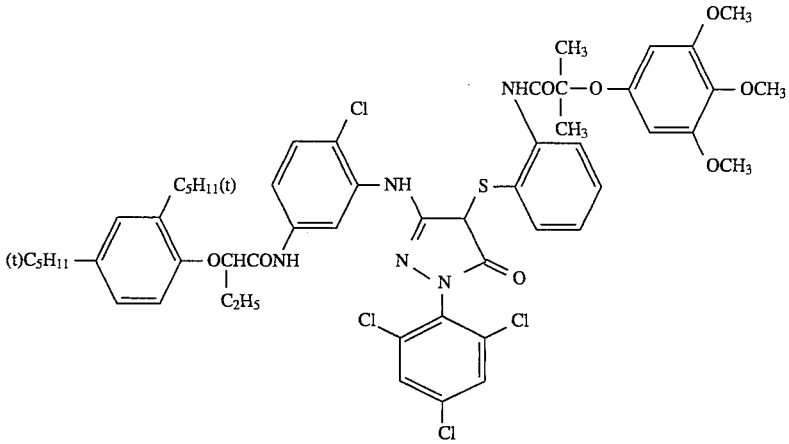
(M-16)
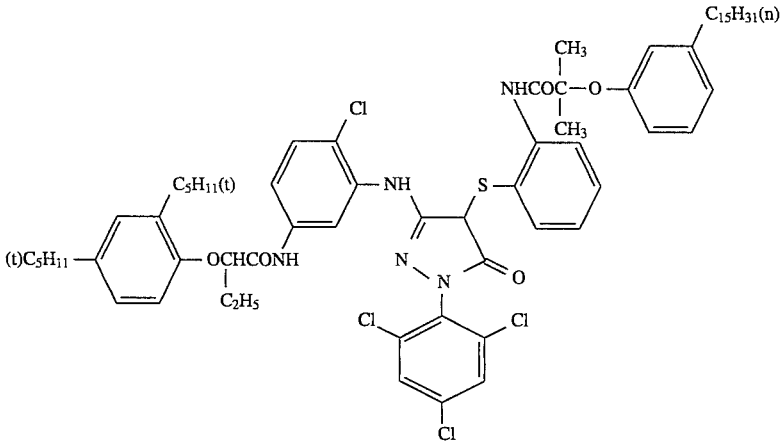

-continued
(M-17)
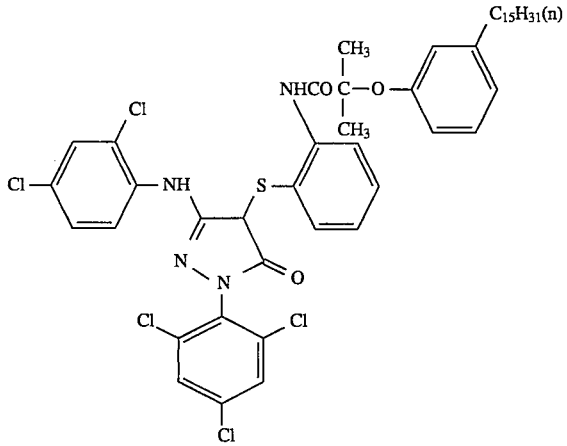
(M-18)
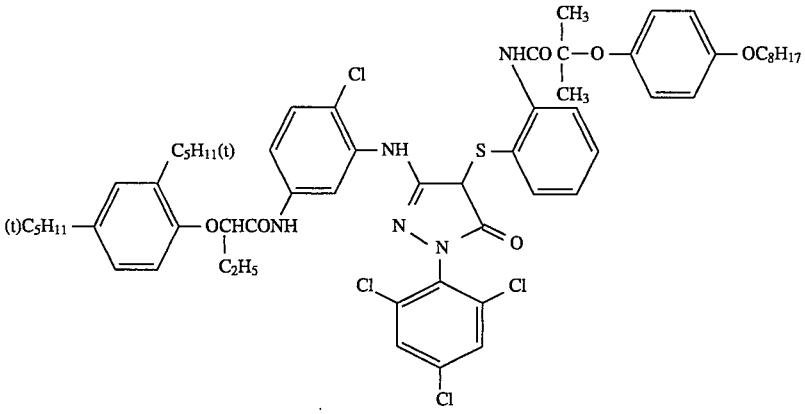
(M-19)
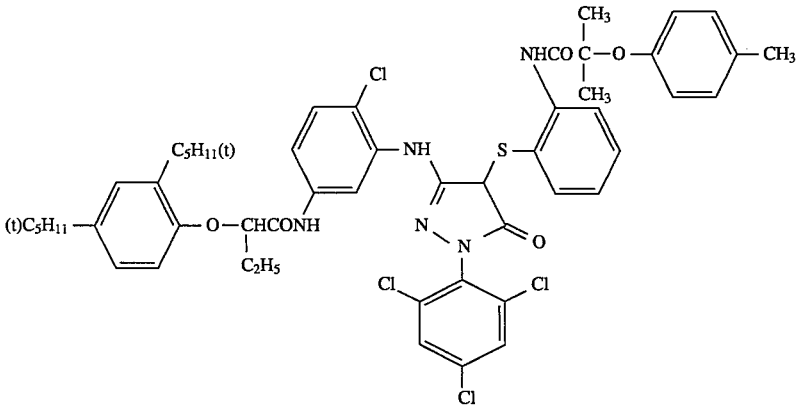
(M-20)
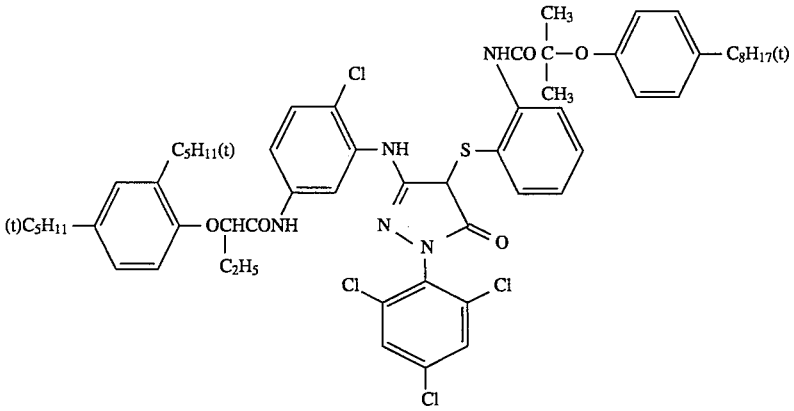

-continued
(M-21)
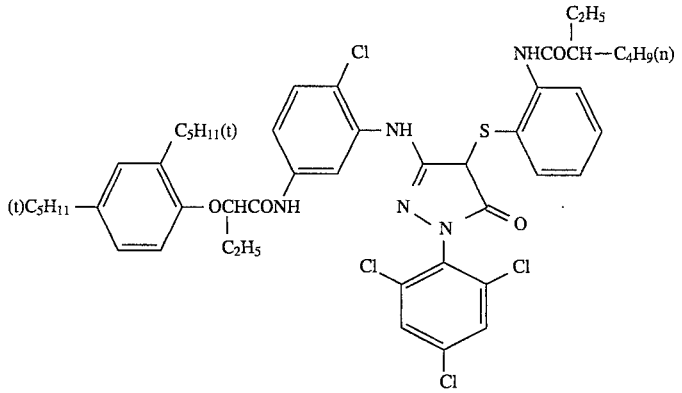
(M-22)
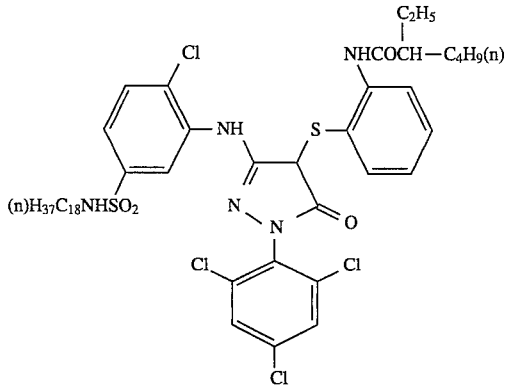
(M-23)
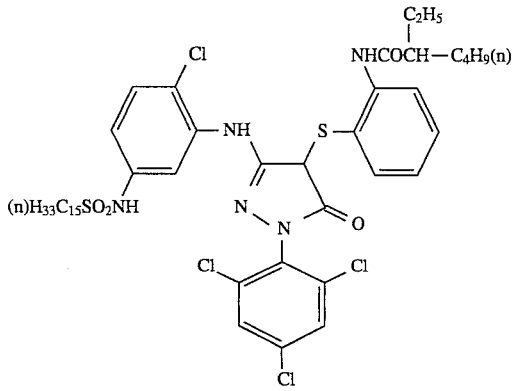
(M-24)
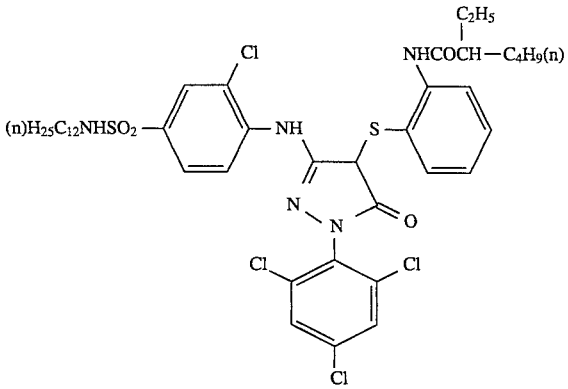
(M-25)
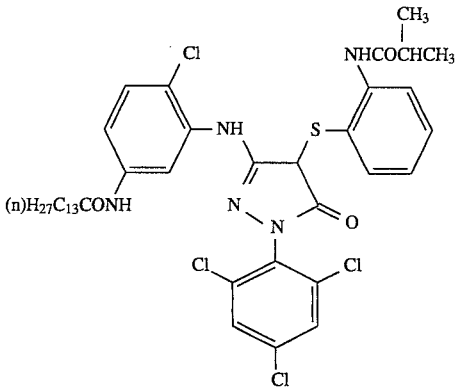
(M-26)
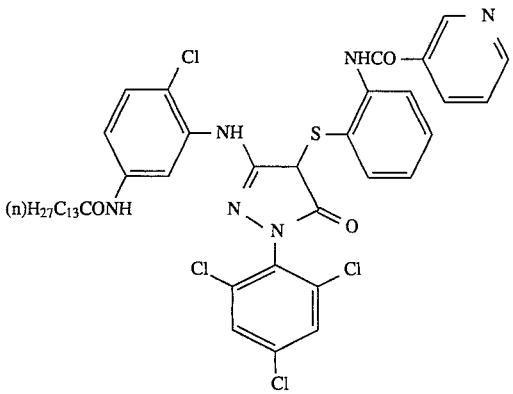

-continued
(M-27)
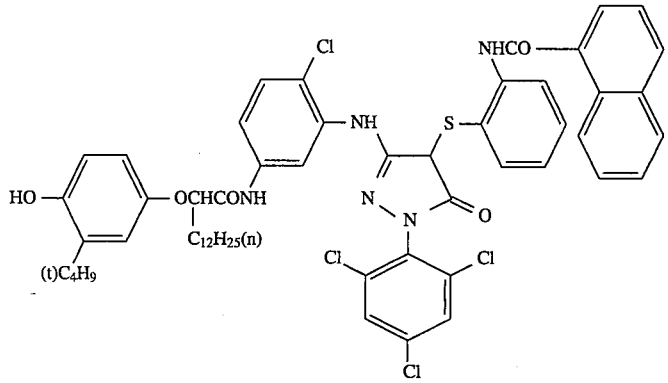
(M-28)
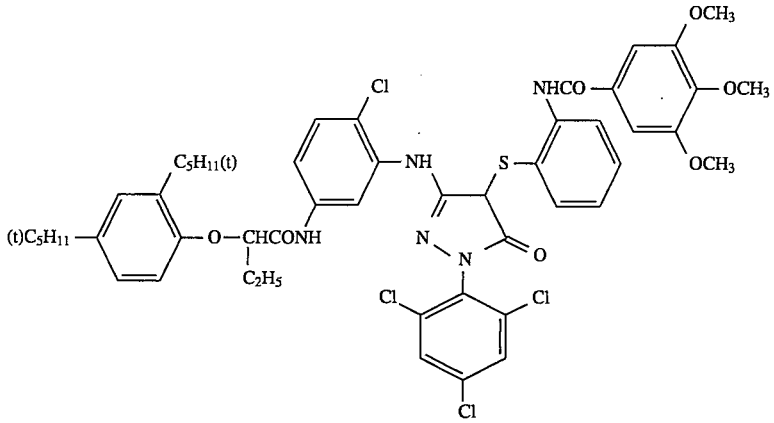
(M-29)
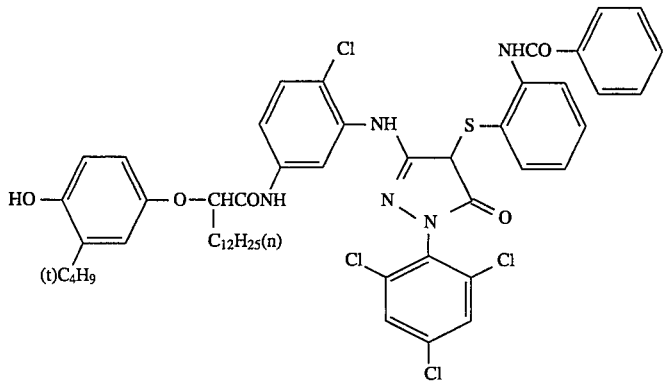
(M-30)
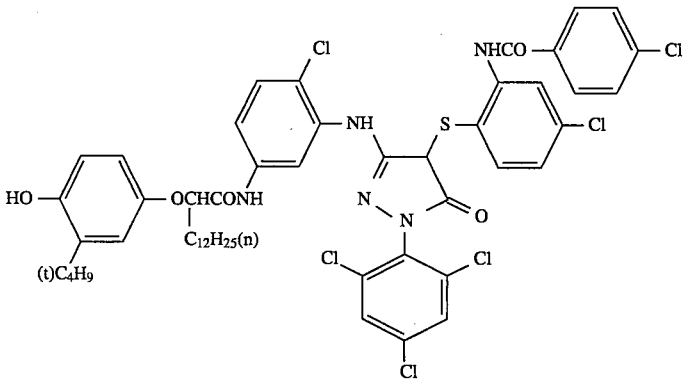

-continued
(M-31)
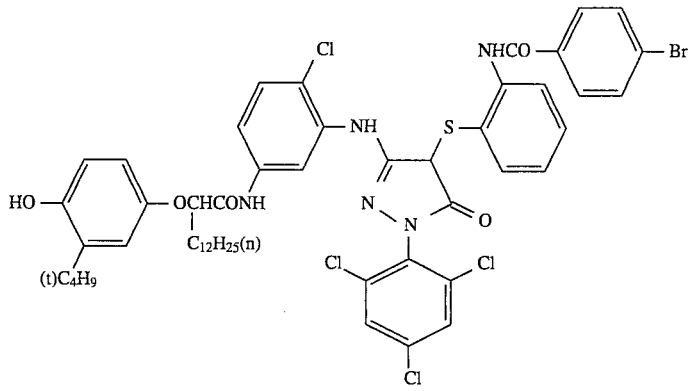
(M-32)
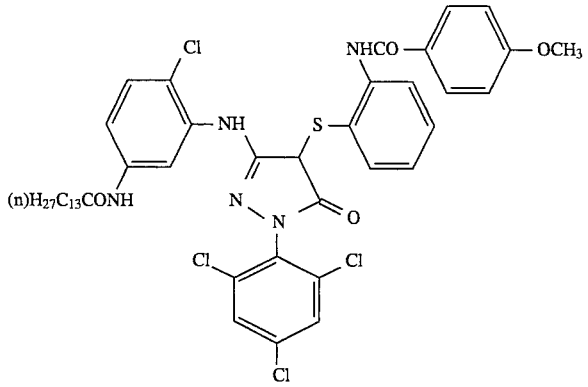
(M-33)
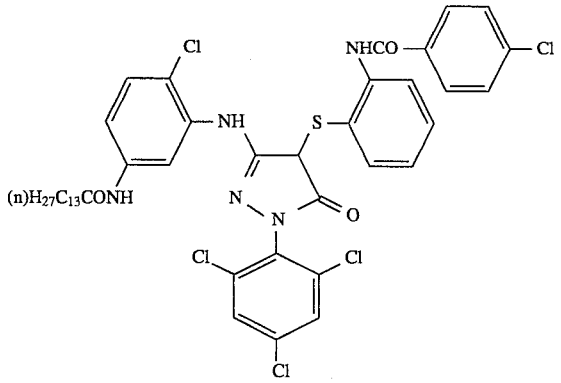
(M-34)
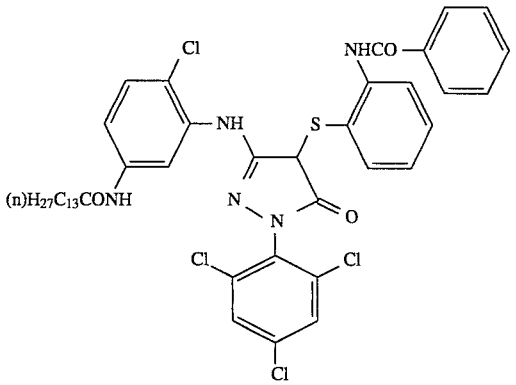

-continued
(M-35)
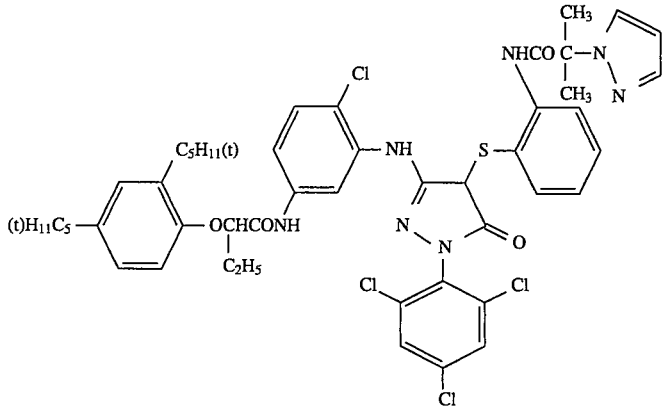
(M-36)
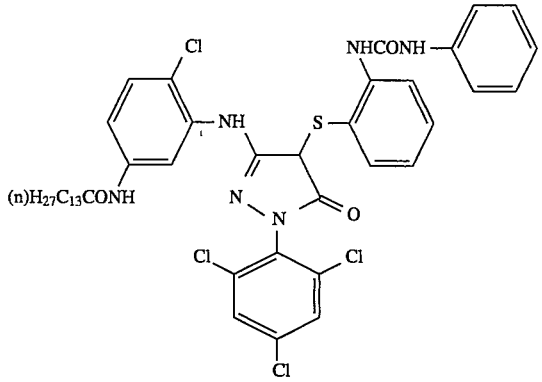
(M-37)
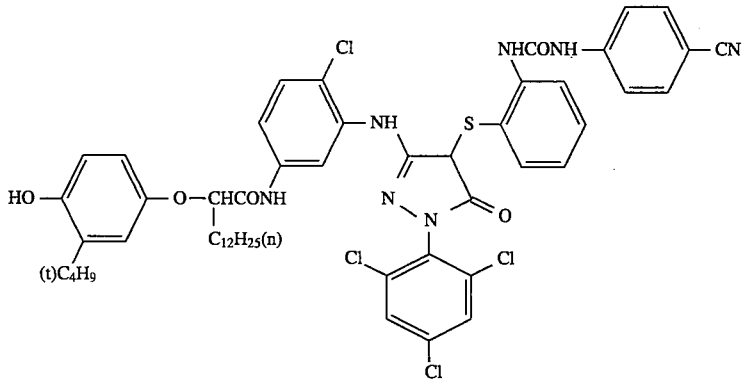
(M-38)
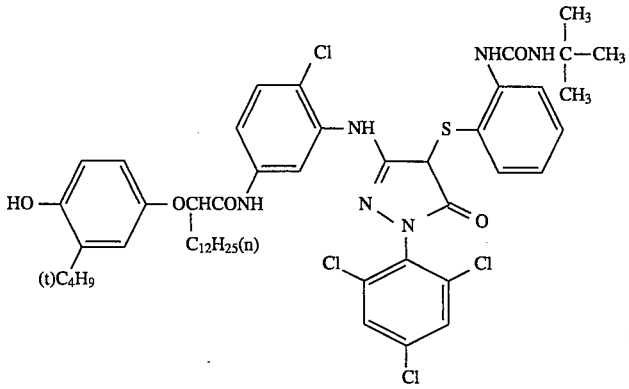

-continued
(M-39)
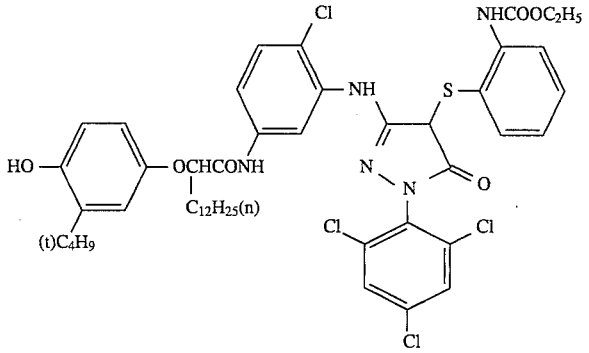
(M-40)
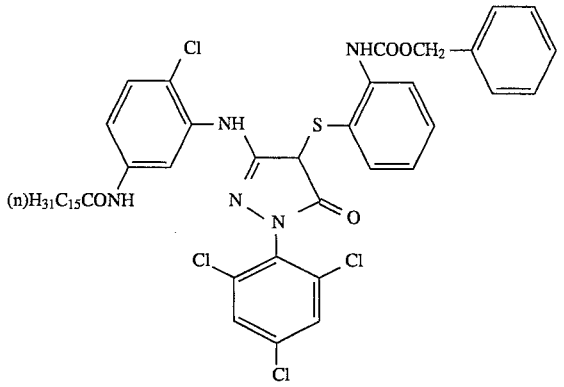
(M-41)
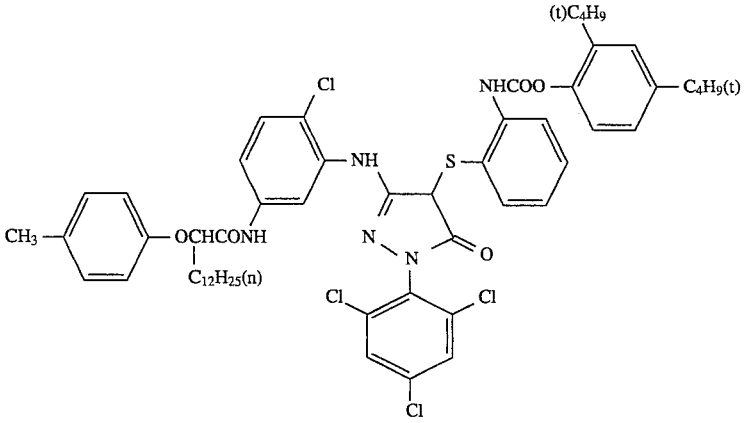
(M-42)
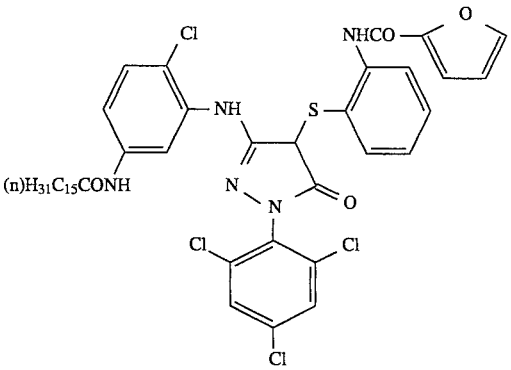

-continued
(M-43)
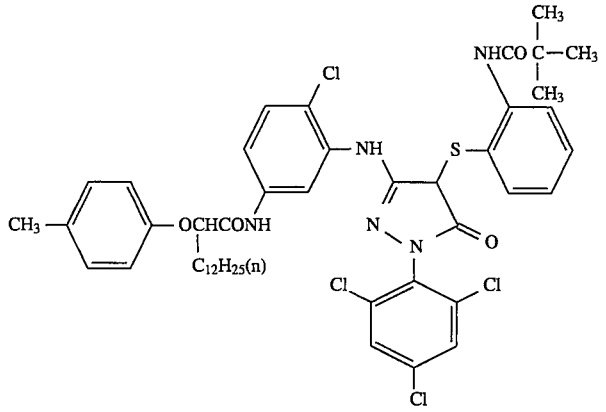
(M-44)
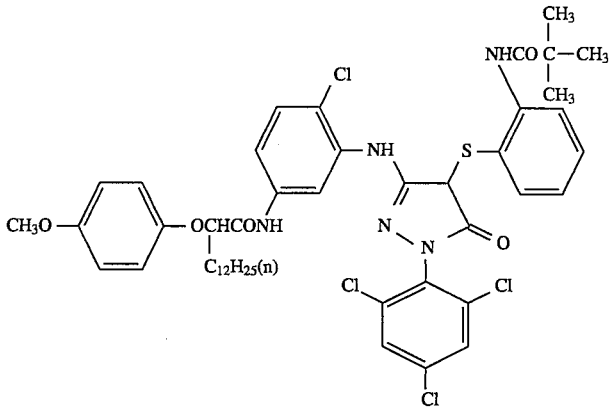
(M-45)
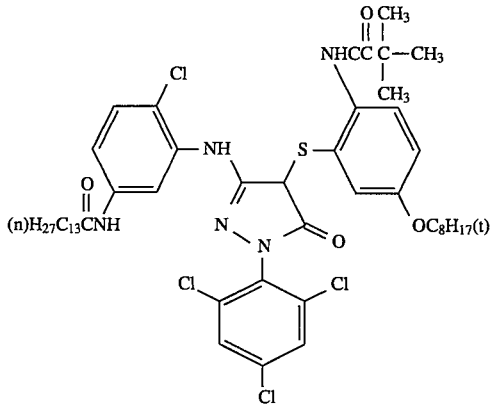
(M-46)
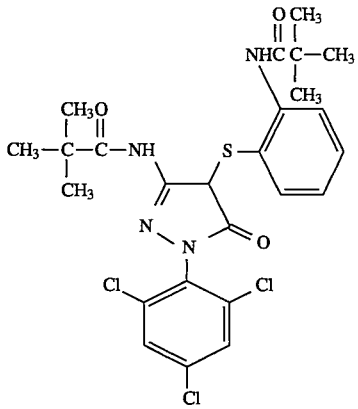
(M-47)
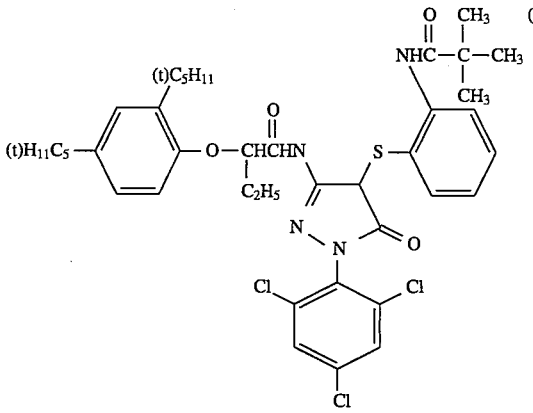
(M-48)
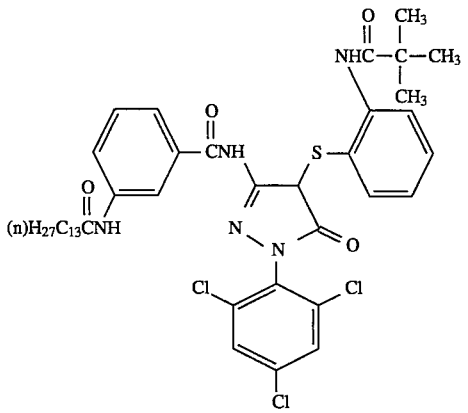

-continued
(M-49)
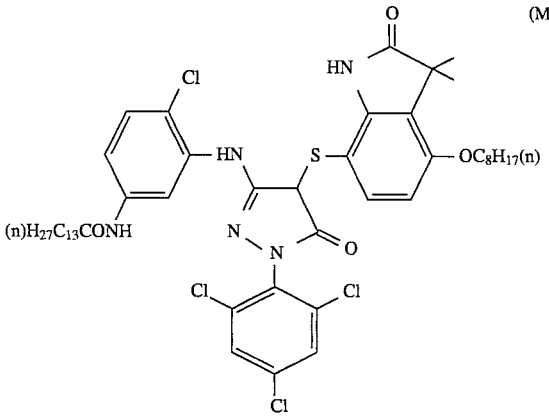
(M-50)
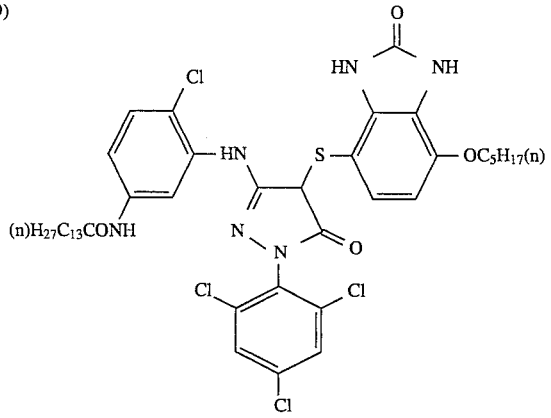
(M-51)
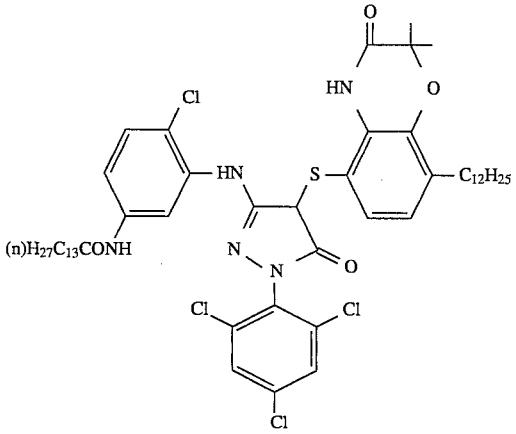
(M-52)
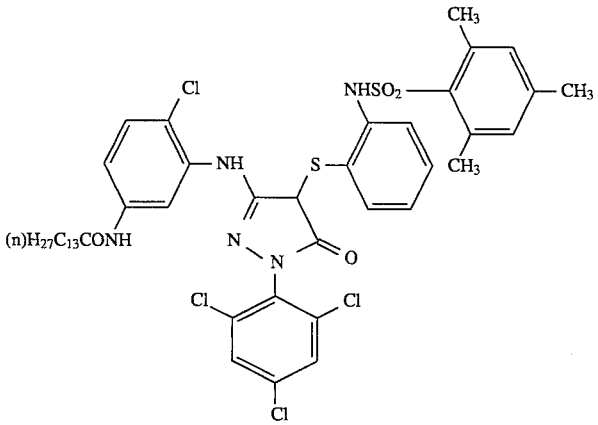
(M-53)
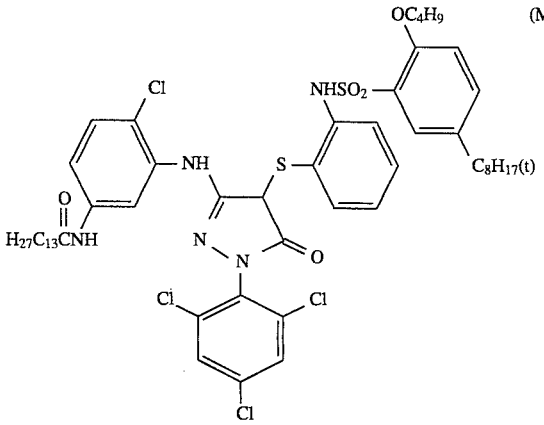
(M-54)
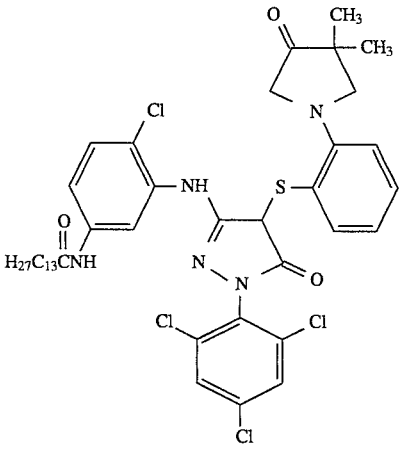

-continued
(M-55)
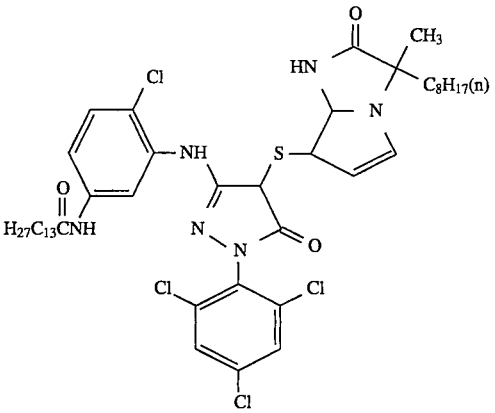
(M-56)
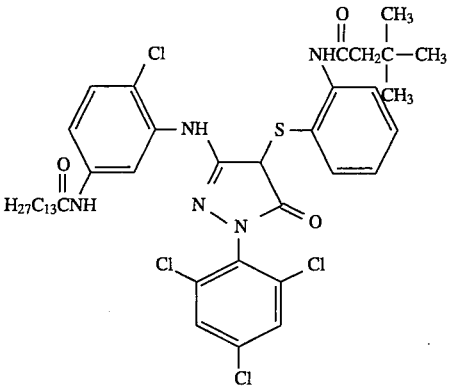
(M-57)
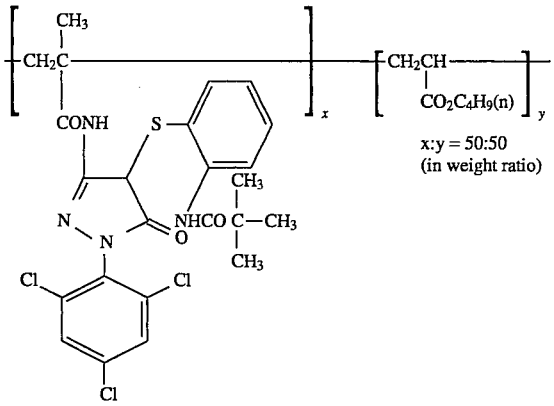
x:y = 50:50
(in weight ratio)
(M-58)
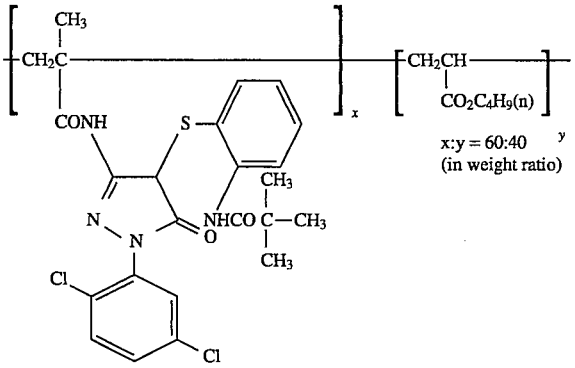
x:y = 60:40
(in weight ratio)
(M-59)
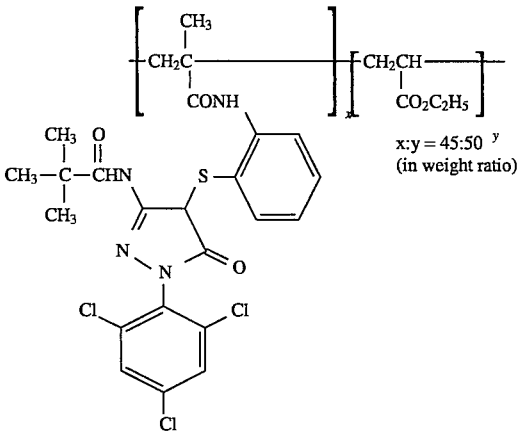
x:y = 45:50
(in weight ratio)

-continued
(M-60)
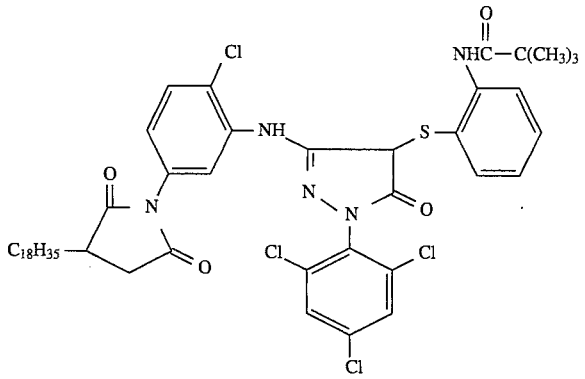
(M-61)
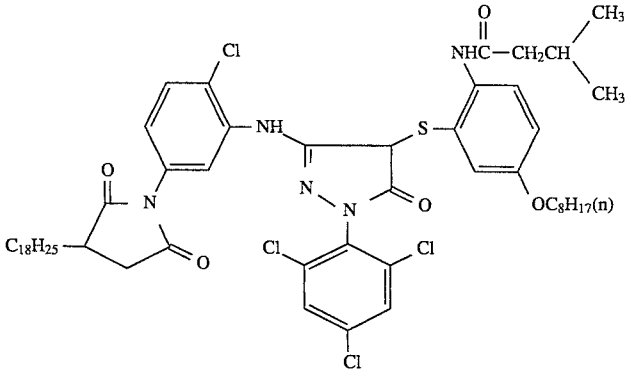
(M-62)
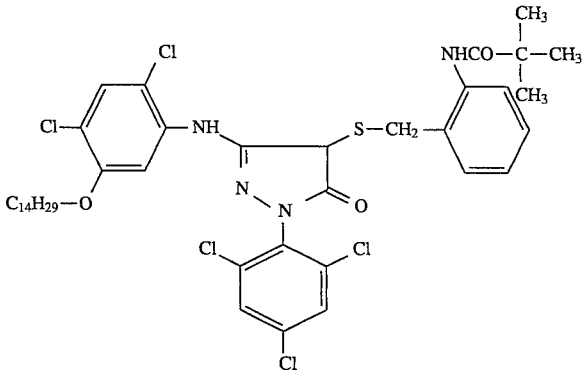
(M-63)
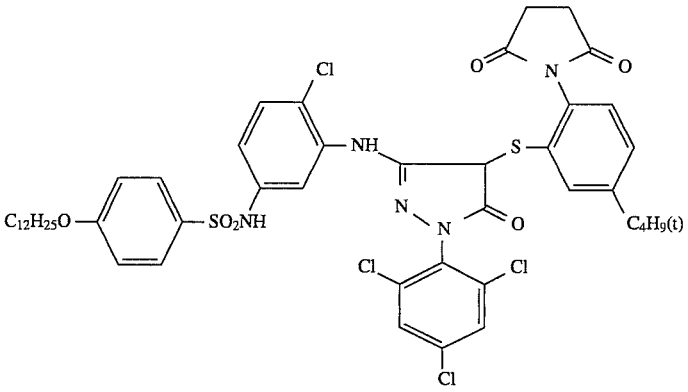

-continued (M-64)

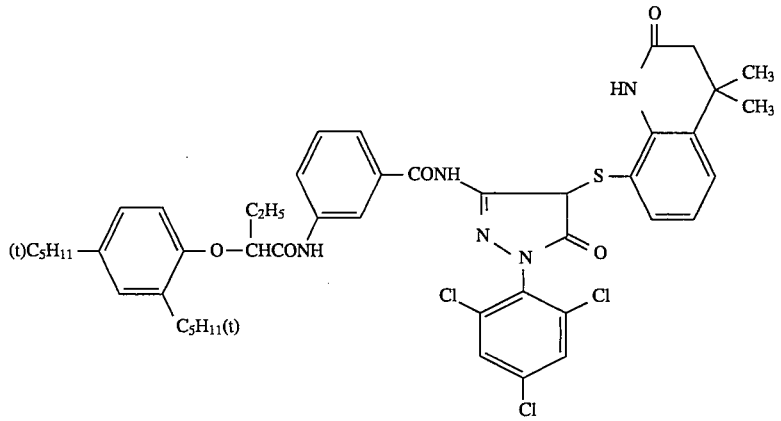

(M-65)

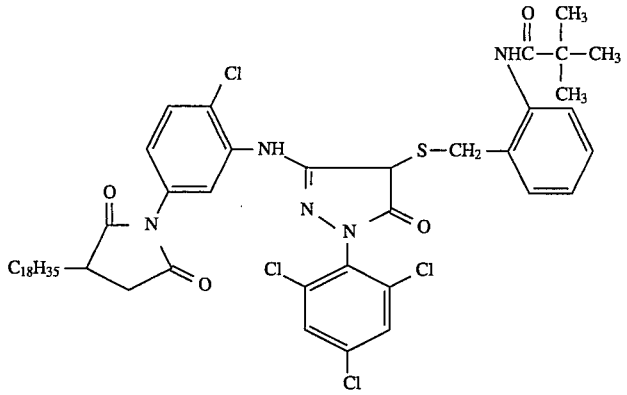

(M-66)

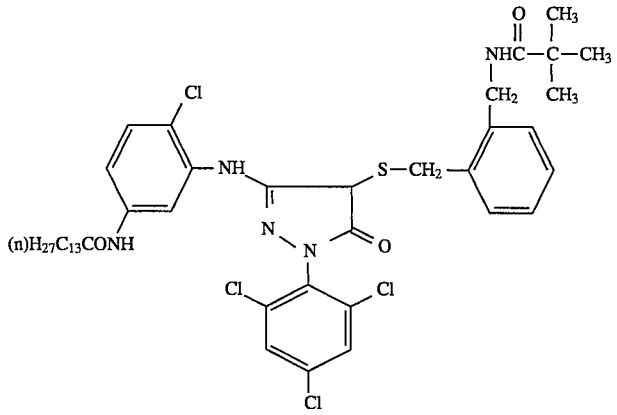

The magenta coupler of the present invention is used in an amount generally in the range of $1\times10^{-3}$ to 1 mol, and preferably $1\times10^{-2}$ to $8\times10^{-1}$ mol, per mol of the silver halide. The magenta coupler of the present invention may be combined with a magenta coupler of another type.

The layer to which the magenta coupler of the present invention will be added may be any of silver halide emulsion layers, but preferably is a green-sensitive silver halide emulsion layer. The amount of silver used in the green-sensitive silver halide emulsion layer is preferably 0.1 to 0.3 $g/m^2$.

The magenta couplers of the present invention can be synthesized by or based on the method described in International Publication (PCT) WO 88/04795.

As the cyan coupler, phenol cyan couplers and naphthol cyan couplers are the most typical.

The phenol cyan coupler includes those which have an acylamino group at the 2-position of the phenol nucleus, and an alkyl group at the 5-position of the phenol nucleus (inclusive of polymer couplers) described, for example, in U.S. Pat. Nos. 2,369,929, 4,518,687, 4,511,647, and 3,772,002, and as typical examples thereof can be mentioned the coupler described in Example 2 in Canadian Patent No. 625,822, Compound (1) described in U.S. Pat. No. 3,772,002, Compounds (1–4) and (1–5) described in U.S. Pat. No. 4,564,590, Compounds (1), (2), (3), and (4) described in JP-A 39045/1986, and Compound (C-2) described in JP-A No. 70846/1987.

The phenol cyan coupler includes 2,5-diacylamino phenol couplers described in U.S. Pat. Nos. 2,772,162, 2,895,826, 4,334,011, and 4,500,653, and JP-A No. 164555/1984, and as typical examples thereof can be mentioned Compound (V) described in U.S. Pat. No. 2,895,826, Compound (17) described in U.S. Pat. No. 4,557,999, Compounds (2) and (12) described in U.S. Pat. No. 4,565,777, Compound (4)

described in U.S. Pat. No. 4,124,396, and Compound (1–19) described in U.S. Pat. No. 4,613,564.

The phenol cyan coupler also includes those described in U.S. Pat. Nos. 4,372,173, 4,564,586, and 4,430,423, JP-A Nos. 390441/1986 and 257158/1987, wherein a nitrogen-containing heterocyclic ring is condensed to the phenol nucleus, and as typical examples thereof can be mentioned Couplers (1) and (3) described in U.S. Pat. No. 4,327,173, Compounds (3) and (15) described in U.S. Pat. No. 4,564,586, Compounds (1) and (3) described in U.S. Pat. No. 4,430,423, and compounds given below:

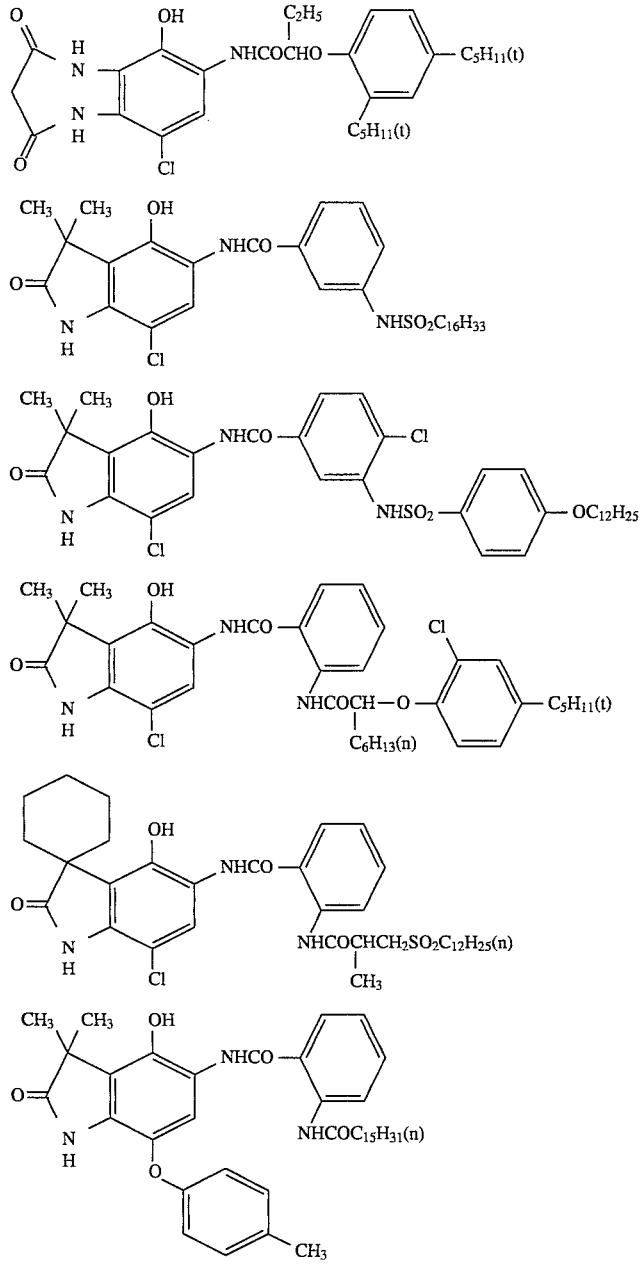

-continued
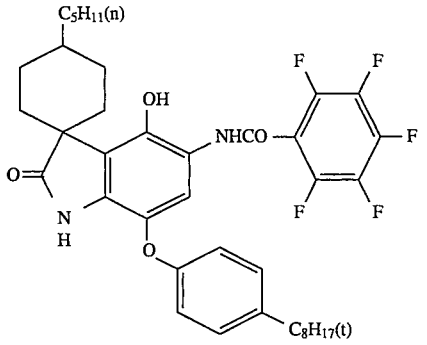
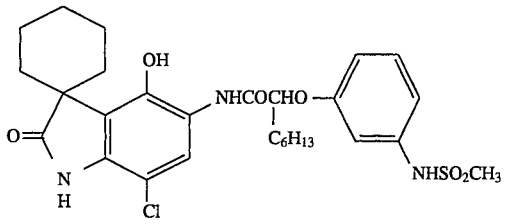
In addition to the cyan couplers of the above types, for example, diphenylamidazole cyan couplers described in European Patent Application Publication EP 0,249,453A2 can be used.
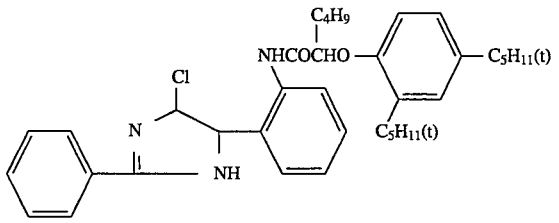
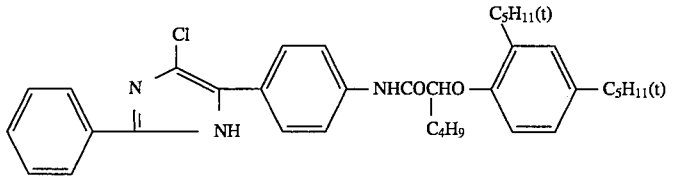
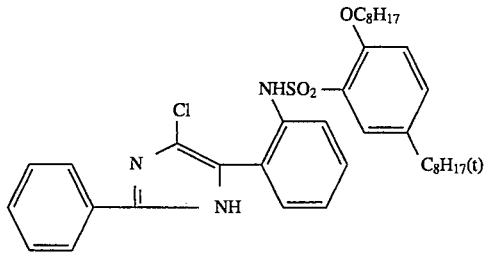
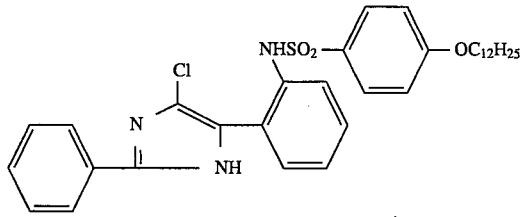

-continued

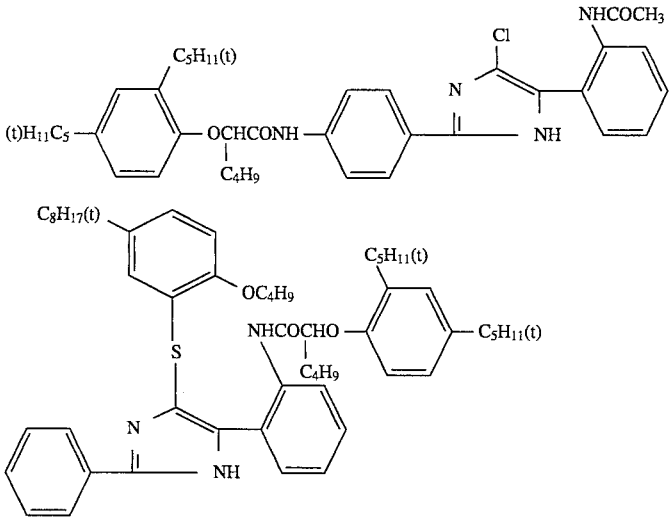

The phenol cyan coupler further includes ureide couplers described, for example, in U.S. Pat. Nos. 4,333,999, 4,451,559, 4,444,872, 4,427,767, and 4,579,813, and European Patent (EP) 067,689B1, and as typical examples thereof can be mentioned Coupler (7) described in U.S. Pat. No. 4,333,999, Coupler (1) described in U.S. Pat. No. 4,451,559, Coupler (14) described in U.S. Pat. No. 4,444,872, Coupler (3) described in U.S. Pat. No. 4,427,767, Couplers (6) and (24) described in U.S. Pat. No. 4,609,619, Couplers (1) and (11) described in U.S. Pat. No. 4,579,813, Couplers (45) and (50) described in European Patent (EP) 067,689B1, and Coupler (3) described in JP-A No. 42658/1986.

The naphthol cyan coupler includes, for example, those having an N-alkyl-N-arylcarbamoyl group at the 2-position of the naphthol nucleus (e.g., see U.S. Pat. No. 2,313,586), those having an alkylcarbamoyl group at the 2-position (e.g., see U.S. Pat. Nos. 2,474,293, and 4,282,312), those having an arylcarbamoyl group at the 2-position (e.g., see JP-B ("JP-B" means examined Japanese patent publication) No. 14523/1975), those having a carbonamido group or a sulfonamido group at the 5-position (e.g., see JP-A Nos. 237448/1985, 145557/1986, and 153640/1986), those having an aryloxy-coupling split-off group (e.g., see U.S. Pat. No. 3,476,563), those having a substituted alkoxy-coupling split-off group (e.g., see U.S. Pat. No. 4,296,199), and those having a glycolic acid-coupling split-off group (e.g., see JP-B 39217/1985).

These couplers can be dispersed together with at least one high-boiling organic solvent, to be incorporated in an emulsion layer. Preferably, a high-boiling organic solvent represented by one of formulae (A) to (D) is used:

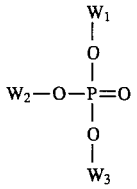

Formula (A)

$W_1-COO-W_2$ Formula (B)

-continued

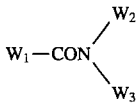

Formula (C)

$W_1-O-W_2$ Formula (D)

wherein $W_1$, $W_2$, and $W_3$ each represent a substituted or unsubstituted alkyl group, cycloalkyl group, alkenyl group, aryl group, or heterocyclic group, $W_4$ represents $W_1$, $OW_1$, or S—$W_1$, n is an integer of 1 to 5, and when n is 2 or over, $W_4$'s may be the same or different, and in formula (E), $W_1$ and $W_2$ may together form a condensed ring.

Details of these high-boiling organic solvents are described in JP-A No. 215272/1987, in the right lower column on page 137 to the right upper column on page 144. Other high-boiling organic solvents that can be used effectively for the couplers of the present invention are N,N-dialkylanilin derivatives. In particular, one having an alkoxy group bonded to the orthoposition of the N,N-dialkylamino group of the nucleus is preferable. More specifically, the following compounds can be exemplified:

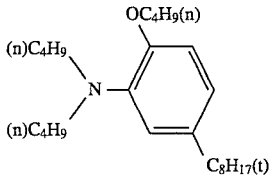

High-boiling organic solvents of this type are effective to prevent magenta stain from occurring with tame on the white background of the processed color print, and they also prevent fogging caused by development. The amount of the high-boiling organic solvents to be used is generally 10 to 500 mol %, and preferably 20 to 300 mol %, for the coupler.

These couplers can also be emulsified and dispersed into a hydrophilic colloid aqueous solution by impregnating then into a loadable latex polymer (e.g., see U.S. Pat. No. 4,203,716) in the presence or absence of the above-mentioned high-boiling organic solvent, or by dissolving then in a water-insoluble and organic-solvent soluble polymer.

Preferably, monopolymers or copolymers described on pages 12 to 30 of International Publication No. WO 88/00723 are used, and more preferably acrylamide polymers are used because, for example, the image dye is stabilized.

The photographic material that is prepared according to the present invention may contain, as a color antifoggant, for example, a hydroquinone derivative, an aminophenol derivative, a gallic acid derivative, or an ascorbic acid derivative.

In the photographic material of the present invention, various anti-fading agents (discoloration preventing agents) can be used. As organic anti-fading agents for cyan, magenta, and/or yellow images, typical examples are hydroquinones, 6-hydroxychromans, 5-hydroxycoumarans, spirochromans, p-alkoxyphenols, hindered phenols, including bisphenols, gallic acid derivatives, methylenedioxybenzenes, aminophenols, and hindered amines, and ether or ester derivatives thereof, obtained by silylating or alkylating the phenolic hydroxyl group of these compounds. Metal complexes such as (bissalicylaldoxymato)nickel complexes, and (bis-N,N-dialkyldithiocarbamato)nickel complexes can also be used.

Specific examples of organic anti-fading agents are described in the following patent specifications.

Hydroquinones are described, for example, in U.S. Pat. Nos. 2,360,290, 2,418,613, 2,700,453, 2,701,197, 2,728,659, 2,732,300, 2,735,765, 3,982,944, and 4,430,425, British Patent No. 1,363,921, and U.S. Pat. Nos. 2,710,801 and 2,816,028; 6-hydroxychromans, 5-hydroxycoumarans, and spirochromans are described, for example, in U.S. Pat. Nos. 3,432,300, 3,573,050, 3,574,627, 3,698,909, and 3,764,337, and JP-A No. 152225/1987; spiroindanes are described, for example, in U.S. Pat. No. 4,360,589; p-alkoxyphenols are described, for example, in U.S. Pat. No. 2,735,765, British Patent No. 2,066,975, JP-A No. 10539/1984, and JP-B No. 19765/1982; hindered phenols are described, for example, in U.S. Pat. No. 3,700,455, JP-A No. 72224/1977, U.S. Pat. No. 4,228,235, and JP-B No. 6623/1977; gallic acid derivatives, methylenedioxybenzenes, and aminophenols are described, for example, in U.S. Pat. Nos. 3,457,079, and 4,332,886, and JP-B No. 21144/1981, respectively; hindered amines are described, for example, in U.S. Pat. Nos. 3,336,135, and 4,268,593, British Patent Nos. 1,326,889, 1,354,313, and 1,410,846, JP-B No. 1420/1976, and JP-A Nos. 114036/1983, 53846/1984, and 78344/1984; ether and ester derivatives obtained by silylating or alkylating thir phenolic hydroxyl group are described, for example, in U.S. Pat. Nos. 4,155,765, 4,174,220, 4,254,216, and 4,264,720, JP-A No. 145530/1979, 6321/1980, 105147/1983, and 10539/1984, JP-B No. 37856/1982, U.S. Pat. No. 4,279,990, and JP-B No. 3263/1978; and metal complexes are described, for example, in U.S. Pat. No. 4,050,938 and 4,241,155, and British Patent No. 2,027,731 (A). These compounds are coemulsified with respective couplers, generally in amounts of 5 to 100 wt. % for respective couplers, and are added to photosensitive layers to attain the purpose. To prevent the cyan dye image from being deteriorated by heat and light, it is more effective that an ultraviolet-absorbing agent is introduced into the layers opposites to the cyan color-forming layer.

Off these anti-fading agents, spiroindanes and hindered amines are particularly preferable.

In the present invention, together with the above couplers, the following compounds are preferably used.

That is, it is preferred that a compound (F), which will chemically bond to the aromatic amide developing agent remaining after the color-developing process, to form a chemically inactive and substantially colorless compound, and/or a compound (G), which will chemically bond to the oxidized product of the aromatic amide color developing agent remaining after the color-developing process, to form a chemically inactive and substantially colorless compound, are used simultaneously or separately, for example, to prevent the occurrence of stain due to the formation of a color-developed dye by the reaction of the couplers with the color-developing agent remaining in the film during storage after the processing or with the oxidized product of the color-developing agent, and to prevent other side effects.

Preferable as compound (F) are those that can react with p-anisidine a the second-order reaction-specific rate k2 (in trioctyl phosphate at 80° C.) in the range of 1.0 l/mol sec to $1\times10^{-5}$ l/ mol sec. The second-order reaction- specific rate can be determined by the method described in JP-A No. 158545/1983.

If k2 is over this range, the compound itself becomes unstable, and in same cases the compound reacts with gelatin or water to decompose. On the other hand, if k2 is below this range, the reaction with the remaining aromatic amine developing agent becomes slow, resulting, in same cases, in the failure to prevent the side effects of the remaining aromatic amine developing agent, which prevention is aimed at by the present invention.

More preferable as compound (F) are those that can be represented by the following formula (FI) or (FII):

$$R'_1-(A)n-X \qquad \text{Formula (FI)}$$

$$R'_2-\underset{\underset{B}{|}}{C}=Y \qquad \text{Formula (FII)}$$

wherein $R_1'$ and $R_2'$ each represent an aliphatic group, an aromatic group, or a heterocyclic group, n is 1 or 0, A represents a group that will react with an aromatic amine developing agent to form a chemical bond therewith, X represents a group that will react with the aromatic amine developing agent and split off, B represents a hydrogen atom, an aliphatic group, an aromatic group, a heterocyclic group, an acyl group, or a sulfonyl group, Y represents a group that will facilitate the addition of the aromatic amine developing agent to the compound represented by formula (II), and $R_1'$ and X, or Y and $R_2'$ or B, may bond together to form a ring structure.

Of the processes wherein compound (F) bonds chemically to the remaining aromatic amine developing agent, typical processes are a substitution reaction and an addition reaction.

Specific examples of the compounds represented by formulae (FI), and (FII) are described, for example, in JP-A Nos. 158545/1988, 28338/1987, 2042/1989, and 86139/1989.

On the other hand, more preferable examples of compound (G), which will chemically bond to the oxidized product of the aromatic amine developing agent remaining after color development processing, to form a chemically inactive and colorless compound, can be represented by the following formula (GI):

$$R\text{-}Z \qquad \text{formula (GI)}$$

wherein R represents an aliphatic group, an aromatic group, or a heterocyclic group, Z represents a nucleophilic group or a group that will decompose in the photographic material to release a nucleophilic group. Preferably the compounds represented by formula (GI) are ones wherein Z represents a group whose Pearson's nucleophilic "$CH_3I$ value (R. G. Pearson, et al., *J. Am. Chem. Soc.*, 90, 319 (1968)) is 5 or over, or a group derived therefrom.

Specific examples of compounds represented by formula (GI) are described, for example, in European Published Patent No. 255722, JP-A Nos. 143048/1987, 229145/1987, and 86139/1989, Japanese Patent Application No. 136724/1988, and JP-A Nos. 57259/1989 and 2042/1989.

Details of combinations of compound (G) and compound (F) are described in JP-A No. 86139/1989.

Similarly, for the purpose of preventing the occurrence of stain and other side effects due to the formation of a color-developed dye by the reaction of a coupler with the color-developing agent remaining in the film or the oxidized product of the color-developing agent during storage after the processing, it is preferable to use an amine compound. Preferable amine compounds can be represented by the following formula (FG):

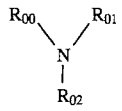

Formula (FG)

wherein $R_{00}$ represents a hydrogen atom, a hydroxy group, an alkoxy group, an acyloxy group, a sulfonyloxy group, a substituted or unsubstituted amino group, an alkoxy group, an aryloxy group, a heterocyclic oxy group, an aliphatic group, an aromatic group, an aromatic group, or a heterocyclic group, $R_{01}$ represents a hydrogen atom, an aliphatic group, an aromatic group, or a heterocyclic group, $R_{02}$ represents an aliphatic group, an aromatic group, or a heterocyclic group, and at least two groups of $R_{00}$, $R_{01}$, and $R_{02}$ may bond together to form a monocyclic or polycyclic heterocyclic ring.

Specific examples of compounds represented by formula (FG) are described, for example, in U.S. Pat. Nos. 4,483,918, 4,555,479, and 4,585,728, and JP-A No. 102231/1983 and 229557/1984.

The photographic material prepared in accordance with the present invention may contain, in the hydrophilic colloid layer, water-soluble dyes as filter dyes or for the purpose of preventing irradiation and other purposes. Such dyes include oxonol dyes, hemioxonol dyes, styryl dyes, merocyanine dyes, cyanine dyes, and azo dyes. Among others, oxonol dyes, hemioxonol dyes, and merocyanine dyes are useful.

As a binder or a protective colloid that can be used in the emulsion layers of the present photographic material, gelatin is advantageously used, but other hydrophilic colloids can be used alone or in combination with gelatin.

In the present invention, gelatin may be lime-treated gelatin or acid-processed gelatin. Details of the manufacture of gelatin is described by Arthur Veis in *The Macromolecular Chemistry of Gelatin* (published by Academic Press, 1964).

As a base to be used in the present invention, a transparent film, such as cellulose nitrate film, and polyethylene terephthalate film or a reflection-type base that is generally used in photographic materials can be used. For the objects of the present invention, the use of a reflection-type base is more preferable.

The "reflection base" to be used in the present invention is one that enhances reflectivity, thereby making sharper the dye image formed in the silver halide emulsion layer, and it includes one having a base coated with a hydrophobic resin containing a dispersed light-reflective substance, such as titanium oxide, zinc oxide, calcium carbonate, and calcium sulfate, and also a base made of a hydrophobic resin containing a dispersed light-reflective substance. For example, there can be mentioned baryta paper, polyethylene-coated paper, polypropylene-type synthetic paper, a transparent base having a reflective layer, or additionally using a reflective substance, such as glass plate, polyester films of polyethylene terephthalate, cellulose triacetate, or cellulose nitrate, polyamide film, polycarbonate film, polystyrene film, and vinyl chloride resin, which may be suitably selected in accordance with the purpose of the application.

It is advantageous that, as the light-reflective substance, a white pigment is kneaded well in the presence of a surface-active agent, and it is preferable that the surface of the pigment particles has been treated with a divalent to tetravalent alcohol.

The occupied area ratio (%) per unit area prescribed for the white pigments finely divided particles can be obtained most typically by dividing the observed area into contiguous unit areas of 6 μm×6 μm, and measuring the occupied area ratio (%) ($R_1$) of the finely divided particles projected onto the unit areas. The deviation coefficient of the occupied area ratio (%) can be obtained based on the ratio $s/\overline{R}$, wherein s stands for the standard deviation of $R_1$, and $\overline{R}$ stands for the average value of $R_1$. Preferably, the number (n) of the unit areas to be subjected is 6 or over. Therefore, the deviation coefficient $s/\overline{R}$ can be obtained by $$\sqrt{\frac{\sum_{i=1}^{n}(R_1-\overline{R})^2}{n=1}} \Big/ \frac{\sum_{i=1}^{n} R_1}{n}$$

In the present invention, preferably the deviation coefficient of the occupied area ratio (%) of the finely divided particles of a pigment is 0.15 or below, and particularly 0.12 or below. If the variation coefficient is 0.08 or below, it can be considered that the substantial dispersibility of the particles is substantially "uniform."

Details of color developers used in the present invention will now be described.

In practicing the present invention, it is preferable to use a developer substantially free from benzyl alcohol. Herein the term "substantially free from" means that the concentration of benzyl alcohol is preferably 2 ml/l or below, and more preferably 0.5 ml/l or below, and most preferably benzyl alcohol is not contained at all.

It is more preferable that the developer used in the present invention is substantially free from sulfite ions. Sulfite ions serve as a preservative of developing agents, and at the same tame have an action for dissolving silver halides, and they react with the oxidized product of the developing agent, thereby exerting an action to lower the dye-forming efficiency. It is presumed that such actions are one of causes for an increase in the fluctuation of the photographic characteristics. Herein the term "substantially free from" sulfite ions means that preferably the concentration of sulfite ions is $3.0\times10^{-3}$ mol/l or below, and most preferably sulfite ions are not contained at all. However, in the present invention, a quite mall amount of sulfite ions used for the prevention of oxidation of the processing kit in which the developing agent is condensed is not considered.

Preferably, the developer used in the present invention is substantially free from sulfite ions, and more preferably, in addition thereto it is substantially free from hydroxylamine. This is because hydroxylamine serves as a preservative of the developer, and at the same tame has itself an activity for developing silver, and it is considered that the fluctuation of the concentration of hydroxylamine influences greatly the photographic characteristics. Herein the term "substantially free from hydroxylamine " means that preferably the concentration of hydroxylamine is $5.0\times10^{-3}$ mol/l or below, and most preferably hydroxylamine is not contained at all.

It is preferable that the developer used in the present invention contains an organic preservative instead of hydroxylamine or sulfite ions, in that process color-contamination and fluctuation of the photographic quality in continuous processing can be suppressed.

Herein the term "organic preservative" refers to organic compounds that generally, when added to the processing solution for the color photographic material, reduce the speed of deterioration of the aromatic primary amine color-developing agent. That is, organic preservatives include organic compounds having a function to prevent the color-developing agent from being oxidized, for example, with air, and in particular, hydroxylamine derivatives (excluding hydroxylamine, hereinafter the same being applied), hydroxamic acids, hydrazines, hydrazides, phenols, α-hydroxyketones, α-amino ketones, saccharides, monoamines, diamines, polyamines, quaternary amines, nitroxyradicals, alcohols, oximes, diamide compounds, and condensed cyclic amines are effective organic preservatives. These are disclosed, for example, in JP-A Nos. 4235/1988, 30845/1988, 21647/1988, 44655/1988, 5355/1988, 43140/1988, 56654/1988, 58346/1988, 43138/1988, 146041/1988, 170642/1988, 44657/1988, and 44656/1988, U.S. Pat. Nos. 3,615,503 and 2,494,903, JP-A No. 143020/1977, and JP-B 30496/1973.

With respect to the above-mentioned preferable organic preservatives, their formulae and specific compounds are listed below, but the present invention is not limited to them.

It is desirable that the amount of the compound s given below to be added to the color developer is 0.005 to 0.5 mol/l, and preferably 0.03 to 0.1 mol/l.

Particularly, it is preferable to add a hydroxylamine derivative and/or a hydrazine derivative.

A hydroxylamine derivative represented by the following formula (I) is preferable:

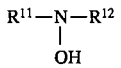

Formula (I)

wherein $R^{11}$ and $R^{12}$ each represent a hydrogen atom, a substituted or unsubstituted alkyl group, a substituted or unsubstituted alkenyl group, a substituted or unsubstituted aryl group, or a heteroaromatic group, and when $R^{11}$ and $R^{12}$ are not hydrogen atoms at the same tame, they may bond together with the nitrogen atom to form a heterocyclic ring. The heterocyclic ring may be a saturated or unsaturated 5- or 6-membered ring consisting, for example, of carbon atoms, hydrogen atoms, halogen atoms, oxygen atoms, nitrogen atoms, and sulfur atoms.

Preferably, $R^{11}$ and $R^{12}$ each represent an alkyl group, or alkenyl group having 1 to 10, more preferably 1 to 5 carbon atoms. The nitrogen-containing heterocyclic ring formed by bonding $R^{11}$ and $R^{12}$ includes, for example, a piperidyl group, a pyrrolidyl group, an N-alkylpiperadyl group, a morpholyl group, an indolinyl group, and a benztriazole group.

Preferable substituents of $R^{11}$ and $R^{12}$ are a hydroxy group, an alkoxy group, an alkyl group, an arylsulffonyl group, an amido group, a carboxy group, a cyano group, a sulfo group, a nitro group, and an amino group.

Compound Exasmples

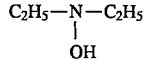

I-1

-continued

Compound Exasmples

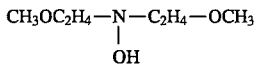

I-2

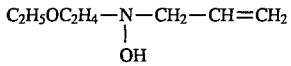

I-3

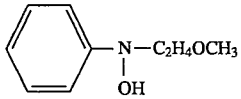

I-4

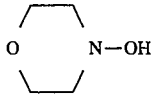

I-5

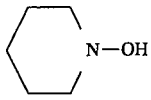

I-6

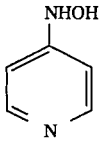

I-7

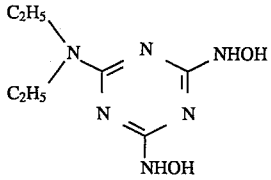

I-8

Preferable hydrazines and hydrazides are the following:

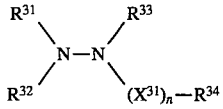

Formula (II)

wherein $R^{31}$, $R^{32}$, and $R^{33}$ each represent a hydrogen atom, a substituted or unsubstituted alkyl group, aryl group, or heterocyclic group, $R^{34}$ represents a hydroxy group, a hydroxyamino group, a substituted or unsubstituted alkyl group, aryl group, heterocyclic group, alkoxy group, or aryloxy group, a carbamoyl group, or an amino group, which heterocyclic group is a 5- to 6-membered ring consisting of C, H, O, N, S and halogen atoms, and it may be saturated or unsaturated, $X^{31}$ represents a divalent group selected from the group consisting of —CO—, —$SO_2$—, and

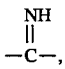

n is 0 or 1. In particular when n is 0, $R^{34}$ represents a group selected from among an alkyl group, an aryl group, and a heterocyclic group, and $R^{33}$, and $R^{34}$ may form together a heterocyclic ring.

In formula (II), preferably $R^{31}$, $R^{32}$, and $R^{33}$ each represent a hydrogen atom or an alkyl group having 1 to 10 carbon atoms, and particularly it is most preferable that $R^{31}$ and $R^{32}$ each represent a hydrogen atom.

In formula (II), preferably, $R^{34}$ represents an alkyl group, an aryl group, an alkoxy group, a carbamoyl group, or an amino group, with an alkyl group or a substituted alkyl group particularly preferable. In this case, preferable substituents of the alkyl group are, for example, a carboxyl group, a sulfo group, a nitro group, an amino group, and a phosphono group. Preferably, $X^{31}$ represents —CO— or —$SO_2$—, with —CO— being the most preferable.

Compound Example

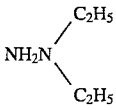
II-1

$NH_2NH(CH_2)_4SO_3H$ II-2

$NH_2NH(CH_2)_2OH$ II-3

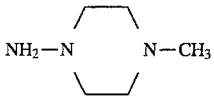
II-4

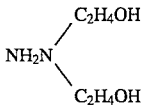
II-5

$NH_2NHCOCH_3$ II-6

$NH_2NHCOOC_2H_5$ II-7

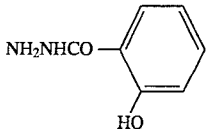
II-8

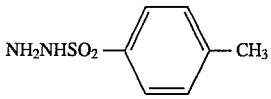
II-9

$NH_2NHCONH_2$ II-10

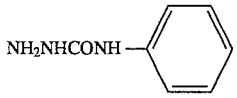
II-11

$NH_2NHSO_3H$ II-12

$NH_2NHC(=NH)NH_2$ II-13

$NH_2NHCOCONHNH_2$ II-14

$NH_2NHCH_2CH_2CH_2SO_3H$ II-15

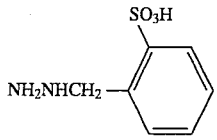
II-16

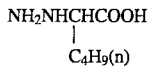
I-17

$NH_2NHCH_2CH_2COOH$ II-18

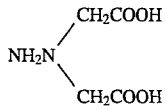
II-19

-continued

Compound Example

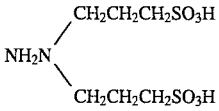
II-20

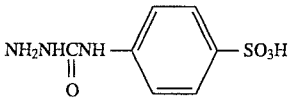
II-21

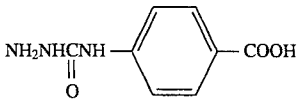
II-22

The use of a combination of a compound represented by formula (I) or (II) and an amine represented by formula (III) or (IV) given below is preferable in view of the improvement of stability of the color developer and the improvement in the stability in continuous processing.

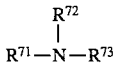
Formula (III)

wherein $R^{71}$, $R^{72}$, and $R^{73}$ each represent a hydrogen atom, an alkyl group, an alkenyl group, an aryl group, an aralkyl group, or a heterocyclic group, and $R^{71}$ and $R^{72}$, or $R^{71}$ and $R^{73}$, or $R^{72}$ and $R^{73}$ may bond together to form a nitrogen-containing heterocyclic ring.

$R^{71}$, $R^{72}$, and $R^{73}$ may be substituted Particularly preferably, $R^{71}$, $R^{72}$, and $R^{73}$ each represent a hydrogen atom or an alkyl group. As the substituent can be mentioned, for example, a hydroxyl group, a sulfo group, a carboxyl group, a halogen atom, a nitro group, and an amino group.

Compound Examples $N(CH_2CH_2OH)_3$ III-1

$H_2NCH_2CH_2OH$ III-2

$HN(CH_2CH_2OH)_2$ III-3

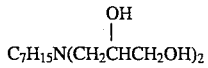
III-4

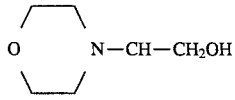
III-5

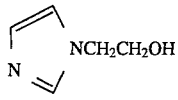
III-6

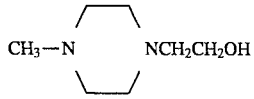
III-7

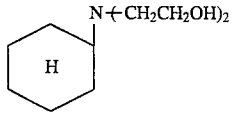
III-8

-continued

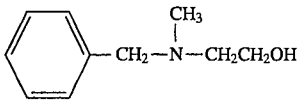

III-9

$(HOCH_2CH_2)_2NCH_2CH_2SO_2CH_3$ III-10

$HN(CH_2COOH)_2$ III-11

$HOOCCH_2CH_2CH(NH_2)COOH$ III-12

$H_2NCH_2CH_2SO_2NH_2$ III-13

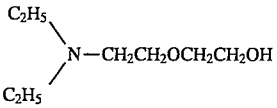

III-14

$H_2N-C(CH_2OH)_2$ III-15

$HOCH_2CH(NH_2)COOH$ III-16

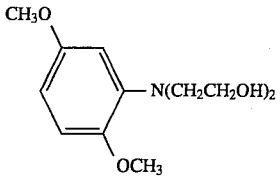

III-17

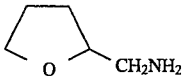

III-18

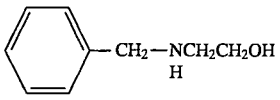

III-19

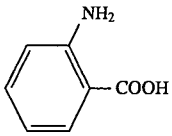

III-20

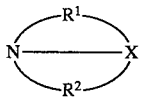

Formula (IV)

wherein X represents a trivalent group of atoms required for the completion of a condensed ring, and $R^1$ and $R^2$, which may be the same or different each represent an alkylene group, an arylene group, an alkenylene group, or an aralkylene group.

Of compounds represented by formula (IV), particularly preferable ones are compounds represented by formulae (IV-a) and (IV-b):

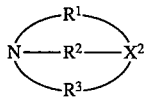

(IV-a)

wherein $X^1$ represents

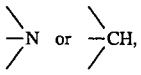

$R^1$ and $R^2$ have the same meaning as defined in formula (IV), and $R^3$ has the same meaning as $R^1$ and $R^3$, or it represents

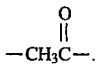

Preferably, in formula (IV-a), X represents

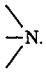

Preferably $R^1$, $R^2$, and $R^3$ each have 6 or less carbon atoms, with 3 or less carbon atoms being more preferable, and 2 carbon atoms being the most preferable.

Preferably $R^1$, $R^2$, and $R^3$ each represent an alkylene group or an arylene group.

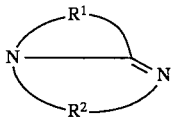

(IV-b)

wherein $R^1$ and $R^2$ have the same meaning as defined in formula (IV).

In formula (IV-b), preferably $R^1$ and $R^2$ each have up to 6 carbon atoms. Preferably $R^1$ and $R^2$ each represent an alkylene group or an arylene group, with an alkylene group being the most preferable.

Of compounds represented by formula e (IV-a) and (IV-b), particularly preferable ones are compounds represented by formula (IV-a).

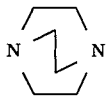

IV-1

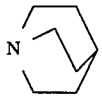

IV-2

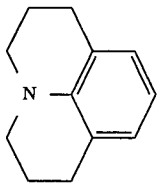

IV-3

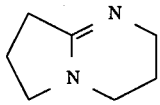

IV-4

-continued

IV-5

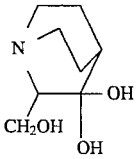

IV-6

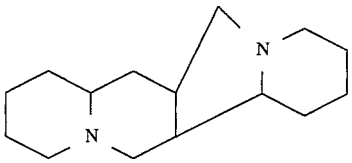

IV-7

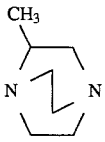

IV-8

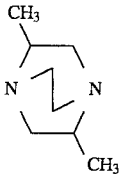

IV-9

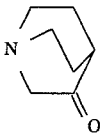

IV-10

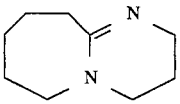

IV-11

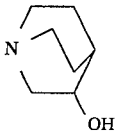

IV-12

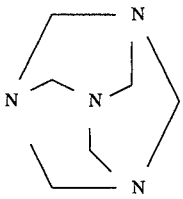

IV-13

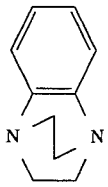

IV-14

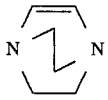

-continued

IV-15

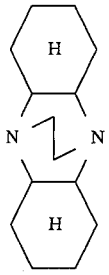

IV-16

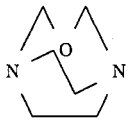

IV-17

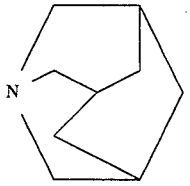

IV-18

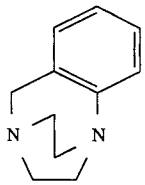

The above-mentioned organic preservatives can be commercially available, but they can also be synthesized by methods described, for example, in JP-A Nos. 170642/1988 and 239447/1988.

The color developer used in the present invention contains a known aromatic primary amine color-developing agent. Preferable examples thereof are p-phenylenediamine derivatives, and typical examples thereof are given below, but the present invention is not limited to them.

D-1: N,N-diethyl-p-phenylenediamine
D-2: 2-amino -5-diethylamino toluene
D-3: 2-amino -5-(N-ethyl-N-laurylamino)toluene
D-4: 4-[N-ethyl-N-(β-hydroxyethyl)amino]aniline
D-5: 2-methyl-4-[N-ethyl-N-(β-hydroxyethyl)amino] aniline
D-6: 4-amino -3-methyl-N-ethyl-N-[β-(methanesulfonamido)ethyl]-aniline
D-7: N-(2-amino -5-diethylamino phenylethyl)methanesulfonamide
D-8: N,N-dimethyl-p-phenylenediamine
D-9: 4-amino -3-methyl-N-ethyl-N-methoxyethylaniline
D-10: 4-amino -3-methyl-N-ethyl-N-β-ethoxyethylaniline
D-11: 4-amino -3-methyl-N-ethyl-N-β-butoxyethylaniline Of the above p-phenylenediamine derivatives, 4-amino-3-methyl-N-ethyl-N-[β-(methanesulfonamido)ethyl]-aniline (Exemplified Compound D-6) is particularly preferable.

Also these p-phenylenediamine derivatives may be in the form of a salt, such as a sulfate, a hydrochloride, a sulfite, and a p-toluene sulfonate. The amount of the aromatic primary amine developing agent to be used is preferably about 0.1 g to about 20 g, and more preferably about 0.5 g to about 10 g, per liter of the developer.

Preferably the color developer used in the present invention has a pH of 9 to 12, and more preferably 9 to 11.0, and it can contain other known developer components.

In order to keep the above pH, it is preferable to use various buffers. As buffers, use can be made, for example, of phosphates, carbonates, borates, tetraborates, hydroxybenzoates, glycyl salts, N,N-dimethylglycinates, leucinates, norleucinates, guanine salts, 3,4-dihydroxyphenylalanine salts, alanine salts, aminolbutyrates, 2-amino -2-methyl-1, 3-propandiol salts, valine salts, proline salts, trishydroxyaminomethane salts, and lysine salts. It is particularly preferable to use carbonates, phosphates, tetraborates, and hydroxybenzoates as buffers, because they have advantages that they are excellent in solubility and in buffering function in the high pH range of a pH of 9.0 or higher, they do not adversely affect the photographic function (for example, to cause flogging), and they are inexpensive. Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium-hydroxybenzoate (sodium salicylate), potassium o-hydroxybenzoate, sodium 5-sulfo-2-hydroxybenzoate (sodium 5-sulfosalicylate), and potassium5-sulfo-2-hydroxybenzoate (potassium 5-sulfosalicylate). However, the present invention is not limited to these compounds.

The amount of buffer to be added to the color developer is preferably 0.1 mol/l, and particularly preferably 0.1 to 0.4 mol/l.

In addition to the color developer can be added various chelating agents to prevent calcium or magnesium from precipitating or to improve the stability of the color developer: nitrilotriacetic acid, diethylenediaminepentaacietic acid, ethylenediaminetetraacetic acid, N,N,N-trimethylenephosphonic acid, ethylenediamine-N,N,N',N'-tetramethylenesulfonic acid, transcyclohexanediamine tetraacetic acid, 1,2-diamino propanetetraacetic acid, glycol ether diamine tetraacetic acid, glycol ether diamine tetraacetic acid, ethylenediamine-ortho-hyroxyphenyltetraacetic acid, 2-phosphonobutane-1,2,4-tricarboxylic acid, 1-hydroxyethylidene-1,1-diphosphonic acid, and N,N'-bis( 2-hydroxybenzyl)ethylenediamine -N,N'-diacetic acid.

If necessary, two or more of these chelating agents may be used together.

With respect to the amount of these chelating agents to be added to the color developer, it is good if the amount is enough to sequester metal ions in the color developer. The amount, for example, is on the order of 0.1 g to 10 g per liter.

If necessary, any development accelerator can be added to the color developer. However, it is preferable that the color developer of the present invention is substantially free from benzyl alcohol, in view of pollution, the solution preparation, and the prevention of color stain. Herein the term "substantially free from " means that the amount of benzyl alcohol is 2 ml or below per liter of the developer, or preferably benzyl alcohol is not contained in the developer at all.

As other development accelerators, the following can be added as desired: thioether compounds disclosed, for example, in JP-B Nos. I6088/1962, 5987/1962, 7826/1962, 12380/1969, and 9019/1970, and U.S. Pat. No. 3,813,247; p-phenylenediamine compounds disclosed in JP-A Nos. 49829/1977 and 15554/1975; quaternary ammonium salts disclosed, for example, in JP-A No. 137726/1975, JP-B No. 30074/1969, and JP-A Nos. 156826/1981 and 43429/1977; amine compounds disclosed, for example, in U.S. Pat. Nos. 2,494,903, 3,128,182, 4,230,796, and 3,253,919, JP-B No. 11431/1966, and U.S. Pat. Nos. 2,482,546, 2,596,926, and 3,582,346; polyalkylene oxides disclosed, for example, in JP-B Nos. 16088/1962 and 25201/1967, U.S. Pat. No. 3,128,183, JP-B Nos. 11431/1966 and 23883/1967, and U.S. Pat. No. 3,532,501; 1-phenyl-3-pyrazolidones, and imidazoles.

In the present invention, if necessary, any antifoggant can be added. As antifoggants, use can be made of alkali metal halides, such as sodium chloride, potassium bromide, and potassium iodide, and organic antifoggants. As typical organic antifoggants can be mentioned, for example, nitrogen-containing heterocyclic compounds, such as benzotriazole, 6-nitrobenzimidazole, 5-nitroisoindazole, 5-methylbenzotriazole, 5-nitrobenzotriazole, 5-chloro-benzotriazole, 2-thiazolylbenzamidazole, 2-thiazolylmethyl-benzamidazole, indazole, hydroxyazaindolizine, and adenine.

It is preferable that the color developer used in the present invention contains a brightening agent. As a brightening agent, 4,4'-diamino -2,2'-disulfostilbene compounds are preferable. The amount of brightening agent to be added is 0 to 5 g/l, and preferably 0.1 to 4 g/l.

If necessary, various surface-active agents may be added, such as alkyl sulfonates, aryl sulfonates, aliphatic acids, and aromatic carboxylic acids.

The processing temperature of the color developer of the invention is 20° to 50° C., and preferably 30° to 40° C. The processing tame is 20 sec to 5 min, and preferably 30 sec to 2 min. Although it is preferable that the replenishing amount is as small as possible, it is suitable that the replenishing amount is 20 to 600 ml preferably 50 to 300 ml, more preferably 60 to 200 ml, and most preferably 60 to 150 ml, per square meter of the photographic material.

The desilvering step in the present invention will now be described.

Generally the desilvering step may comprise, for example, any of the following steps: a bleaching step—a fixing step; a fixing step—a bleach-fixing step; a bleaching step—a bleach-fixing step; and a bleach/fix step.

Next, the bleaching solution, the bleach-fixing solution, and the fixing solution that are used in the present invention will be described.

As the bleaching agent used in the bleaching solution or the bleach-fixing solution used in present invention, use is made of any bleaching agents, but particularly it is preferable to use organic complex salts of iron(III) (e.g., complex salts of aminopolycarboxylic acids, such as ethylenediaminetetraacetic acid, and diethylenetriaminepentaacetic acid, aminopolyphosphonic acids, phosphonocarboxylic acids, and organic phosphonic acids); organic acids, such as citric acid, tartaric acid, and malic acid; persulfates; and hydrogen peroxide.

Of these, organic complex salts of iron (III) are particularly preferable in view of the rapid processing and the prevention of environmental pollution. Aminopolycarboxylic acids, aminopolyphosphonic acids, or organic phosphonic acids, and their salts useful to form organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methylaminodiacetic acid, aminodiacetic acid, and glycol ether diaminetetraacetic acid. These compounds may be in the form of any salts of sodium, potassium, lithium, or ammonium. Of these compounds, iron(III) complex salts of ethylenediaminetetraacetic acid, diethylenetriaminepentaacetic acid, cyclohexanediaminetetraacetic acid, 1,3-diaminopropanetetraacetic acid, and methylaminodiacetic acid are preferable, because they are high in bleaching power. These ferric ion, complex salts may be used in the form of a complex salt, or they may be formed in solution by using a ferric salt such as ferric sulfate, ferric chloride, ferric nitrate, ammonium ferric sulfate, and ferric phosphate, and a chelating agent such as aminopolycarboxylic acids, aminopolyphosphonic acids, and phosphonocarboxylic acids. The chelating agent may be used in excess to form the ferric ion complex salt. Of iron complexes, aminopolycarboxylic acid iron complexes are preferable, and the amount thereof to be added is 0.01 to 1.0 mol/l, and more preferably 0.05 to 0.50 mol/l.

In the bleaching solution, the bleach-fix solution, and/or the bath preceding them, various compounds may be used as a bleach accelerating agent. For example, the following compounds are used: compounds having a mercapto group or a disulfido bond, described in U.S. Pat. No. 3,893,858, German Patent No. 1,290,812, JP-A No. 95630/1978, and *Research Disclosure* No. 17129 (July 1978), thiourea compounds described, for example, in JP-B No. 8506/1970, JP-A Nos. 20832/1977 and 32735/1978, and U.S. Pat. No. 3,706,561, or halides such as iodides and bromides, which are preferable because of their excellent bleaching power.

further, the bleaching solution or the bleach-fixing solution used in the present invention can contain rehalogenizing agents, such as bromides (e.g., potassium bromide, sodium bromide, and ammonium bromide), chlorides (e.g., potassium chloride,sodium chloride, and ammonium chloride), or iodides (e.g., ammonium iodide). If necessary the bleaching solution or the bleach-fixing solution can contained, for example, one or more inorganic acids and organic acids or their alkali salts or ammonium salts having a pH-buffering function, such as borax, sodium metaborate, acetic acid, sodium acetate, sodium carbonate, potassium carbonate, phosphorous acid, phosphoric acid, sodium phosphate, citric acid, sodium citrate, and tartaric acid, and ammonium nitrate, and guanidine as a corrosion inhibitor.

The fixing agent used in the bleach-fixing solution or the bleaching solution according to the present invention can use one or more of water-soluble silver halide solvents, for example thiosulfates, such as sodium thiosulfate and ammonium thiosulfate, thiocyanates, such as sodium thiocyanate and ammonium thiocyanate, thiourea compounds and thioether compounds, such as ethylenebisthioglycolic acid and 3,6-dithia-1,8-octanedithiol. For example, a special bleach-fixing solution comprising a combination of a fixing agent described in JP-A No. 155354/1980 and a large amount of a halide, such as potassium iodide, can be used. In the present invention, it is preferable to use thiosulfates, and particularly ammonium thiosulfate. The amount of the fixing agent per liter is preferably 0.3 to 2 mol, and more preferably 0.5 to 1.0 mol. The pH range of the bleach-fixing solution or the fixing solution is preferably 1 to 10, and particularly preferably 5 to 9.

further, the bleach-fixing solution may additionally contain various brightening agents, anti-forming agents, surface-active agents, polyvinyl pyrrolidone, and organic solvents, such as methanol.

The bleach-fixing solution or the fixing solution used in the present invention contains, as a preservative, sulfites (e.g., sodium sulfite, potassium sulfite, and ammonium sulfite), bisulfites (e.g., ammonium bisulfite, sodium bisulfite, and potassium bisulfite), and methabisulfites (e.g., potassium metabisulfite, sodium metabisulfite, and ammonium metabisulfite). Preferably these compounds are contained in an amount of 0.02 to 0.05 mol/l, and more preferably 0.04 to 0.40 mol/l, in terms of sulfite ions.

As a preservative, generally a bisulfite is added, but other compounds, such as ascorbic acid, carbonyl bisulfite addition compound, or carbonyl compounds, may be added.

If required, for example, buffers, brightening agents, chelating agents, anti-forming agents, and mildew-proofing agents may be added.

The silver halide color photographic material used in the present invention is generally washed and/or stabilized after the fixing or the desilvering, such as the bleach-fixing.

The amount of washing water in the washing step can be set over a wide range, depending on the characteristics of the photographic material (e.g., the characteristics of the materials used, such as couplers), the application of the photographic material, the washing water temperature, the number of the washing water tanks (stages), the type of replenishing (i.e., depending on whether the replenishing is of the countercurrent type or of the down flow type), and other various conditions. The relationship between the number of washing water tanks and the amount of water in the multi-stage countercurrent system can be determined based on the method described in *Journal of the Society of Motion Picture and Television* Engineers, Vol. 64, pp. 248 to 253 (May 1955). Generally, the number of stages in a multi-stage countercurrent system is preferably 2 to 6, and particularly preferably 2 to 4.

According to the multi-stage countercurrent system, the amount of washing water can be reduced considerably. For example, the amount can be 0.5 to 1 l per square meter of the photographic material, and the effect of the present invention is remarkable. But a problem arises that bacteria can propagate due to the increase in the dwelling time of the water in the tanks, and the suspended matter produced will adhere to the photographic material. To solve such a problem in processing the color photographic material of the present invention, the process for reducing calcium and magnesium described in JP-A No. 131632/1986 can be used quite effectively. Further, isothiazolone compounds and thiabendazoles described in JP-A No. 8542/1982, chlorine-type bactericides, such as sodium chlorinated isocyanurates described in JP-A No. 120145/1986, benzotriazoles described in JP-A No. 267761/1986, copper ions, and bactericides described by Hiroshi Hori in *Bokin Bobai-zai no Kagaku, Biseibutsu no Genkin, Sakkin, Bobai Gijutsu* (edited by Eiseigijutsu-kai), and *Bokin Bobai-zai Jiten* (edited by Nihon Boki Bobai-gakkai), can be used.

Further, the washing water can contain surface-active agents as a water draining agent, and chelate agents such as EDTA as a water softener.

After the washing step mentioned above, or without the washing step, the photographic material is processed with a stabilizer. The stabilizer can contain compounds that have an image-stabilizing function, such as aldehyde compounds, for example typically formalin, buffers for adjusting the pH of the stabilizer suitable to the film pH for the stabilization of the dye, and ammonium compounds. Further, in the stabilizer, use can be made of the above-mentioned bactericides and anti-mildew agent for preventing bacteria from propagating in the stabilizer, or for providing the processed photographic material with mildew-proof properties.

Still further, surface-active agents, brightening agents, and hardening agents can also be added. In the processing of the photographic material of the present invention, if the stabilization is carried out directly without a washing step, known methods described, for example, in JP-A Nos. 8543/1982, 14834/1983, and 20345/1985, can be used.

Further, chelate agents, such as 1-hydroxyethylidene-1,1-diphosphonic acid, and ethylenediaminetetramethylenephosphonic acid, and magnesium and bismuth compounds can also be used in preferable modes.

A so-called rinse can also be used as a washing solution or a stabilizing solution, used after the desilverization in the present invention.

The pH of the washing step or a stabilizing step of the present invention is preferably 5 to 8. The temperature will vary depending, for example, on the application and the characteristics of the photographic material, and it generally will be 15° to 45° C., and preferably 20° to 40° C. Although the time can be arbitrarily set, it is desirable that the time is as short as possible, because the processing time can be reduced. Preferably the time is 15 sec to 1 min and 45 sec, and more preferably 30 sec to 1 min and 30 sec. It is preferable that the replenishing amount is as low as possible in view, for example, of the running cost, the reduction in the discharge, and the handleability.

A specific preferable replenishing amount per unit area of the photographic material is 0.5 to 50 times, and more preferably 3 to 40 times, the carry-in from the preceding bath. The replenishing amount per square meter of the photographic material is 1 l or below, and preferably 500 ml or below. The replenishing may be carried out continuously or intermittently.

The solutions used in the washing step and/or the stabilizing step can be used in the step preceding them. For example, the overflow of the washing water used in the multi-stage countercurrent system is allowed to flow into the bleach-fix solution preceding it, and a concentrate is supplied to the bleach-fix solution, so that the amount of the liquor can be decreased.

The total time of the desilvering step, the time of the washing step, and the time of the stabilizing step is up to 2 min, and preferably 30 sec to 1 min and 30 sec. Herein the total time means the period from the time when the silver halide color photographic material is brought in contact with the first bath of the desilvering step to the time when the silver halide photographic material leaves the last bath of the washing step or the stabilizing step, including the airborne time required for the movement of the silver halide color photographic material between the baths.

Herein "the sum of the desilvering time, the washing time, and the stabilizing time is up to 2 min" means that the sum of the periods of the processes (more specifically the washing process and/or stabilizing process) included from the desilvering step to the drying step is up to 2 min, and, for example, the sum of the periods of

| | |
|---|---|
| (1) desilvering | washing |
| (2) desilvering | stabilizing or |
| (3) desilvering | washing stabilizing |

is 2 min or below.

Now the present invention will be further described in detail with reference to Examples.

EXAMPLE b 1

A multilayer color printing paper having a layer constitution given below formed on a paper base, both surfaces of which had been laminated with polyethylene, was prepared (Sample A). Coating solutions were prepared as follows:

The preparation of the first layer coating solution 27.2 ml of ethyl acetate and 8.2 g of a solvent (Solv-3) were added to 19.1 g of a yellow coupler (ExY), 4.4 g of an image dye stabilizer (Cpd-1), and 0.7 g of an image dye stabilizer (Cpd-7) to dissolve them, and the solution was emulsified and dispersed into 185 ml of a 10% gelatin aqueous solution containing 8 ml of 10% sodium dodecylbenzene sulfonate. Additionally, two blue-sensitive sensitizing dyes, shown below, were added to a silver chlorobromide emulsion (which had a grain size of 0.85 μm, was in the form of cubes having a variation coefficient of 0.07, and contained 1 mol % of silver bromide localized at parts of the surface of the grains based on all the grains) in amounts of $2.0\times10^{-4}$ mol respectively per mol of silver, followed by sulfur sensitization. The emulsified dispersion prepared above and the resulting emulsion were mixed and dissolved to prepare a first layer coating solution to have the composition shown below. Coating solutions for a second layer to a seventh layer were prepared in the same way as for the first layer coating solution. As the gelatin hardener of each layer, use was made of 1-oxy- 3,5-dichloro-s-triazine sodium salt.

As spectral sensitizing dyes of the respective layers, the following dyes were used:

Blue-sensitive emulsion layer

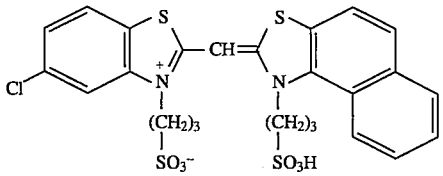

and

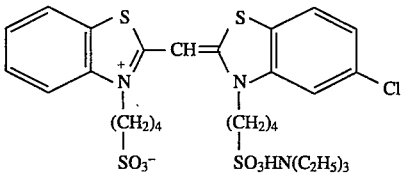

(each $2.0\times10^{-4}$ mol per mol of silver halide)

-continued

Green-sensitive emulsion layer

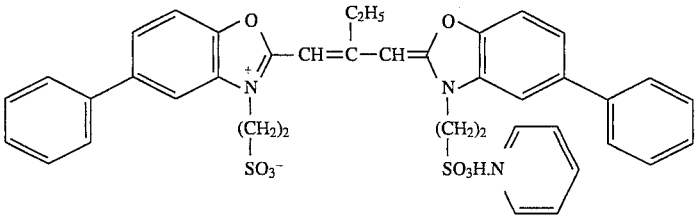

($4.0 \times 10^{-4}$ mol per mol of silver halide)

and

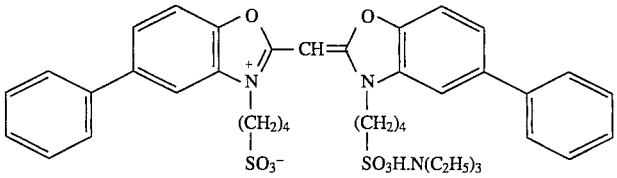

($7.0 \times 10^{-5}$ mol per mol of silver halide)

Red-sensitive emulsion layer

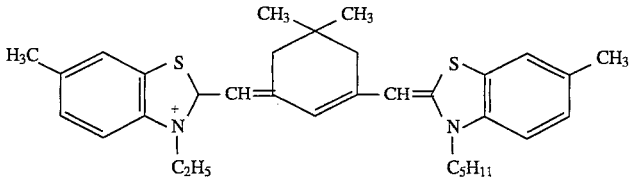

($0.9 \times 10^{-4}$ mol per mol of silver halide)

The following compound was added to the red-sensitive layer in an amount of $2.6 \times 10^{-3}$ mol per mol of silver halide.

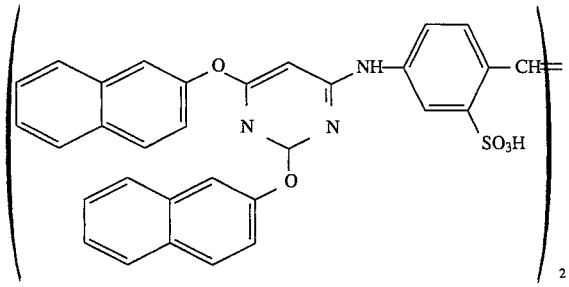

The following dyes were added to each emulsion layer for preventing irradiation.

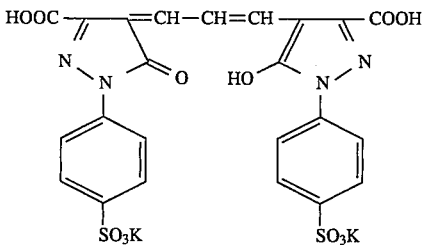

and

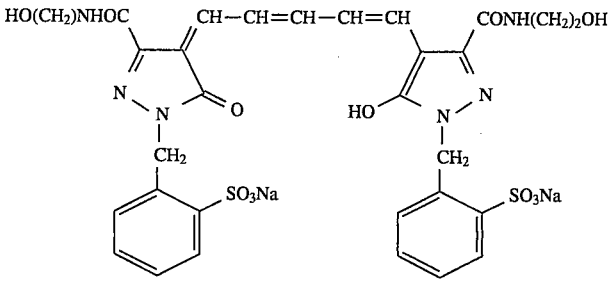

Compositions of layers

The composition of each layer is shown below. Each ingredient is indicated in g/m$^2$ of a coating amount, but the coating amount of silver halide is shown in g/m$^2$ in terms of silver.

| Supporting base: Polyethylene-laminated paper (a white pigment, $TiO_2$, and a bluish dye, ultramarine, were included in the first-layer side of the polyethylene laminated) | |
|---|---|
| First layer: Blue-sensitive layer | |
| Silver chlorobromide emulsion described above | 0.30 |
| Gelatin | 1.86 |
| Yellow coupler (ExY) | 0.82 |
| Image-dye stabilizer (Cpd-1) | 0.19 |
| Image-dye stabilizer (Cpd-7) | 0.03 |
| Solvent (Solv-3) | 0.35 |
| Second layer: Color-mix-preventing layer | |
| Gelatin | 0.99 |
| Color-mix inhibitor (Cpd-5) | 0.08 |
| Solvent (Solv-1) | 0.16 |
| Solvent (Solv-4) | 0.08 |
| Third layer: Green-sensitive emulsion layer | |
| Silver chlorobromide emulsion (cubic grains having av. grain size of 0.40 μm, deviation coefficient of grain size distribution: 0.09, AgBr contained on the part of grain surface locally: 1 mol % of total grains) | 0.36 |
| Gelatin | 1.24 |
| Magenta coupler (ExM) | 0.31 |
| Image-dye stabilizer (Cpd-3) | 0.12 |
| Image-dye stabilizer (Cpd-4) | 0.06 |
| Image-dye stabilizer (Cpd-8) | 0.09 |
| Solvent (Solv-2) | 0.42 |
| Fourth layer: UV-absorbing layer | |
| Gelatin | 1.58 |
| UV-absorbent (UV-1) | 0.47 |
| Color-mix inhibitor (Cpd-5) | 0.05 |
| Solvent (Solv-5) | 0.24 |
| Fifth layer: Red-sensitive emulsion layer | |
| Silver chlorobromide emulsion (cubic grains having av. grain size of 0.36 μm, deviation coefficient of grain size distribution: 0.11, AgBr contained on the part of grain surface locally: 1.6 mol % of | 0.21 |

-continued

| Supporting base: Polyethylene-laminated paper (a white pigment, $TiO_2$, and a bluish dye, ultramarine, were included in the first-layer side of the polyethylene laminated) | |
|---|---|
| total grains) | |
| Gelatin | 1.34 |
| Cyan coupler (ExC) | 0.34 |
| Image-dye stabilizer (Cpd-6) | 0.17 |
| Image-dye stabilizer (Cpd-7) | 0.34 |
| Image-dye stabilizer (Cpd-9) | 0.04 |
| Solvent (Solv-4) | 0.37 |
| Sixth layer: UV-absorbing layer | |
| Gelatin | 0.53 |
| UV-absorbent (UV-1) | 0.16 |
| Color-mix inhibitor (Cpd-5) | 0.02 |
| Solvent (Solv-5) | 0.08 |
| Seventh layer: Protective layer | |
| Gelatin | 1.33 |
| Acryl-modified copolymer of poly (vinyl alcohol) (modification degree: 17%) | 0.17 |
| Liquid paraffin | 0.03 |

(ExY) Yellow coupler:

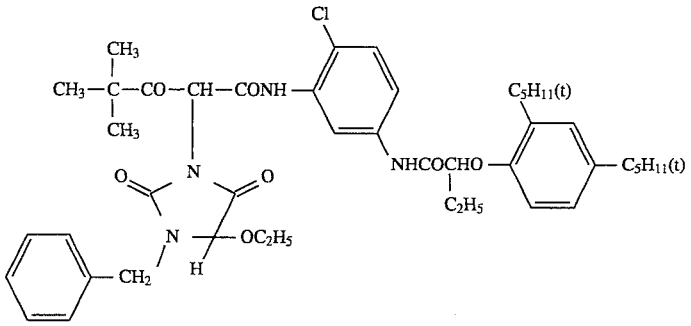

(ExM) Magenta coupler

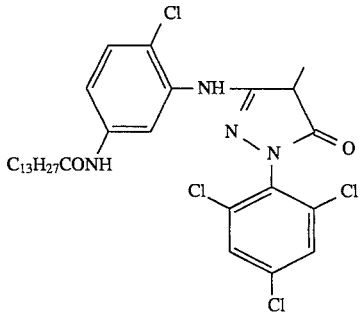

(ExC) Cyan coupler

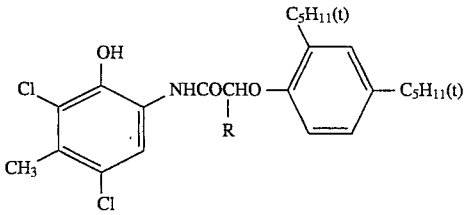

(blend of R = H, $C_2H_5$, $C_4H_9$, in weight ratio of 1:3:6)

-continued

| Supporting base: Polyethylene-laminated paper (a white pigment, $TiO_2$, and a bluish dye, ultramarine, were included in the first-layer side of the polyethylene laminated) |
|---|

(Cpd-1) Image dye stabilizer

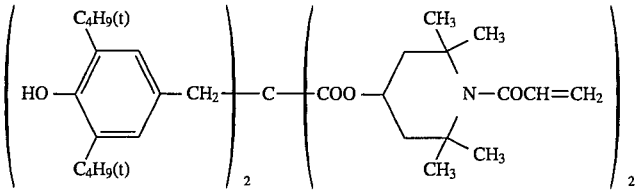

(Cpd-3) Image dye stabilizer

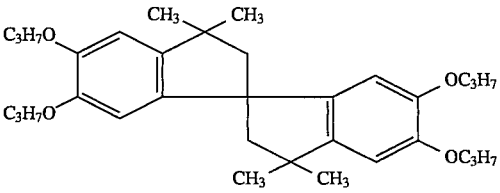

(Cpd-4) Image dye stabilizer

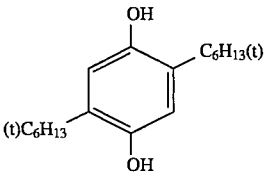

(Cpd-5) Color-mix inhibitor

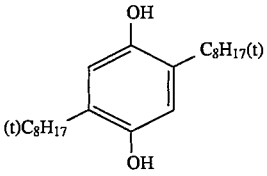

(Cpd-6) Image dye stabilizer (Blend of 2:4:4 in weight ratio)

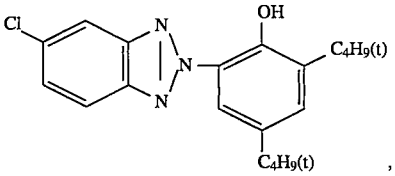

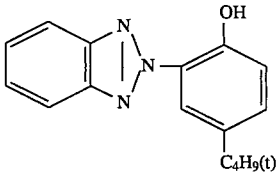

and

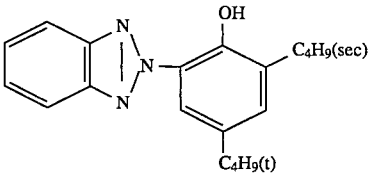

(Cpd-7) Image dye stabilizer

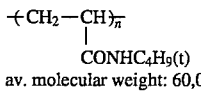

av. molecular weight: 60,000

-continued
| Supporting base: Polyethylene-laminated paper (a white pigment, $TiO_2$, and a bluish dye, ultramarine, were included in the first-layer side of the polyethylene laminated) |
|---|
(Cpd-8) Image dye stabilizer
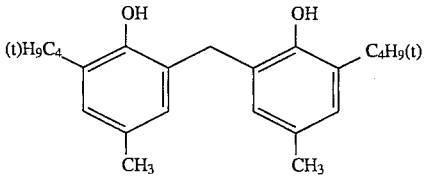
(Cpd-9) Image dye stabilizer
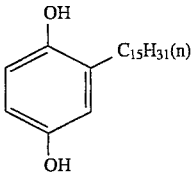
(UV-1) UV absorbent (Blend of 4:2:4 in weight ratio)
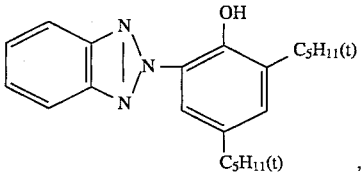
,
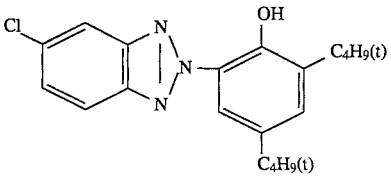
and
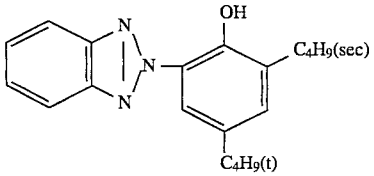
(Solv-1) Solvent
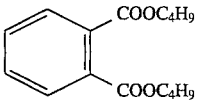
(Solv-2) Solvent (Blend 1:1 in volume ratio)
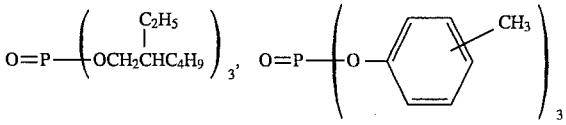
(Solv-3) Solvent
$O{=}P{-}(O{-}C_9H_{19}(iso))_3$
(Solv-4) Solvent
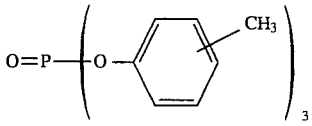

-continued

| |
|---|
| Supporting base: Polyethylene-laminated paper (a white pigment, $TiO_2$, and a bluish dye, ultramarine, were included in the first-layer side of the polyethylene laminated) |

(Solv-5) Solvent

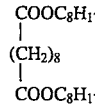

(Solv-6) Solvent

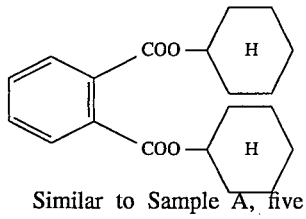

Similar to Sample A, five samples were prepared as follows:

Sample B-1: 1-(5-methylureidophenyl)-5-mercaptotetrazole ($Ksp=10^{-16.2}$) was added to each of the blue-sensitive emulsion layer, the green-sensitive emulsion layer, and the red-sensitive emulsion layer, in an amount of $5.0\times10^{-4}$ mol per mol of the silver halide.

Sample B-2: 1,1,-ethyl-2-mercapto-5-amino -1,3,4-triazole ($Ksp=10^{-14.7}$) was added to each of the blue-sensitive emulsion layer, the green-sensitive emulsion layer, and the red-sensitive emulsion layer, in an amount of $5\times10^{-4}$ mol per mol of the silver halide.

Sample C: dimethyl-dithiocarbamate ($Ksp=10^{-19.0}$) was added to each of the blue-sensitive emulsion layer, the green-sensitive emulsion layer, and the red-sensitive emulsion layer, in an amount of $5\times10^{-4}$ mol per mol of the silver halide.

Sample D: 4-hydroxy-6-methyl-1,3,3a-7-tetraazaindene ($Ksp=10^{-9.7}$) was added to each of the blue-sensitive emulsion layer, the green-sensitive emulsion layer, and the red-sensitive emulsion layer, in an amount of $5.0\times10^{-4}$ mol per mol of the silver halide.

To investigate the photographic characteristics of the coated samples, the following experiments were carried out.

first, a sensitometer (FWH model, manufactured by Fuji Photo film Co., Ltd., the color temperature of the light source was 3200 K.) was used to obtain separated B, G, and G lights for coated samples, and each sample was given a gradation exposure for sensitometer. At that time, an exposure of 250 CMS for 1/10 sec was carried out.

The above samples were processed in the following steps using the following processing compositions, with the color developer composition varied as shown in Table 1.

| Processing step | Temperature | Time |
|---|---|---|
| Color development | 38° C. | 45 sec |
| Bleach-fixing | 30 to 36° C. | 45 sec |
| Rinsing (1) | 30 to 37° C. | 30 sec |
| Rinsing (2) | 30 to 37° C. | 30 sec |
| Rinsing (3) | 30 to 37° C. | 30 sec |
| Drying | 70 to 80° C. | 60 sec |

The compositions of the processing solutions were as follows:

| Color developer | |
|---|---|
| Water | 800 ml |
| Ethylenediamine-N,N,N,N-tetramethylenephosphonic acid | 3.0 g |
| Organic preservative A (I-1) | 0.03 mol |
| Sodium chloride | see Table 1 |
| Sodium bromide | see Table 1 |
| Potassium carbonate | 25 g |
| N-ethyl-N-(β-methanesulfonamidoethyl)-3-methyl-4-aminoalinine sulfate | 5.0 g |
| Triethanolamine | 10.0 g |
| Brightening agent (4,4'-diaminostilbene type) | 2.0 g |
| Water to make | 1000 ml |
| pH (25° C.) | 10.05 |
| **Bleach-fixing solution** | |
| Water | 400 ml |
| Ammonium thiosulfate (70%) | 100 ml |
| Sodium sulfite | 17 g |
| Ethylenediaminetetraacetic acid iron (III) ammonium | 55 g |
| Ethylenediaminetetraacetic acid disodium | 5 g |
| Ammonium bromide | 40 g |
| Glacial acetic acid | 9 g |
| Water to make | 1000 ml |
| pH (25° C.) | 5.40 |
| **Rinsing** | |
| Deionized water (calcium and magnesium contents: up to 3 ppm, respectively) | |

After sensitometry was carried out using the developer immediately after its preparation, the degree of color formation of magenta was measured with an amount of blue light so that the yellow color density might be 2.0, and the obtained value ($D_G$) was taken as the scale of the processing color-contamination.

It was determined to what relative extent the degree of the logarithm of the exposure that gave a density of 0.5 to the magenta color formation obtained by the exposure to green light was small, assuming the logarithm of the maximum amount of the exposure used in this experiment to be 0. In other words, the greater the logarithm value of the exposure on the minus side is, the higher the sensitivity is. This value Δlog E was assumed as the scale of the sensitivity.

Using the processing solutions shown in Table 1, running process was carried out. During the running, the concentration of chloride ions, the concentration of bromide ions in the replenisher, and the amount of the replenisher were adjusted so that the concentration of chloride ions and the concentration of bromide ions in Table 1 might be kept constant.

In this running, a 2-l tank was used to process 50 $m^2$ of the photographic material. The difference (Dm (running)—Dm (Fn)) in the maximum density (Dm) of the magenta color formation obtained by exposure to green light between the start (the start of the development processing) and the completion of the running was assigned as ΔD, and assumed to be the scale of the fluctuation of the process.

TABLE 1

| Level | Composition of Color-developing Solution: Concentration of $Cl^-$ | Composition of Color-developing Solution: Concentration of $Br^-$ | Photographic Material (Sample NO.) | $D_G$ | ΔD | ΔlogE | Remarks |
|---|---|---|---|---|---|---|---|
| 1 | $3.0 \times 10^{-1}$ mol/l | — | A | 0.45 | −0.08 | −2.31 | Comparative Example |
| 2 | " | — | B-1 | 0.40 | −0.06 | −2.30 | " |
| 3 | " | — | C | 0.35 | −0.05 | −2.25 | " |
| 4 | " | — | D | 0.44 | −0.07 | −2.29 | " |
| 5 | $4.0 \times 10^{-2}$ mol/l | — | A | 0.48 | −0.08 | −2.49 | " |
| 6 | " | — | B-1 | 0.47 | −0.07 | −0.48 | " |
| 7 | " | — | C | 0.37 | −0.06 | −2.30 | " |
| 8 | " | — | D | 0.49 | −0.06 | −2.48 | " |
| 9 | $4.0 \times 10^{-2}$ mol/l | $5.0 \times 10^{-5}$ mol/l | A | 0.45 | −0.09 | −2.48 | " |
| 10-1 | " | " | B-1 | 0.21 | −0.03 | −2.47 | This Invention |
| 10-2 | " | " | B-2 | 0.22 | −0.02 | −2.47 | " |
| 11 | " | " | C | 0.32 | −0.06 | −2.27 | Comparative Example |
| 12 | " | " | D | 0.31 | −0.07 | −2.48 | " |
| 13 | — | $5.0 \times 10^{-5}$ mol/l | A | 0.46 | −0.10 | −2.50 | " |
| 14 | — | " | B-1 | 0.44 | −0.09 | −2.49 | " |
| 15 | — | " | C | 0.38 | −0.06 | −2.26 | " |
| 16 | — | " | D | 0.45 | −0.07 | −2.49 | " |
| 17 | — | $2.0 \times 10^{-3}$ mol/l | A | 0.39 | +0.07 | −2.22 | " |
| 18 | — | " | B-1 | 0.38 | +0.05 | −2.20 | " |
| 19 | — | " | C | 0.33 | +0.06 | −2.18 | " |
| 20 | — | " | D | 0.36 | +0.04 | −2.19 | " |

From the above results, it can be understood that when the photosensitive materials that use nitrogen-containing heterocyclic compounds, the solubility products of the silver salts of which are within the scope of the present invention, are processed with processing solutions having a concentration of chloride ions and a concentration of bromide ions of the present invention, images uniquely high in sensitivity, low in process fluctuation, and low in processing color-contamination can be formed.

EXAMPLE 2

Sample E was prepared in the same manner as Sample A in Example 1, except that the third layer (green-sensitive layer) was changed to the layer having the following composition:

| Third layer: Green-sensitive layer | |
|---|---|
| Silver chlorobromide emulsion (cubic grains having grain size of 0.40 μm, deviation coefficient of grain size distribution: 0.09, AgBr contained on the part of surface locally: 1 mol % of total grains) | 0.20 |
| Gelatin | 1.24 |
| Magenta coupler (ExM') | 0.29 |
| Image dye stabilizer (Cpd-3) | 0.09 |
| Image dye stabilizer (Cpd-4') | 0.06 |
| Solvent (Solv-2') | 0.32 |
| Solvent (Solv-7) | 0.16 |

-continued

Third layer: Green-sensitive layer (ExM')

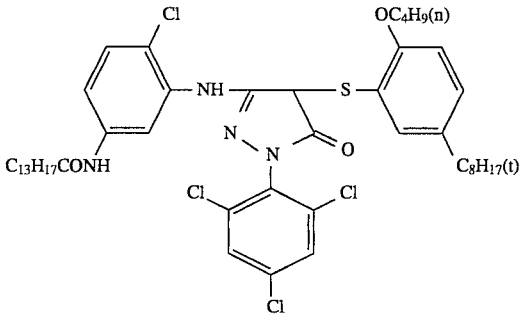

(Cpd-4') Image dye stabilizer

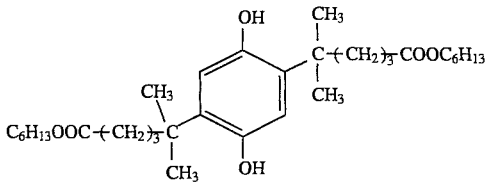

-continued

Third layer: Green-sensitive layer (Solv-2') Solvent (Blend of 3:7 in volume ratio)

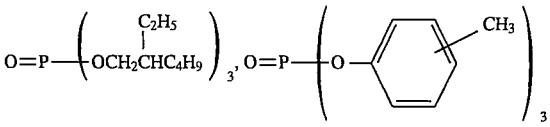

Magenta coupler (M-1)

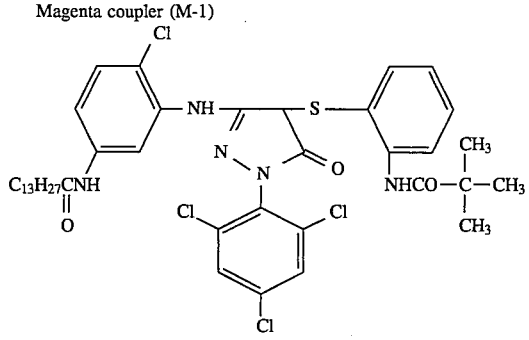

These four Samples were subjected to the same treatment as in Example 1, and obtained results are shown in Table 2.

TABLE 2

| Level | Composition of Color-developing Solution: Concentration of $Cl^-$ | Composition of Color-developing Solution: Concentration of $Br^-$ | Photographic Material (Sample NO.) | $D_G$ | ΔD | ΔlogE | Remarks |
|---|---|---|---|---|---|---|---|
| 21 | $3.0 \times 10^{-1}$ mol/l | — | E | 0.49 | −0.10 | −2.40 | Comparative Example |
| 22 | " | — | F | 0.46 | −0.09 | −2.38 | " |
| 23 | " | — | G | 0.53 | −0.08 | −2.41 | " |
| 24 | " | — | H | 0.52 | −0.08 | −2.39 | " |
| 25 | $4.0 \times 10^{-2}$ mol/l | — | E | 0.50 | −0.11 | −2.51 | " |
| 26 | " | — | F | 0.48 | −0.10 | −2.49 | " |
| 27 | " | — | G | 0.55 | −0.08 | −2.54 | " |
| 28 | " | — | H | 0.53 | −0.07 | −2.52 | " |
| 29 | $4.0 \times 10^{-2}$ mol/l | $5.0 \times 10^{-5}$ mol/l | E | 0.47 | −0.07 | −2.50 | " |
| 30 | " | " | F | 0.25 | −0.02 | −2.49 | This Invention |
| 31 | " | " | G | 0.45 | −0.04 | −2.54 | Comparative Example |
| 32 | " | " | H | 0.20 | −0.01 | −2.53 | This Invention |
| 33 | — | $5.0 \times 10^{-5}$ mol/l | E | 0.48 | −0.09 | −2.50 | Comparative Example |
| 34 | — | " | F | 0.47 | −0.09 | −2.49 | " |
| 35 | — | " | G | 0.52 | −0.07 | −2.55 | " |
| 36 | — | " | H | 0.51 | −0.06 | −2.54 | " |
| 37 | — | $2.0 \times 10^{-3}$ mol/l | E | 0.46 | +0.06 | −2.39 | " |
| 38 | — | " | F | 0.44 | +0.05 | −2.33 | " |
| 39 | — | " | G | 0.47 | +0.04 | −2.40 | " |
| 40 | — | " | H | 0.46 | +0.04 | −2.36 | " |

-continued

Third layer: Green-sensitive layer (Solv-7) Solvent

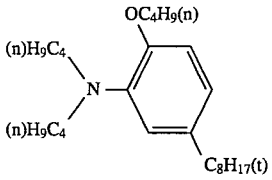

Sample F was prepared in the same manner as Sample E, except that 1-(5-methylureido-phenyl)-5-mercaptotetrazole (Ksp=$10^{-16.2}$ ) was added to the blue-sensitive emulsion layer, the green-sensitive layer, and the red-sensitive layer, in an amounts of $8.5\times10^{-5}$ mol, $7.7\times10^{-4}$ mol, and $2.5\times10^{-4}$ mol, respectively, per mol of the silver halide. Samples G and H were prepared by exchanging magenta coupler in Samples E and F to the following magenta coupler (M-1).

From the above results, it can be understood that when the photosensitive materials that use nitrogen-containing heterocyclic compounds, the solubility products of the silver salts of which are within the scope of the present invention, are processed with processing solutions having a concentration of chloride ions and a concentration of bromide ions of the present invention, images uniquely high in sensitivity, low in process fluctuation, and low in processing color-contamination can be formed. It can also be understood that when magenta couplers as used in Samples G and H are used, and processing solutions outside the scope of the present invention are used for the processing, the processing color-contamination is greater in comparison with that of cases using other couplers, thereby not allowing the images to be used practically, but when the constitution of the present invention is applied, the processing color-contamination is lessened more than with other couplers, the process fluctuation is low, and the sensitivity is high, resulting in a preferable result.

EXAMPLE 3

The procedure of Example (1) was repeated, except that the third layer (green-sensitive layer) of Sample A was changed as shown below, thereby preparing Sample I.

| Third layer (green-sensitive layer) | |
|---|---|
| Silver chlorobromide emulsion (cubes; grains having an average grain size of 0.55 μm and grains having an average grain size of 0.39 μm were mixed in a ratio of 1:3 (in Ag molar ratio); the deviation coefficients of the grain size distributions were 0.10 and 0.08, respectively; and 0.8 mol % of AgBr based on all the grains was localized at the surface of the grains) | 0.12 |
| Gelatin | 1.24 |
| Magenta coupler (ExM") | 0.27 |
| Image dye stabilizer (Cpd-3) | 0.15 |
| Image dye stabilizer (Cpd-8) | 0.02 |
| Image dye stabilizer (Cpd-9) | 0.03 |
| Solvent (Solv-2") | 0.54 |

(ExM") Magenta coupler

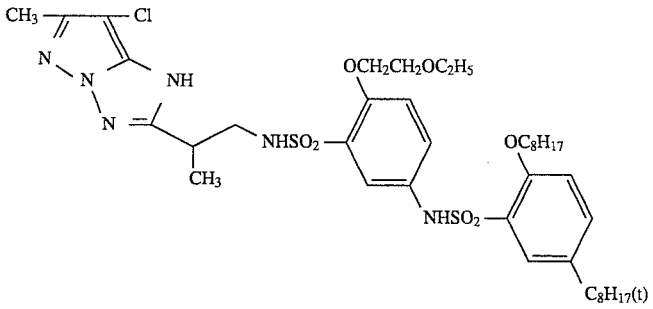

(Cpd-8) Image dye stabilizer

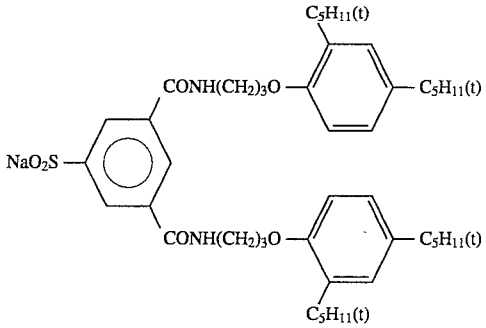

(Cpd-9) Image dye stabilizer

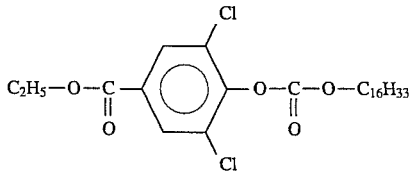

(Solv-2") Solvent (Blend of 2:1 in volume ratio)

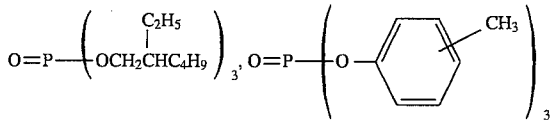

Sample J was prepared in the same manner as for Sample I, except that 1-(5-methylureidophenyl)- 5-mercaptotetrazole was added to the blue-sensitive emulsion layer, the green-sensitive emulsion layer, and the red-sensitive emulsion layer, respectively, in amounts of $8.5\times10^{-5}$ mol, $7.7\times10^{-4}$ mol, and $2.5\times10^{-4}$ mol, respectively, per mol of the silver halide. These two samples were processed in the same manner as in Example 1. The obtained results of this embodiment of the present invention satisfied the objects of the present invention.

EXAMPLE 4

A multilayer color printing paper Sample K, having a layer constitution given below, was formed on a paper base, both surfaces of which had been laminated with polyethylene. The coating solutions were prepared as follows:

Preparation of the coating solution of the first layer 150 ml of ethyl acetate, 1.0 ml of a solvent (Solv-3), and 3.0 ml of a solvent (Solv-4) were added to 60.0 g of a yellow coupler (ExY) and 28.0 g of an anti-fading additive (Cpd-1), thereby dissolving them. Then, after the solution was added to 450 ml of a 10% gelatin aqueous solution containing sodium dodecylbenzenesulfonate the solution was dispersed by an ultrasonic homogenizer, and the resulting dispersion was mixed and dissolved into 420 g of a silver chlorobromide emulsion (having a content of silver bromide of 0.7 mol %) containing the below-mentioned blue-sensitive sensitizing dye, to prepare a first layer coating solution. Coating solutions for second layer to seventh layer were prepared in the same manner as for the first layer coating solution. As the gelatin hardener for each layer, 1,2-bis(vinylsulfonyl)propane was used.

As spectral-sensitizing dyes for the respective layers, the following spectral sensitizing dyes were used:

Blue-sensitive emulsion layer: Anhydro-5,5'-chloro- 3,3'-disulfoethylthiacyanine hydroxide Green-sensitive emulsion layer: Anhydro-9-ethyl- 5,5'-diphenyl-3,3'-disulfoethyloxacarbocyanine hydroxide Red-sensitive emulsion layer: 3,3'-Diethyl-5-methoxy-9,9'-(2,2'-dimethyl-1,3-propano) thiacarbocyanine iodide As antiirradiation dyes, the following compounds were used:

[3-Carboxy-5-hydroxy-4-(3-(3-carboxy-5-oxo-1-(2,5-disulfonatophenyl)-2-pyrazolin-4-ilidene)- 1 -propenyl)-1-pyrazolyl]benzene-2,5-disulfonato disodium salt, N,N'-(4,8-Dihydroxy-9,10-dioxo- 3,7-disulfonatoanthracene-1,5-diyl)bis(aminomethanesulfonato) tetrasodium salt, and

[3-cyano-5-hydroxy-4-(3-(3-cyano-5-oxo-l-( 4-sulfonatophenyl)-2-pyrazolin-4-ilidene)-l-pentanyl)-1-pyrazolyl]benzene-4-sulfonato sodium salt Layer composition The compositions of the layers are shown below. The figures show the coating amounts (g/m$^2$). The coating amounts of the silver halide emulsions are given in terms of silver.

Base

A paper base whose both surfaces had been laminated with polyethylene.

| | |
|---|---|
| First layer (blue-sensitive emulsion layer) | |
| Silver halide emulsion (AgBr: 0.7 mol %; cubes; grain size: 0.9 μm) | 0.29 |
| Gelatin | 1.80 |
| Yellow coupler (ExY) | 0.60 |
| Anti-fading additive (Cpd-1) | 0.28 |
| Solvent (Solv-3) | 0.01 |
| Solvent (Solv-4) | 0.03 |
| Second layer (color-mix inhibiting emulsion layer) | |
| Gelatin | 0.80 |
| Color-mixing inhibitor (Cpd-2) | 0.055 |
| Solvent (Solv-1) | 0.03 |
| Solvent (Solv-2) | 0.015 |
| Third layer (green-sensitive layer) | |
| Silver halide emulsion (AgBr: 0.7 mol %; cubes; grain size: 0.45 μm) | 0.305 |
| Gelatin | 1.40 |
| Magenta coupler (ExM) | 0.67 |
| Anti-fading additive (Cpd-3) | 0.23 |
| Anti-fading additive (Cpd-4) | 0.11 |
| Solvent (Solv-1) | 0.20 |
| Solvent (Solv-2) | 0.02 |
| Fourth layer (color-mix inhibiting layer) | |
| Gelatin | 1.70 |
| Color-mixing inhibitor (Cpd-2) | 0.065 |
| Ultraviolet absorber (UV-1) | 0.45 |
| Ultraviolet absorber (UV-2) | 0.23 |
| Solvent (Solv-1) | 0.05 |
| Solvent (Solv-2) | 0.05 |
| Fifth layer (red-sensitive emulsion layer) | |
| Silver halide emulsion (AgBr: 4 mol %; cubes; grain size: 0.5 μm) | 0.21 |
| Gelatin | 1.80 |
| Cyan coupler (ExC-1) | 0.26 |
| Cyan coupler (ExC-2) | 0.12 |
| Anti-Fading additive (Cpd-1) | 0.20 |
| Solvent (Solv-1) | 0.16 |
| Solvent (Solv-2) | 0.09 |
| Sixth layer ultraviolet-absorbing layer) | |
| Gelatin | 0.70 |
| Ultraviolet absorber (UV-1) | 0.26 |
| Ultraviolet absorber (UV-2) | 0.07 |
| Solvent (Solv-1) | 0.30 |
| Solvent (Solv-2) | 0.09 |
| Seventh layer (protective layer) | |
| Gelatin | 1.07 |

(ExY) Yellow coupler:

α-pivalyl-α-(3-benzyl-1-hydantoynyl)-2-chloro-5[β-(dodecylsulfonyl)butylamido]acetanilide (ExM) Magenta coupler:

1-(2,4,6-trichlorophenyl)-3 [2-chloro-5(3-octadecenylsuccinimido)anilino]-5-pyrazolone (ExC-1) Cyan coupler:

2-pentafluorobenzamido-4-chloro-5 [2-(2,4-di-tert-amylphenoxy)- 3-methylbutylamido)phenol (ExC-2) Cyan coupler:

2,4-dichloro-3-methyl-6-[α-(2,4-di-tert-amylphenoxy) butylamido)phenol (Cpd-1) Anti-fading additive:

2,5-di-tert-amylphenyl-3,5-di-tert-butylhydroxybenzoate (Cpd-2) Color-mixing inhibitor:

2,5-di-tert-octylhydroquinone (Cpd-3) Anti-fading additive:

1,4-di-tert-amyl-2,5-dioctyloxybenzene (Cpd-4) Anti-fading additive:

2,2'-methylenebis(4-methyl-6-tert-butylphenol)

(UV-1) Ultraviolet absorber:

2-(2-hydroxy-3,5-di-tert-amylphenyl)benzotriazole (UV-2) Ultraviolet absorber:

2-(2-hydroxy-3,5-di-tert-butylphenyl)benzotriazole (Solv-1) Solvent:

di(2-ethylhexyl)phthalate (Solv-2) Solvent:

dibutylphthalate (Cpd-5 ):

p-(p-toluenesulfonamido)-phenyldodecane (Solv-3) Solvent:

di(inonyl)phthalate (Solv-4) Solvent:

N,N-diethylcarboamidomethoxy-2,4-di-t-amylbenzene

Sample L was prepared in the same manner as for Sample K, except that a 7: 2: 1 (molar ratio) mixture (pKsp=16.4) of 1-(2-acetoaminophenyl)-5-mercaptotetrazole, 1-phenyl-5-mercaptotetrazole, and 1-(p-methoxyphenyl)- 5-mercaptotetrazole was added to each of the blue-sensitive emulsion layer, the green-sensitive emulsion layer, and the red-sensitive emulsion layer in an amount of $7.0\times10^{-4}$ mol per mol of the silver halide. These two samples were subjected to the following processes, and were assessed in the same way as in Example 1.

The obtained results satisfied the objects of the present invention.

After the above photographic materials were exposed through an optical wedge, they were processed in the following steps:

| Processing step | Temperature | Time |
|---|---|---|
| Color development | 35° C. | 45 sec |
| Bleach-fixing | 30 to 36° C. | 45 sec |
| Stabilization (1) | 30 to 37° C. | 20 sec |
| Stabilization (2) | 30 to 37° C. | 20 sec |
| Stabilization (3) | 30 to 37° C. | 20 sec |
| Stabilization (4) | 30 to 37° C. | 30 sec |
| Drying | 70 to 85° C. | 60 sec |

(A four-tank countercurrent of stabilization (4) to (1) was used)

The compositions of the processing solutions were as follows:

| Color developer | |
|---|---|
| Water | 800 ml |
| Ethylenediaminetetraacetate | 2.0 g |
| Triethanolamine | 8.0 g |
| Sodium chloride (varied in the same way as shown in Table 1 of Example 1) | |
| Sodium bromide (varied in the same way as shown in Table 1 of Example 1) | |
| Potassium carbonate | 25 g |
| N-ethyl-N-($_{\beta}$-methanesulfonamidoethyl)-3-methyl-4-aminoalinine sulfate | 5.0 g |
| N,N-diethylhydroxylamine | 4.2 g |
| 5,6-dihydroxybenzene-1,2,4-tolylsulfonic acid | 0.3 g |
| Brightening agent (4,4'-diaminostilbene series) | 2.0 g |
| Water to make | 1000 ml |
| pH (25° C.) | 10.10 |
| **Bleach-fixing solution** | |
| Water | 400 ml |
| Ammonium thiosulfate (70%) | 100 ml |
| Sodium sulfite | 18 g |
| Ammonium iron (III) ethylenediaminetetraacetate | 55 g |
| Disodiumethylenediaminetetraacetate | 5 g |

-continued

| | |
|---|---|
| Glacial acetic acid | 8 g |
| Water to make | 1000 ml |
| pH (25° C.) | 5.50 |
| **Stabilizer** | |
| Formalin (37%) | 0.1 g |
| Formalin-sulfurous acid adduct | 0.7 g |
| 5-chloro-2-methyl-4-isothiazolin-3-one | 0.02 |
| 2-methyl-4-isothiazolin-3-one | 0.01 g |
| Copper sulfate | 0.005 g |
| Water to make | 1000 ml |
| pH (25 °C.) | 4.0 |

EXAMPLE 5

Sample B-1 in Example 1 was used to confirm the dependability on the chloride ion concentration and the bromide ion concentration of developers, and assessment similar to the assessment in Example (1) was carried out using developers having compositions shown in Table 3.

The results are shown in Table 3.

TABLE 3

| Level | Composition of Color-developing Solution: Concentration of $Cl^-$ | Concentration of $Br^-$ | $D_G$ | ΔD | ΔlogE | Remarks |
|---|---|---|---|---|---|---|
| 41 | $3.0\times10^{-1}$ mol/l | $2.0\times10^{-3}$ mol/l | 0.37 | +0.09 | −2.18 | Comparative Example |
| 42 | $1\times10^{-1}$ mol/l | $5\times10^{-4}$ mol/l | 0.20 | +0.02 | −2.43 | This Invention |
| 43 | $1\times10^{-2}$ mol/l | $1\times10^{-4}$ mol/l | 0.21 | −0.01 | −2.45 | " |
| 44 | $4\times10^{-2}$ mol/l | $5\times10^{-5}$ mol/l | 0.21 | −0.03 | −2.47 | " |
| 45 | $1\times10^{-2}$ mol/l | $1\times10^{-5}$ mol/l | 0.43 | −0.10 | −2.48 | Comparative Example |

From the above results, it can be understood that when photographic materials having the constitution of the present invention are processed with the processing solutions according to the present invention, images low in processing color-contamination and process fluctuation and high in sensitivity can be formed.

EXAMPLE 6

Similar to Sample E of Example 2, Samples M, N, O, P, and Q were prepared using (M-2), (M-3), (M-49), (M-56), and (M-60), described herein as magenta couplers. In these five samples, 1-(5-methylureidophenyl)-5-mercaptotetrazole (Ksp=$10^{-16.2}$) was added to the blue-sensitive emulsion layer, the green-sensitive emulsion layer, and the red-sensitive emulsion layer, respectively, in amounts of $8.5\times10^{-5}$ mol, $7.7\times10^{-4}$ mol, and $2.5\times10^{-4}$ mol, respectively, per mol of the silver halide, and these samples were named Samples R, S, T, U, and V, respectively.

These ten samples were processed in the same way as in Example 1. Samples R, S, T, U, and V satisfied the present invention when the processing mode according to the present invention was used.

Having described our invention as related to the embodiment, it is our intention that the invention be not limited by any of the details of the description, unless otherwise specified, but rather be construed broadly within its spirit and scope as set out in the accompanying claims.

What we claim is:

1. A method for forming an image, which comprises processing an image-wise exposed silver halide color photographic material comprising a base having thereon at least red-sensitive, blue-sensitive and green-sensitive silver halide emulsion layers each containing at least one corresponding color coupler, and a magenta coupler in the green-sensitive silver halide emulsion layer is a 5-pyrazolone magenta coupler represented by the following formula:

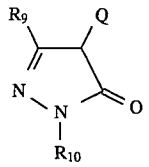

wherein $R_{10}$ represents an unsubstituted aryl group or a phenyl group having at least one substituent selected from the group consisting of a halogen atom, an alkyl group, an alkoxy group, an alkoxycarbonyl group, an acylamino group, a sulfamido group, a sulfonamido group, and a cyano group, Q represents a coupling split-off group represented by formula (V) below, and $R_9$ represents an anilino group of the following formula:

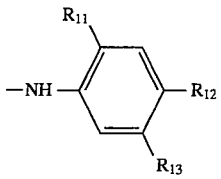

wherein $R_{11}$ represents an alkoxy group having 1 to 30 carbon atoms, an aryloxy group or a halogen atom, and $R_{12}$ and $R_{13}$ each represents a hydrogen atom, a halogen atom, an alkyl group, an alkoxy group, an acylamino group, a sulfonamido group, a sulfamoyl group, a sulfamido group, a carbamoyl group, a diacylamino group, an aryloxycarbonyl group, an alkoxycarbonyl group, an alkoxysulfonyl group, an aryloxysulfonyl group, an alkanesulfonyl group, an arylenesulfonyl group, an alkylthio group, an arylthio group, an alkoxycarbonylamino group, an alkylureido group, an acyl group, a nitro group, or a carboxyl group;

Formula (V)

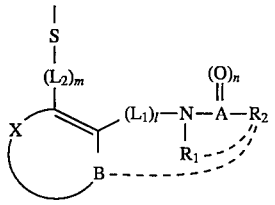

wherein $L_1$ and $L_2$ each represent a methylene group or an ethylene group, l and m each are 0 or 1, $R_1$ represents a hydrogen atom, an alkyl group, an aryl group, or a heterocyclic group, $R_2$ represents a group bonded to A through a carbon atom, an oxygen atom, a nitrogen atom, or a sulfur atom, A represents a carbon atom or a sulfur atom, n is 1 when A is a carbon atom, or 1 or 2 when A is a sulfur atom, B represents a carbon atom, an oxygen atom, a nitrogen atom, or a sulfur atom, X represents a group of atoms required for forming a ring, $R_1$ and $R_2$ may bond together to form a ring, and B and $R_2$ may bond together to form a ring when B represents a carbon atom or a nitrogen atom, at least said green-sensitive silver halide emulsion layer comprises a high-silver-chloride silver halide emulsion comprising silver halide grains, 95 mol % or more of said grains comprising silver chloride and said grains comprising a localized silver bromide layer, and said green-sensitive silver halide emulsion layer containing an anti-fogging nitrogen-containing heterocyclic compounds elected from the group consisting of mercaptotriazoles and mercaptotetrazoles in an amount of $1\times10^{-4}$ to $1\times10^{-1}$ mol per mol of silver halide, the solubility product of which for the silver salt is $10^{-10}$ or less but $10^{-18}$ or more, with a color developer containing chloride ions in an amount of $4.0\times10^{-2}$ to 1.0–1 mol/l and bromide ions in an amount of $5.0\times10^{-5}$ to $5.0\times10^{-4}$ mol/l.

2. The method as claimed in claim 1, wherein the high-silver-chloride silver halide emulsion is substantially free from silver iodide.

3. The method as claim 1, wherein the solubility product for the silver salt $10^{-10.5}$ to $10^{-16.5}$.

4. The method as claimed in claim 1, wherein the high-silver-chloride silver emulsion comprises grains having a layered-structure.

5. The method as claimed in claim 1, wherein the high-silver-chloride silver halide emulsion comprises grains having a structure with nonlayered parts different in halogen composition, inside the grain or on the surface of the grain.

6. The method as claimed in claim 1, wherein the coating amount of silver of the silver halide color photographic material is 0.90 g/m$^2$or less.

7. The method as claimed in claim 1 wherein the silver halide color photographic material contains a cyan coupler selected from the group consisting of phenolcyan couplers and naphthol-cyan couplers.

8. The method as claimed in claim 1, wherein the color developer is substantially free from sulfite ions.

9. The method as claimed in claim 1, wherein the processing time of the color development is in the range of 20 seconds to 5 minutes.

10. The method as claimed in claim 1, wherein said high-silver-chloride silver halide emulsion comprises 98 to 100 mol % of silver chloride.

11. The method as claimed in claim 1, wherein the silver bromide content in the localized layer is at least 10 mol %.

12. The method as claimed in claim 1, wherein each of the red-sensitive and blue-sensitive emulsion layers comprise silver halide grains which comprise 95 mol % or more of silver chloride.

13. The method as claimed in claim 1, wherein the silver halide grains in the green-sensitive silver halide emulsion layer containing said 5-pyrazolone magenta coupler comprise 98 mol % or more of silver chloride.

14. The method as claimed in claim 1, wherein the silver bromide content in the localized layer is at least 10 mol %, and the silver halide grains in the green-sensitive silver halide emulsion layer containing said 5-pyrazolone magenta coupler comprise 98 mol % or more of silver chloride.

* * * * *